US007274305B1

(12) United States Patent
Luttrell

(10) Patent No.: US 7,274,305 B1
(45) Date of Patent: Sep. 25, 2007

(54) ELECTRICAL UTILITY COMMUNICATIONS AND CONTROL SYSTEM

(75) Inventor: Clyde K. Luttrell, Huntsville, AL (US)

(73) Assignee: Carina Technology, Inc., Huntsville, AL (US)

( * ) Notice: Subject to any disclaimer, the term of this patent is extended or adjusted under 35 U.S.C. 154(b) by 291 days.

(21) Appl. No.: 10/882,931

(22) Filed: Jul. 1, 2004

Related U.S. Application Data

(63) Continuation-in-part of application No. 10/613,430, filed on Jul. 3, 2003, now Pat. No. 6,995,666.

(60) Provisional application No. 60/418,922, filed on Oct. 16, 2002.

(51) Int. Cl.
*G08C 15/06* (2006.01)

(52) U.S. Cl. ..... 340/870.02; 340/870.01; 340/870.03; 324/141; 324/142; 324/143

(58) Field of Classification Search ..... 340/870.02, 340/870.01, 870.03; 705/1; 324/142, 141, 324/143; 455/7; 361/661
See application file for complete search history.

(56) References Cited

U.S. PATENT DOCUMENTS

| | | | | |
|---|---|---|---|---|
| 4,638,314 | A * | 1/1987 | Keller | 340/870.02 |
| 4,977,482 | A * | 12/1990 | Langdon et al. | 361/661 |
| 5,767,790 | A * | 6/1998 | Jovellana | 340/870.02 |
| 5,873,043 | A | 2/1999 | Comer et al. | |
| 6,014,089 | A | 1/2000 | Tracy et al. | |
| 6,072,874 | A | 6/2000 | Shin et al. | |
| 6,078,785 | A * | 6/2000 | Bush | 455/7 |
| 6,108,537 | A | 8/2000 | Comer et al. | |
| 6,178,337 | B1 | 1/2001 | Spartz et al. | |
| 6,393,297 | B1 | 5/2002 | Song | |
| 6,538,577 | B1 * | 3/2003 | Ehrke et al. | 340/870.02 |
| 6,571,093 | B1 | 5/2003 | Jarrett, Jr. | |
| 6,681,110 | B1 | 1/2004 | Crookham et al. | |
| 6,718,177 | B1 | 4/2004 | Comer et al. | |
| 6,734,663 | B2 * | 5/2004 | Fye et al. | 324/142 |
| 7,091,878 | B2 * | 8/2006 | Holle et al. | 340/870.02 |
| 2003/0167178 | A1 * | 9/2003 | Jarman et al. | 705/1 |

* cited by examiner

*Primary Examiner*—Jeffery Hofsass
*Assistant Examiner*—Sisay Yacob
(74) *Attorney, Agent, or Firm*—Lanier Ford Shaver & Payne P.C.; Angela Holt

(57) ABSTRACT

A system for managing collection of data and remote operation of fielded remote units is disclosed. The remote units may be incorporated in automatic meter reading systems, capacitor bank switching systems, power line fault detection units, power recloser units, surveillance systems, railroad switch heaters, or any of a multitude of systems wherein widely scattered devices require monitoring and/or operational commands. Each remote unit is provided with a CELLEMETRY™ transceiver, allowing the unit to receive commands from and pass data to a data center via the cellular control channel network and the Internet. The data center is organized to provide data related to a particular service to an associated customer user via the Internet, the customer users being utility companies, railroad companies, surveillance companies, and the like. Particularly, electrical, gas and water utilities may advantageously utilize Applicant's system for automatic meter reading, prepaid utilities, fault location in 3 phase power, preventative power outage monitoring, and power outage monitoring.

26 Claims, 59 Drawing Sheets

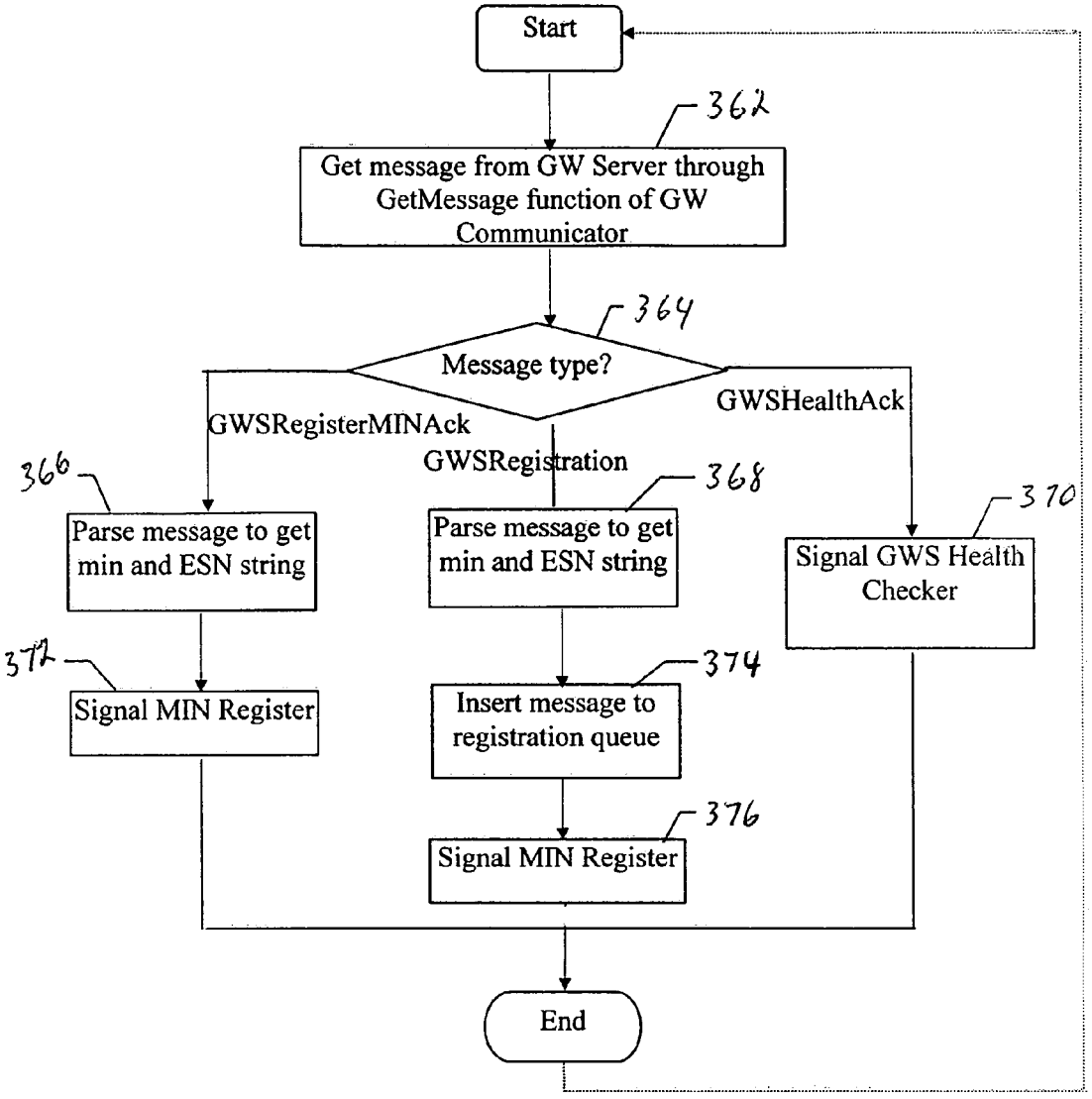
FIG; 11c

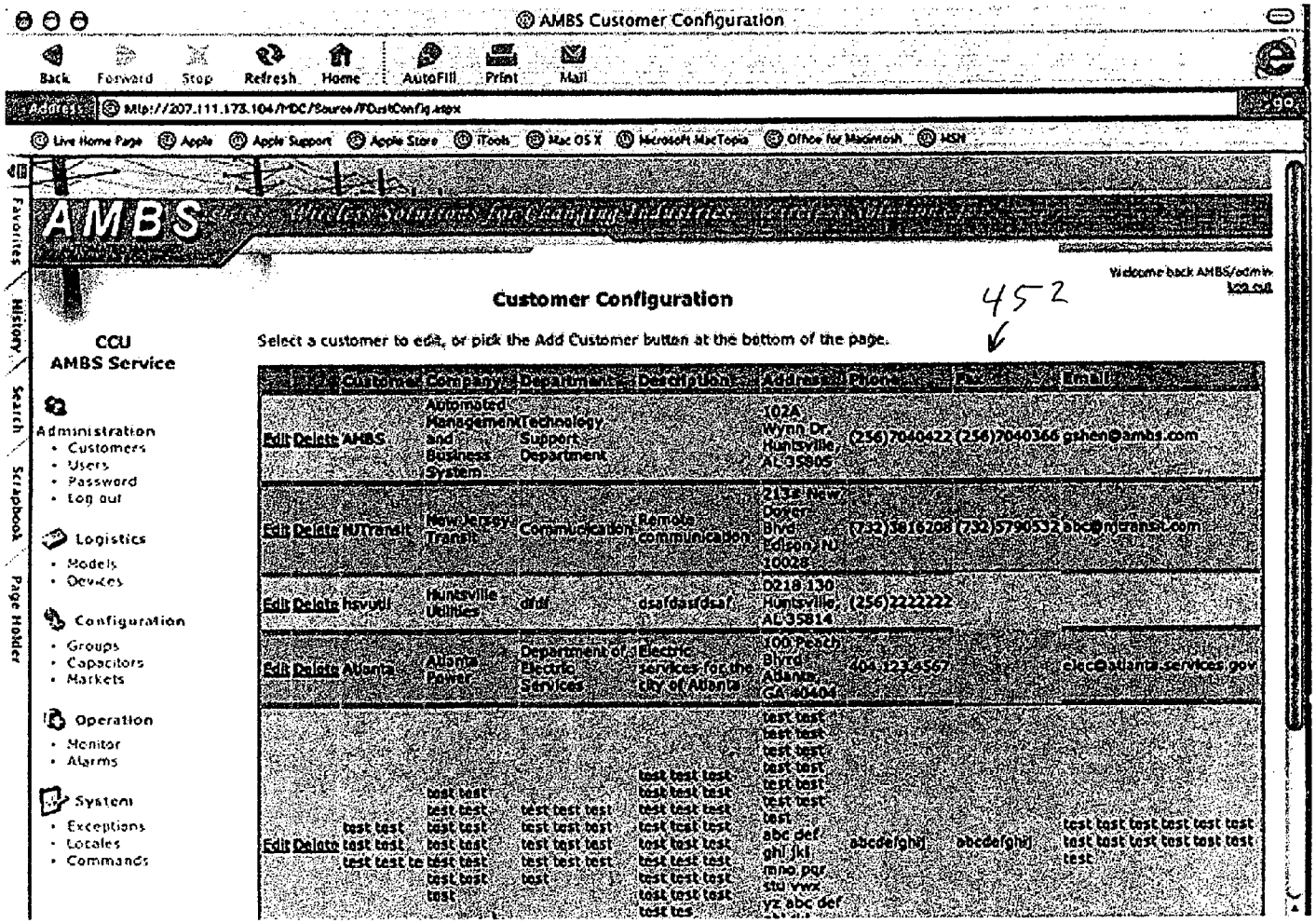
AMBS Customer Configuration
Back
Forward
Stop
Refresh
Home
AutoFill
Print
Mail
Live Home Page
Apple
Apple Support
Apple Store
iTools
Mac OS X
Microsoft MacTopia
Office for Macintosh
MSN
AMBS
CCU
AMBS Service
Administration
Customers
Users
Password
Log out
Logistics
Models
Devices
Configuration
Groups
Capacitors
Markets
Operation
Monitor
Alarms
System
Exceptions
Locales
Commands
Customer Configuration
Select a customer to edit, or pick the Add Customer button at the bottom of the page.
Edit Delete AMBS Automated Management Technology and Support Business System 102A Wynn Dr. Huntsville AL35805 (256)7840422 (256)7840366 gphen@ambs.com
Edit Delete NJTransit New Jersey Transit Communication Remote Communication Direct 213 New Dover Edison NJ 10028 (732)3816208 (732)5790532 bx@njtransit.com
Edit Delete hewlett Huntsville dfd 0218130 Huntsville (256)2222222
Edit Delete Alpha Power Department of Electric Services for the City of Atlanta 100 Peachtree Street Atlanta GA 40404 404 223-4567 ehc@atlanta-services.gov
test test test

ELECTRICAL UTILITY COMMUNICATIONS AND CONTROL SYSTEM

CROSS-REFERENCE TO RELATED APPLICATIONS

This application is a continuation-in-part of Applicant's patent application Ser. No. 10/613,430, filed Jul. 3, 2003 now U.S. Pat. No. 6,995,666, which claims the benefit of provisional application No. 60/418,922, filed 10/16/2002.

FIELD OF THE INVENTION

This invention pertains generally to a control and monitoring system for a plurality of end user companies such as utility companies, surveillance companies, railroad companies and the like, and particularly to a system for monitoring and controlling various parameters and functions related to utilities and these other services. Data related to the services may be automatically collected and sent via control channels of the cellular network to a central data location, where the data is provided to the end user companies. This system also incorporates apparatus for remote electrical power connect/disconnect functions and notification to the user of impending termination of electrical service in an electrical power prepay environment, electrical power outage monitoring, power factor control, phase fault detection, preventative power outage maintenance and power outage maintenance.

BACKGROUND OF THE INVENTION

In general, utility companies, for the most part, have eliminated the practice of manually collecting water, gas and electricity meter readings. Instead, utility usage sensors and a small electronics package including a low-power radio transmitter, which is battery powered in the case of water and gas meters, is coupled to the meter for sending the meter reading wirelessly to a nearby meter reading collector. In some instances, collecting the meter readings simply involves driving a vehicle equipped with a combined radio triggering device and electronic memory storage for the meter readings past a meter, such as a water or gas meter, so that the radio triggering device causes the meter transmitter to "burst" the meter reading out in the form of a wireless transmission. This transmission is picked up by the receiver and stored in memory for later retrieval. Thus, a meter reader simply drives past a meter to obtain the reading. In other implementations, a meter reader is required to walk up to the meter and touch it with a wand or the like, which incorporates a radio triggering device and memory storage for the meter readings, to likewise obtain the meter readings.

In addition to these so-called "automatic" meter reading systems, prepaid electrical power systems are becoming increasingly common as cost and demand of electricity continues to increase. In instances of individuals who have marginal ability to pay and/or may have dubious credit history, situations where an electrical power technician is sent to disconnect electrical power from a residence of such an individual may become volatile. There have been instances where utility workers have been attacked, and even killed, in confrontations with electrical power users over disconnection of electrical service. Further, notification laws have been passed in areas where disconnection of electrical power may result in direct harm to individuals due to severe inclement conditions, such as from cold weather. In these areas, disconnection of electrical power may not be done without prior notification, which may be a week or more.

During that notification period, the individual may continue to use electrical power that may never be paid for. Other problems related to connecting/disconnecting electrical power are that a trained technician must be sent to the site to perform the electrical connection or disconnection of service.

Due to these problems, limited prepaid systems have been implemented. In one such system devised by COMVERGE™, an adapter is plugged into the electrical meter base, with the electrical meter plugged into the adapter. A 200 amp switch coupled to a VHF radio receiver makes or breaks electrical connection between the meter and the user responsive to an ON/OFF VHF signal on a channel reserved for utilities communications (139-174 Mhz). As such, all this system is capable of doing is performing connections and disconnects of electrical power responsive to the VHF signal from the electrical utilities office. In this application, there may be a collection point every square mile or so, depending on topography where houses and collection points are situated.

In addition to the foregoing, other problems are present in management of electrical utilities. For instance, with respect to three phase power, which is common in industrial applications, it is not particularly uncommon for one phase to lose power. When this happens, unprotected equipment, such as motors, may be destroyed.

Utility companies typically attempt to balance loading on three phase circuits so that generators are not overly strained and subject to damage. Here, power factor of each of the three phases is monitored, and if it becomes unbalanced, then capacitor banks consisting of large capacitors are coupled between respective phase lines and a neutral line to connect a large amount of capacitance to the power lines.

In other instances, utility companies use reclosers, which are designed to burn off small limbs, animals such as squirrels and other things that may short out a power line. Here, a recloser functions initially as a circuit breaker to remove power from a shorted power line, but after a brief delay, such as 2 seconds or so, will typically make three attempts to reapply power to the line in order to burn off the object shorting the line. After the third attempt, if the short is still present, the recloser will remain open, requiring utility service personnel to remove the object and possibly repair the line. Where reclosers are operating more frequently than normal, such as in a neighborhood, it may indicate to the utility company that trees in the neighborhood are in need of trimming. In addition, where a recloser is unable to burn off the short, a utility company currently has no way of knowing that power downstream of that recloser is out until people begin to call the utility company to complain.

In related situations, a recloser may be put on a service line to a neighborhood of a hundred or more residences, while every 10 houses or so in the neighborhood may be protected by a fuse in the power line. Here, the recloser may be applying power to the line but a fuse may have blown. Again, the utility company has no way of knowing the fuse is blown until people call to complain that their electrical power is out.

In view of the foregoing, Applicant proposes an integrated system wherein, in a basic embodiment, electrical power connect/disconnect capability is integrated with automatic meter reading wherein the meter reading and connect/disconnect commands are conveyed over control channels of the cellular network and the Internet between the power user and a central location. In an enhancement of the basic embodiment, a prepaid electrical power system is disclosed that automatically provides notification to the user of an impending termination of electrical power. In another embodiment, water, gas and electric meter readings are transmitted by a low-power transmitter to a collection point, which then transmits the readings to a central location over the control channels of the cellular network and the Internet. Any of Applicant's electrical power systems may be configured to transmit data related to power outages so that a utility company may determine in real time exactly where a power outage has occurred. In addition, Applicant proposes a data collection system wherein a data center receives all the data from a diverse variety of sources, such as those described above, and from other sources such as surveillance systems, railroad switch heater systems and others. The data center integrates data from the various sources and allows customer users to access their respective data.

BRIEF DESCRIPTION OF THE DRAWINGS

FIG. 11*c* is a flowchart of another of the processes initialized in the flowchart of FIG. 10.

FIG. 13 is an image of a main menu screen presented to a user after log-in.

FIG. 14 is an image of a customer configuration screen accessible from the screen of FIG. 13.

FIG. 16*a* is an image of a screen accessible from the screens of FIGS. 14 and 14*a*.

DETAILED DESCRIPTION OF THE DRAWINGS

As stated, Applicant's system is a communications, monitoring and control system that may be used in almost any situation where it is desirable to monitor switch closures, or to cause switch closures. As such, Applicant's system is applicable to a wide range of other systems such as, but not limited to, surveillance systems, sewage systems, water and gas utilities systems, and others. In this application, it is to be understood that while a communications system for electrical utilities is disclosed, such disclosure is by way of example only and those skilled in the art should easily understand how Applicant's system may be interfaced with many other systems.

Figure 1:
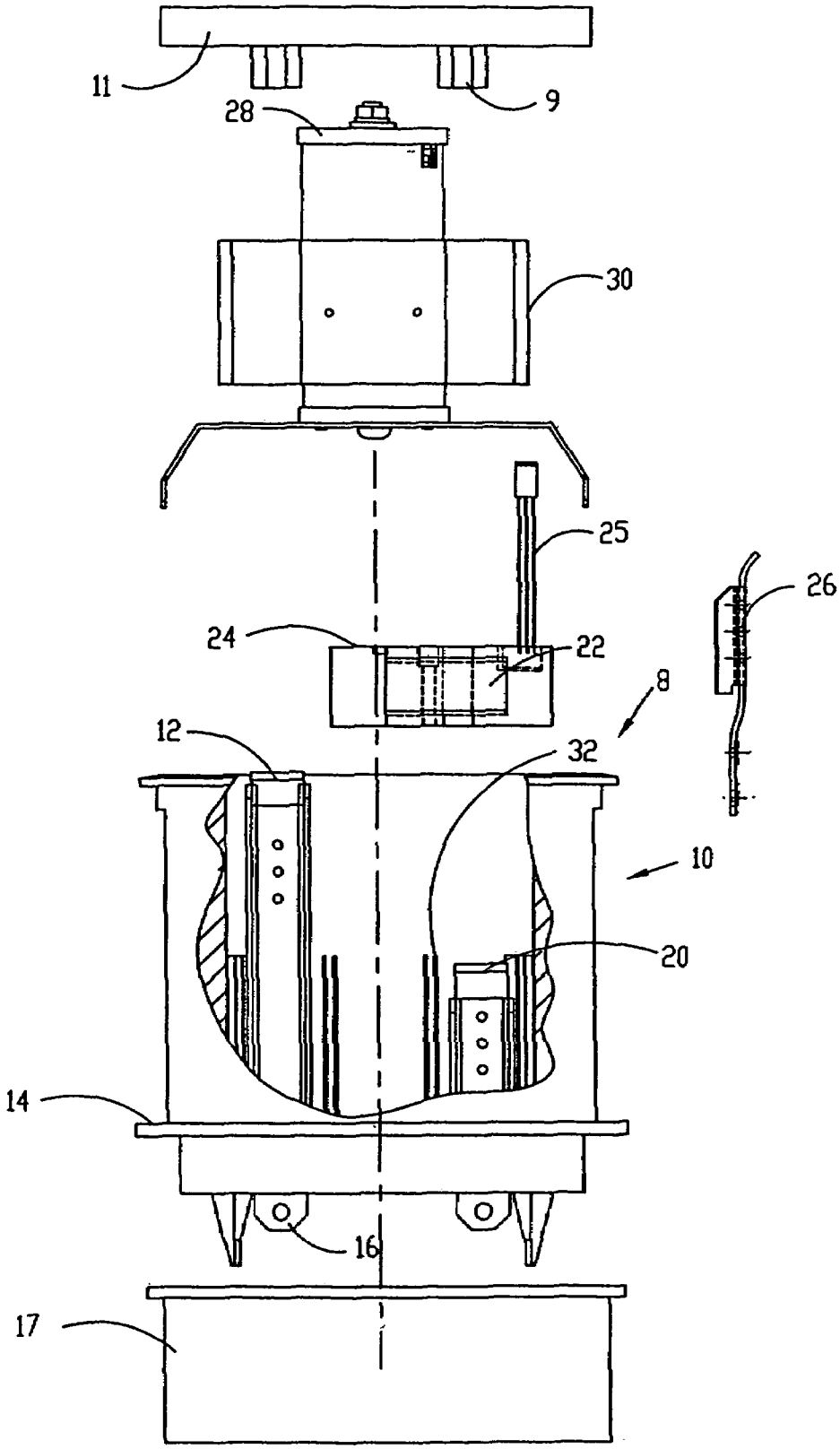
FIG. 1 is a partially diagrammatic exploded view of one embodiment of my invention.

Referring initially to FIG. 1, an illustration of an electrical utility meter adapter or collar 10 is disclosed. Enclosed at upper end 8 of collar 10 are a pair of conventional terminals 12 for receiving prongs 9 of an electrical power meter 11 that otherwise would plug into an electrical meter base 13 mounted to a residence or facility to be connected to electrical power, the base 13 being connected to electrical power from a utility pole or underground electrical utility source. Conventionally, on the electrical power meter, these prongs are simply flat terminals extending outward from the bottom of the meter. Terminals 12 extend the length of collar 10 and connect between the ground and neutral lines of the base 13 and meter 11. On a bottom side 14 of collar 10 are prongs 16 (only 1 shown) that plug into mating plugs 17 of the electrical meter base 13 in place of the meter. Thus, the lower end 14 of collar 10 is configured as a meter, and takes the place of a meter when plugged into base 13.

Within collar 10 are two shorter terminals 20 that receive corresponding prong-type terminals 22 of a 200 amp or so solid state contactor 24, which functions as a relay, and to which 230 volt power is applied from the electrical utilities meter. As such, contactor 24 is positioned to make or break electrical power between the meter and base 13 that in turn provides electrical power to the residence or facility to which it is connected. Extending from terminals 22 of contactor 24 are a pair of extension terminals 26 (only 1 shown) that respectively carry each of the 115 volt phases as controlled by the contactor and which extend upward through the collar to a level of terminals 12. With this construction, prongs 9 of meter 11 that connect to the ground and neutral connections of base 13 are connected to terminals 12 of collar 10, while the two prongs of the meter that each connect to a respective 115 volt phase are each connected to a respective extension terminal 26, the electrical power through which being controlled by contactor 24.

Also connected to contactor 24, as by a "pigtail" and connector 25, is an electronics package 28 mounted within collar 10. Electronic package 28 may be mounted within collar 10 by mounting strips 30 attached to the electronics package and which slidably fit within corresponding interior grooves 32 (only 1 shown) of collar 10. One or two antenna leads (not shown), and depending on configuration of the electronics package, extend from the electronics package to corresponding small antennas (similar in size to cell phone antennas) positioned within the meter 11 so they are generally next to the glass or transparent portion of the meter where radio signals propagate best. These antennae may also be located within an upper portion of collar 10 in instances where the existing electrical meters are not modified, but installation of an automatic meter reading system and/or remote connection/reconnection system is implemented.

The electronics package 28 is shielded against EMF radiation from the adjacent power conductors to prevent interference of its operation, and is connected via 2 or 3 wires, which may be shielded, to a meter-reading device in a mechanical meter, or to KYZ outputs of a digital meter, as will be further described. In some applications, only the electronics package 28 may be installed in collar 10 where only an automated meter reading is performed. Here, the terminals 26 may simply plug into terminals 20, or collar 10 may be constructed so that all the terminals are the same length as terminals 12 so that the collar simply houses electronics package 28 and plugs into respective terminals that carry power through the collar.

In a complete utilities automatic meter reading system, sensors such as those manufactured by BADGER METERS, Inc. of Houston, Tex., may be installed on water meters of residences or businesses, and a similar sensor, such as those manufactured by ITRON, Inc. of Boise, Id., may be installed on gas meters of residences or businesses. These sensors include an encoder that provides a stream of pulses indicative of a current meter reading. Coupled to each of these sensors is a corresponding electronics package including a wireless radio transmitter and control circuitry, as will be further described.

Figure 2:
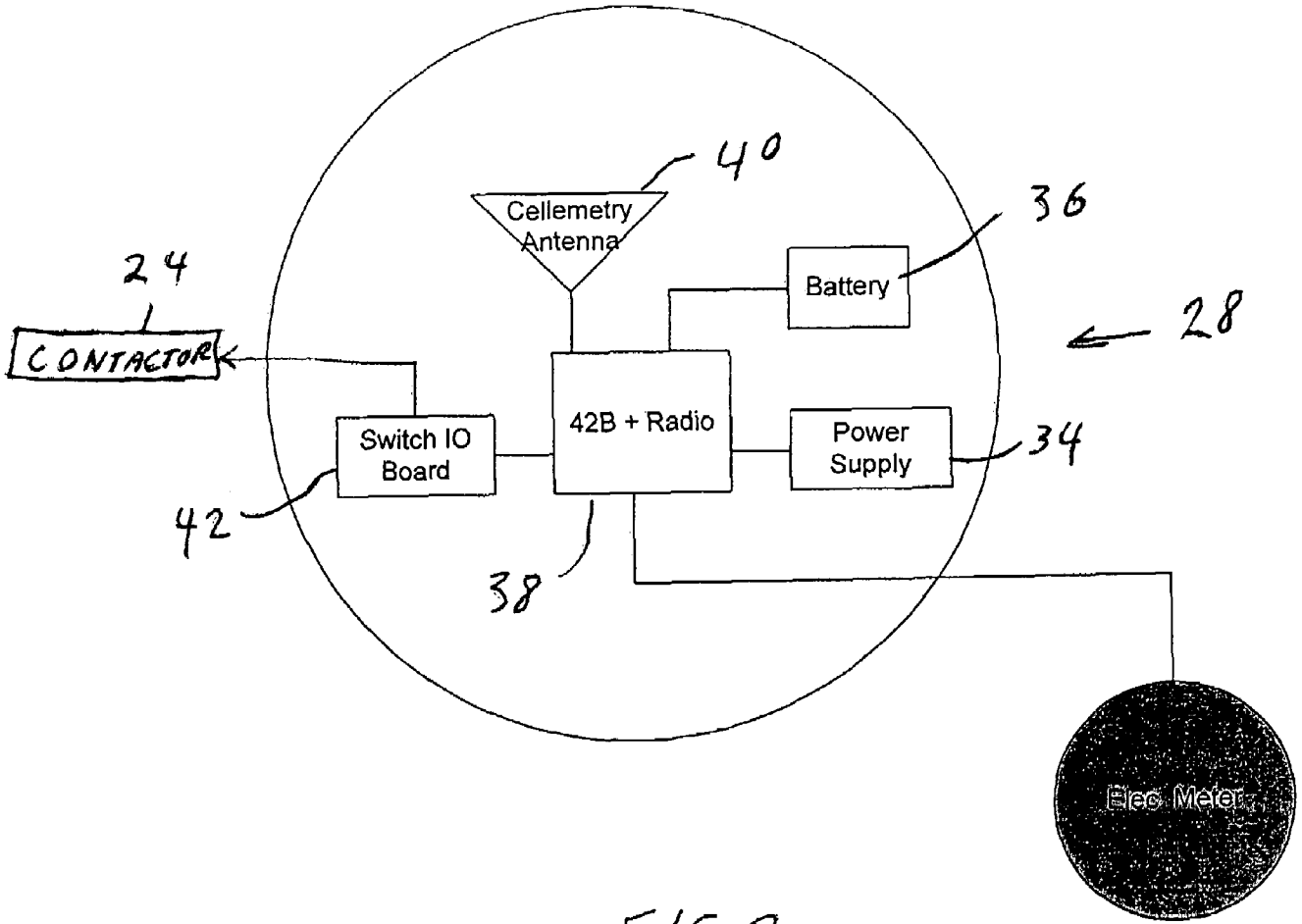
FIG. 2 is a block diagram of circuitry of another embodiment of my invention.

With respect to the electrical meter electronics package 24, reference is made to FIG. 2, which shows a block diagram of a basic embodiment thereof. Here, a power supply 34 provides power to the circuitry, with a battery backup 36 providing power to the circuitry in the event of a power failure. Significantly, a battery back-up at the electrical meter allows immediate communication to the electrical utility that power at the location of the meter has been interrupted, allowing the electrical utility company to immediately ascertain location and extent of a power failure.

Power from power supply 34 or battery 36 is provided to a circuit board 38, which as a significant feature of the invention, is a universal circuit board that may be used in many different applications, as will be explained. Board 38 includes a CELLEMETRY™ radio transmitter and receiver, with an antenna 40 connected to the radio portion of circuit board 38. A switch I/O board 42 is connected between circuit board 38 and contactor 24, and generally conditions and latches the holding currents required to reliably maintain the state of contactor 24.

Figure 3:
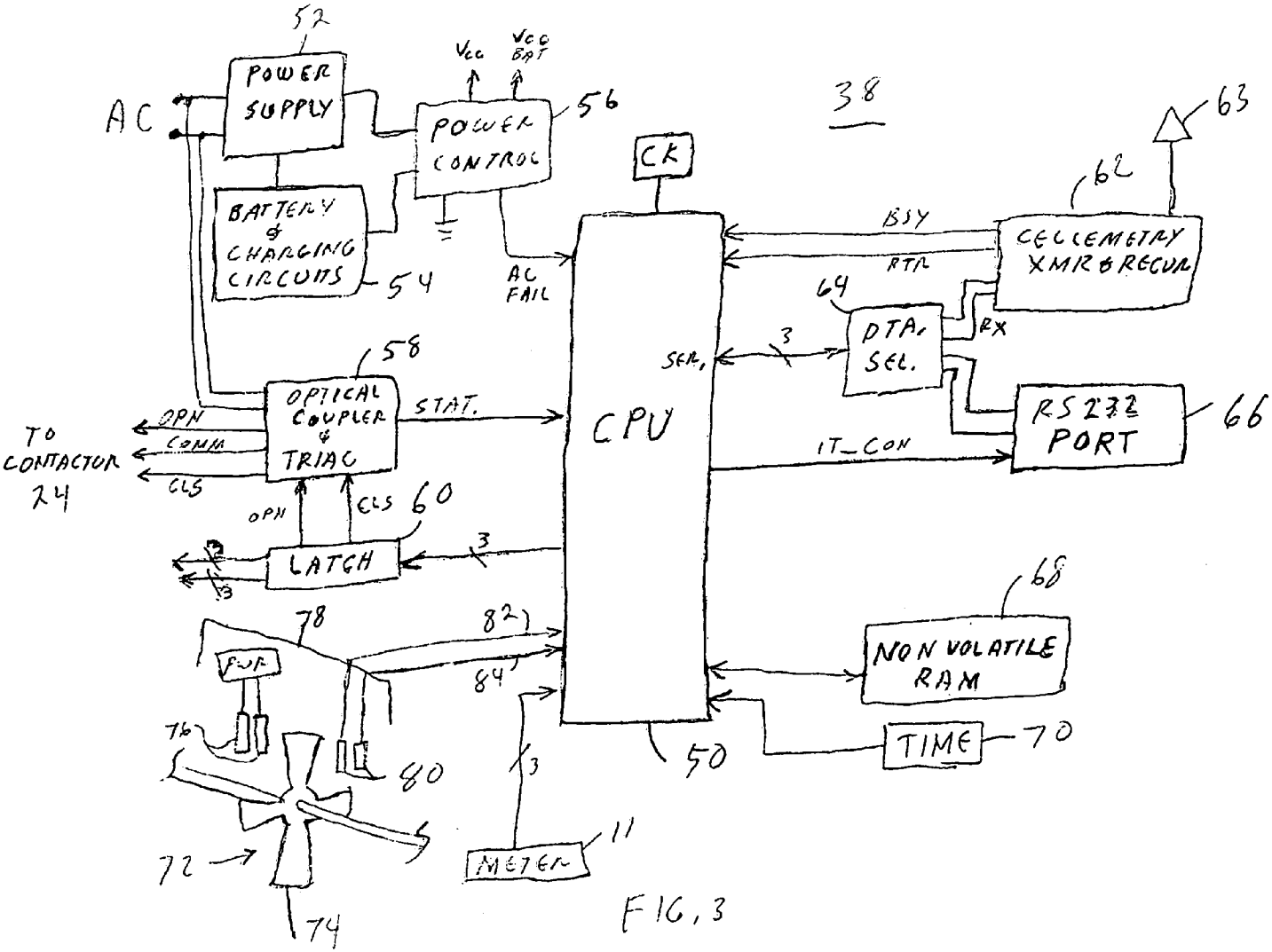
FIG. 3 is a block diagram showing details of construction of an embodiment of my invention.

Referring now to FIG. 3, a block diagram of one possible configuration of the circuit board 38 (dashed lines) integrated in an electrical meter is shown. A CPU 50, which may be a COP 8 CPU manufactured by Motorola, controls operation of the electronics package 28 (FIG. 1) and associated systems where used. 115 volt AC power from the power line is provided to a power supply and converter 52, which provides power potentials to conventionally operate the various components of the system, as should be apparent to those skilled in the art, which power and ground potentials not shown for clarity. A battery and associated charging circuit 54 provides power to the system in the electrical meter during power outages in order to transmit information to a data center, such as an electrical utilities company. Significantly, the COP8 microprocesor has 8 ports that may be programmed on the fly so that each of these I/O ports may be inputs or outputs, depending on the application. This allows the processor and associated circuit board, in conjunction with a programmable read-only memory, to be programmed for almost any application where switch closures and openings are to be monitored or to effect switch openings and closures. When coupled with the CELLEMETRY™ tranceiver, data related to almost anything may be easily and inexpensively transmitted from a remote location to a data collection point or central data center. As stated, such data may be related to wide and diverse applications, such as electrical power outage, surveillance systems of all types, gas, water and sewage system monitoring and control, and other systems.

In a simplest system, information gathered by a remote unit may be sent to a central data center by transmitting a cellular registration number containing at least one bit position for a flag. Likewise, information sent to a remote unit from a central data center may be done by sending a pair of cellular MIN numbers (similar to a page) wherein the first MIN number wakes up the remote unit and the second MIN number is a command for the remote unit to perform a function. Such commands may be configured as software masks in the PROM associated with the COP8 microprocessor.

Still referring to FIG. 3, a power control 56 automatically switches between conventional power and battery power, and provides an indication of the AC status to CPU 50 via one of the 8 I/O ports. For switching the contactor 54 between ON and OFF states, in turn connecting or disconnecting power to the user, an optical coupler and switching triac combination 58 is provided, and which connects or disconnects 115 volt AC power to contactor 24 to switch it ON or OFF. To trigger the triac, inputs thereto are provided via latching circuits 60 responsive to commands from CPU 50 from others of the I/O ports, which latching circuits may incorporate small time delays to counter electrical power "glitches" when power is interrupted for only a few seconds or so. Commands to trigger the contactor ON and OFF are received by CELLEMETRY™ radio 62 connected to CPU 50, with handshaking signals (bsy, rtr) passed directly to the CPU and serial data signals, which may be configured as an RS 232 port separate from the I/O ports, passed via a data selector 64 to the CPU. Also connected to data selector 64 is an RS 232 port 66 that may be used to configure the unit during installation, which may include setting a time zone, setting a serial number of the meter and corresponding electronic package 28 for identification purposes, and perform other functions as defined by the application. This information is stored in a nonvolatile memory 68, along with information such as a running total of electrical meter readings, and any other information needed for operation. For storing software masks, initialization values, "boot" information, and information related to operation and functions of a particular application, a programmable read-only memory (PROM) 69 is provided. In addition, a real time clock 70 provides time and date information in order to track occurrence and duration of power outages and provides a time and date stamp capability in other applications. With this construction, it should be apparent that simply by changing PROM 69 and configuring the I/O ports, the circuit board may be tailored for other applications, such as surveillance, capacitor bank switching, or any application where it is desired to monitor and transmit data related to a switch closure, perform switch closures responsive to other automated equipment or responsive to programming in the PROM or nonvolatile memory or transmit data stored in memory 68 either on a predetermined schedule or responsive to a command from a central data center.

As an optional feature of the invention, and still referring to FIG. 3, and as one example of versatility of the system, a fraud detection feature for mechanical meters is disclosed. Here, for mechanical electrical meters, Applicant attaches a small rotor 72 having vanes 74 to a shaft in the electrical meter that rotates the wheel in the meter that indicates power usage. On one side of rotor 72 is positioned a pair of side-by-side transmitters 76 of the a pair of transmitter/sensor pairs 78, each of which generating a beam of light (or other energy), with receiver portions 80 of the sensors positioned on the other side of rotor 72 for receiving a respective beam, and each in turn connected to I/O ports of the CPU 50 configured as inputs via respective lines 82, 84. Software in the PROM configures CPU 50 so as to recognize which line of lines 82 and 84 registers the first pulse of the pair of pulses. In this manner, a pair of pulses, one occurring slightly before the other, is provided to the CPU each time a vane 74 interrupts the beams. Significantly, when the electrical meter is correctly plugged into collar 10, the shaft rotates in a direction indicating correct operation of the meter to CPU 50. When an attempt is made to plug the meter into collar 10 upside down so as to make the meter run backwards, defrauding the electrical power company, rotor 72 is caused to rotate backwards, which in turn causes the wrong line coupled to the CPU to register the beginning of the first pulse of the pair of pulses. Thus, an immediate indication is made to CPU 50 that a user is tampering with a meter and/or defrauding the electrical power company.

The mechanical-type electrical meter may be read by software that instructs CPU 50 to keep a running total of the number of rotations of rotor 72. The number of rotations is correlated with a quantity of electricity used, such as 1 kilowatt/hour per rotation of the shaft, with the number of rotations fed via lines 82, 84 to CPU 50. A software counter maintains a count of the number of rotations and stores the count in memory until the meter is read. At that time, the number of rotations is retrieved by CPU 50 from memory and transmitted by CELLEMETRY™ radio 62 to the central data location. Where an electronic meter 11 is used, the meter KYZ outputs, which are a series of pulses similar to those provided by rotor 74, is coupled via an I/O port configured as an input to CPU 50 as represented by dashed lines 81. Here, the pulses are counted and a running total stored, in a similar manner as a mechanical meter, to maintain a meter reading from which consumed electrical power may be calculated, which typically occurs at the data center.

During operation, when the meter is fabricated or modified for installation, port 66 may be used to install software and masks into RAM memory, and provide a serial number to the electronics package for identification purposes. After installation, the CELLEMETRY information for that meter is activated at the local cellular switch so that CELLEMETRY™ commands may be passed between the meter and local switch. When first connected, the contactor may be closed by providing a command from the central data location to the CELLEMETRY™ receiver, the command being passed through data selector 64, which functions as a multiplexer to switch serial data sources input to microprocessor 50 between the radio 62 and tranceiver 66.

Responsive to the CELLEMETRY™ command, CPU 50 provides a CLS (close) command to latch 60 via respective I/O ports, which in turn provides the CLS signal to optical coupler and triac 58 to close contactor 24 (FIG. 1). Other outputs from latch 60 may be used to operate status lights, or be used in other applications to control other functions, such as to operate switches and valves, etc.

In the instance of a power outage, power control 56 functions as an uninterruptable power supply, automatically switching the components of FIG. 3, and the CELLEMETRY™ radio, to battery power. In addition, a data line labeled AC FAIL and coupled via an I/O port to microprocessor 50 is toggled, indicating to CPU 50 that AC power has been interrupted. Responsive to the interruption, CPU 50 generates a message that is sent via CELLEMETRY™ radio 62 back to the data center. As stated, the time and duration of the outage may be logged, as facilitated by time circuit 70.

Once the unit is installed and electrical power provided to the user, the usage wheel begins to rotate, also rotating rotor 72. As the vanes 74 interrupt the beam of light between transmitters 76 and 80, pairs of pulses are provided to microprocessor 50, each pair being in a sequence indicating proper direction of rotation of the meter wheel. If the meter is tampered with in such a way so as to cause the meter wheel to rotate backwards, then the pairs of pulses occur in the wrong sequence, prompting a message from microprocessor 50 and passed by CELLEMETRY™ to the data center that tampering of the meter has occurred.

Other messages to the data center may also be generated by CPU 50 as needed, such as health messages related to condition or status of the system, including "battery low or inoperable" conditions. In addition, routine meter readings are collected from meter 11 and provided to CPU 50, which are formatted into a CELLEMETRY™ message and transmitted to the data center according to a preset schedule or responsive to a request from the data center to obtain the reading.

Figure 4:
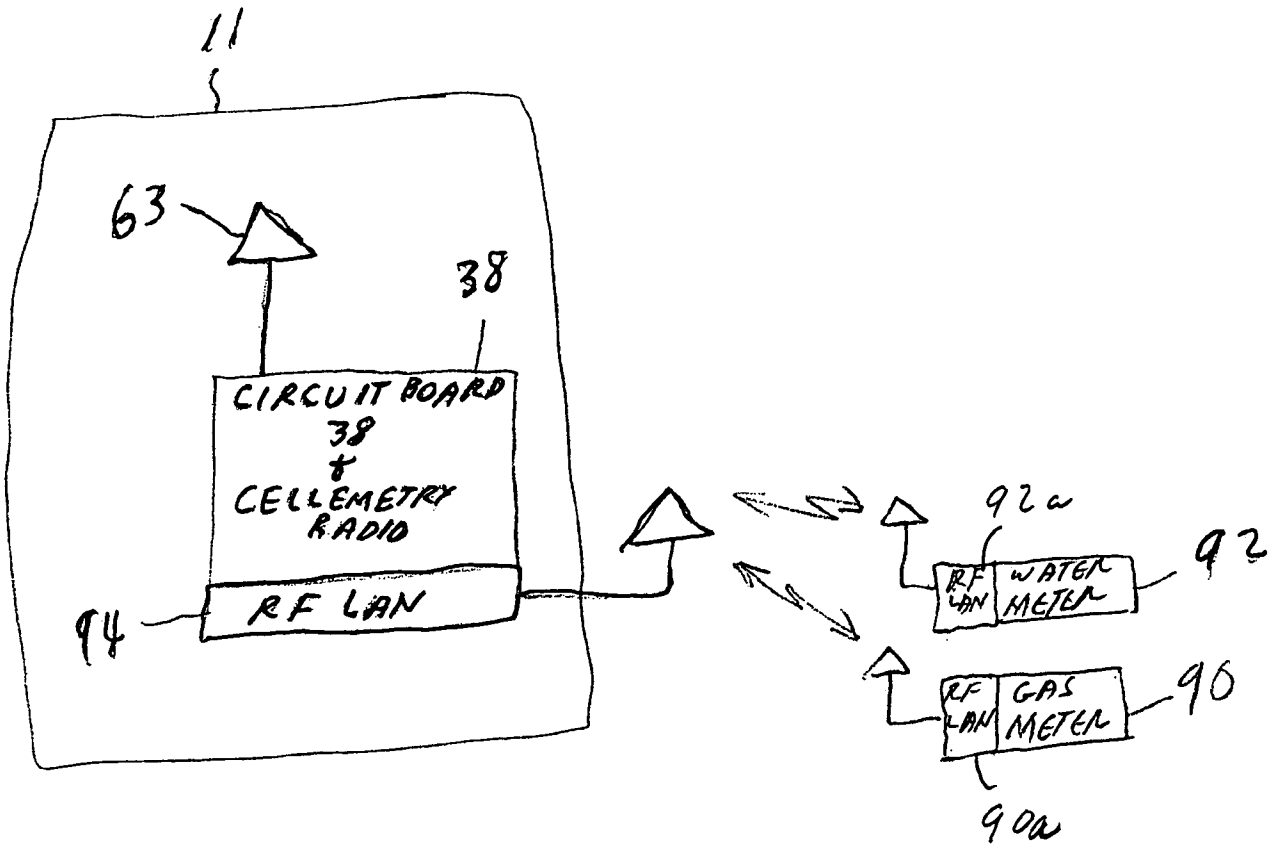
FIG. 4 is a block diagram showing another embodiment of my invention for remote reading of electrical meters.

Referring to FIG. 4, an overview of one embodiment of a complete automatic water, gas and electrical meter reading system is shown. Here, the circuit board 38 (FIG. 3) may be mounted in the electrical meter or the electronics package 28 (FIG. 1), and takes readings of the electrical meter as described above. Attached to a water meter 92, and where used a gas meter 90, is a conventional absolute encoder sensor such as one of the sensors described above, and in turn coupled to an RF transceiver circuit 92*a*, 90*a*, respectively. The water and gas readings are taken according to a preset schedule, and transmitted via RF transmitters 90*a*, 92*a* operating at low power on an unregulated frequency, such as around 900 Mhz.

Figure 4A:
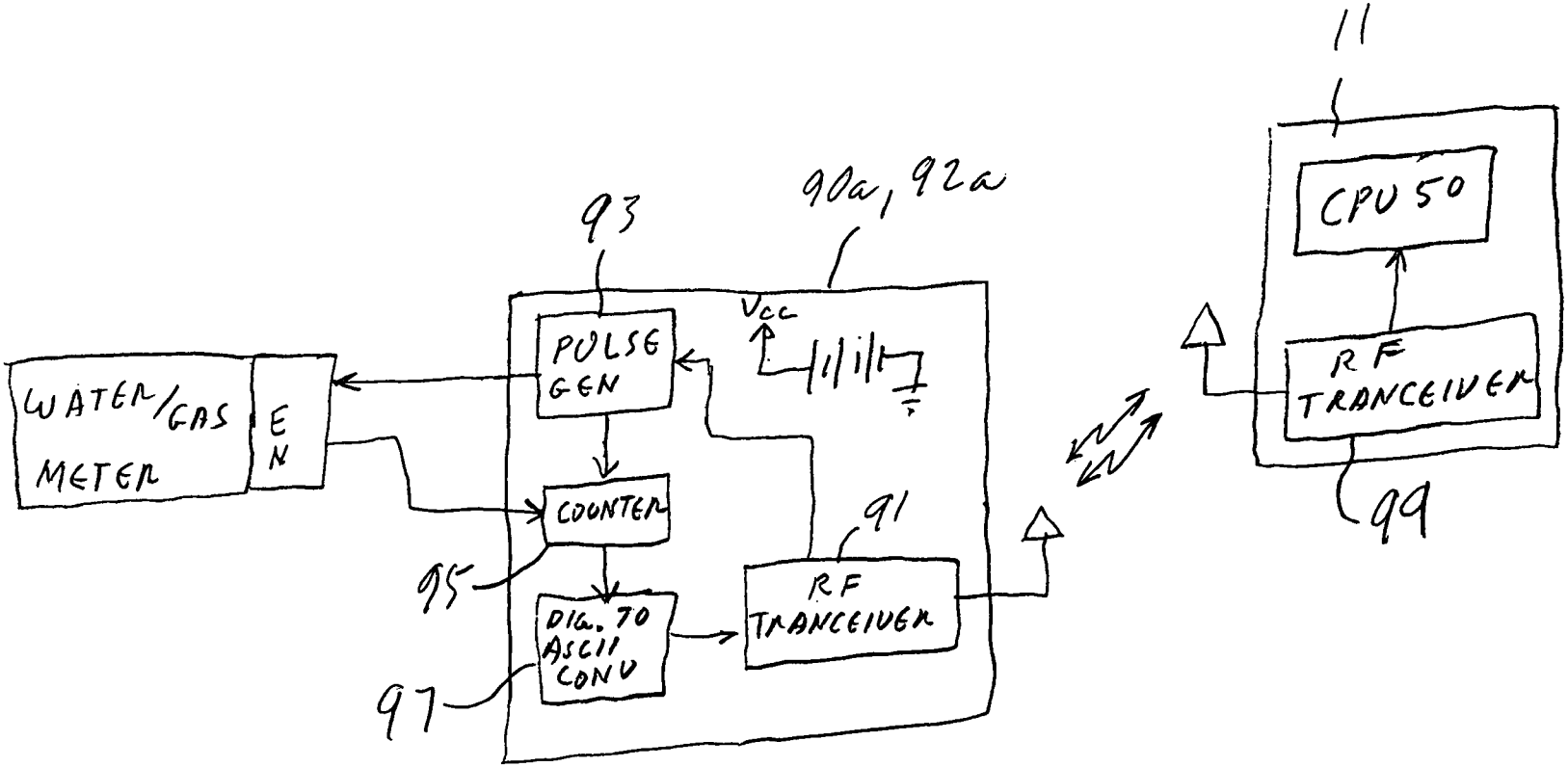
FIG. 4*a* is a block diagram of one possible interface for a water or gas meter of a meter reading system.

Referring to FIG. 4*a*, a more detailed block diagram of the system of FIG. 4 is shown. Here, a programmable RF transceiver 91 manufactured by CHIPCON™, is used to control operation of the water and gas meter remote units. The transceiver 91 is coupled to provide an enabling signal to a pulse generator 93, which in turn provides a string of pulses of a duration and potential as specified by the manufacturer of encoder EN. These encoders for the water and gas meters take a water or gas reading and convert it to a serial string of pulses. These pulses are applied to a counter 95, which counts the pulses and provides a digital count to digital to ASCII converter 97. Counter 97 in turn provides the ASCII representation of the count to transceiver 91, which transmits the ASCII indication to the RF transceiver 99 in electrical meter 11.

The system of FIG. 4*a* may have two modes of operation, a first wherein RF transceiver 99 in electrical meter 11, on a preset schedule, such as once a week or once a month or so, transmits a signal to transceiver 91 to initiate a meter reading. In another mode, a signal may be sent from transceiver 99 at any time to take a meter reading. These readings may be buffered at the meter and sent to the central data center on a preset transmission schedule, or retrieved and sent immediately to the central data center.

Figure 5:
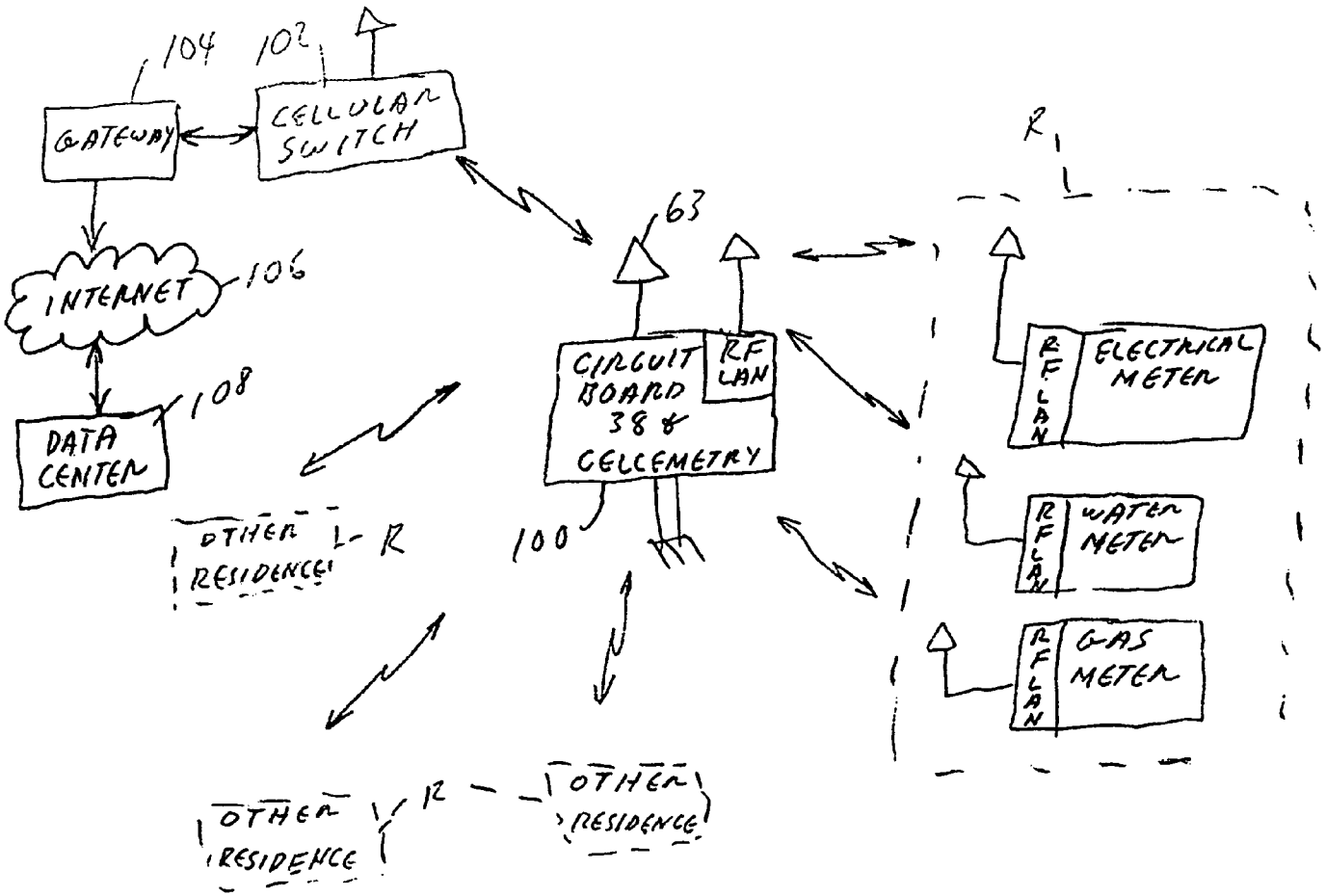
FIG. 5 is a block diagram showing how a plurality of meter readings may be collected and forwarded to a data center.

In another embodiment of an automatic meter reading system suitable for a densely populated area, and referring to FIG. 5, the circuit board 38 is constructed in conjunction with an RF LAN receiver/transmitter as described above operating generally in the unregulated 900 Mhz band that receives and transmits to corresponding RF LAN spread spectrum signals from units as described above coupled to water, gas and electrical meters in each of a plurality of residences, businesses or the like, designated R in FIG. 5. In this embodiment, the circuit board 38 and RF link incorporated therein are configured as a data collector 100. These data collectors may be mounted to a pole or stand, and powered by a solar collector/power supply, or may be incorporated in an electrical meter of one of the residences as shown in FIGS. 1 and 3. As such, the water, gas and electrical meters associated with the plurality of residences R may be automatically read on a predetermined schedule, such as once a day, and the information transmitted to data collector 100. In a typical installation, there may be a data collector 100 about every square mile or so, and which may receive water, gas and electrical meter readings from up to 24 or so residences R and store these readings in nonvolatile memory 68 (FIG. 3) for later transmission. Alternately, these readings may be transmitted to the central data center immediately. The readings are sent via CELLEMETRY™ to the nearest cellular tower 102 where the signals are relayed to an Internet gateway 104 and applied to Internet 106 from which they are received at the data center 108. The RF LAN network may utilize spread spectrum technology to prevent interference between discrete RF transmitting units, and a may further utilize an ad hoc communications protocol to determine extent of power outages and pass along other information suitable for such a protocol. In addition, a "mesh" type network may also be employed in conjunction with spread spectrum technology, such a network incorporating features of the ad hoc communications protocol in addition to the "mesh" capabilities that allow each of the units so equipped to be reconfigured "on-the-fly". For instance, a discrete unit that is transmitting meter information may be reconfigured as a transmitter/repeater. During a power outage, and in a mesh-type network, the units affected by the power outage may be configured to report their status to a central unit that in turn passes the information to the central data location.

The RF transmitters for water and gas may be constructed as shown and described in FIG. 4*a*. With respect to electrical meters, of which there are two types, mechanical and electronic, the mechanical meters may be made to generate a stream of pulses that are read and counted by mounting a rotor 72 (to the rotating shaft in the meter) and associated sensors 76, 80 as shown in FIG. 3, or by mounting a magnet and reed switch (not shown) to the rotating wheel in the meter. In this instance, the reed switch would be connected to a power source so that a pulse is generated every time the magnet passed the reed switch. In electronic meters, a pulsed output, the KYZ output, is provided directly by the meter. In the latter instance, this pulsed output of the electronic meter may be applied directly to an RF transceiver in a collar similar to the collar shown in FIG. 1. In the former instance, the pulses generated by the rotor or reed switch are counted, as by a counter such as counter 95 (FIG. 4*a*) and translated to ASCII by a digital to ASCII converter. The count may be stored for later transmission, or transmitted on demand.

Figure 6:
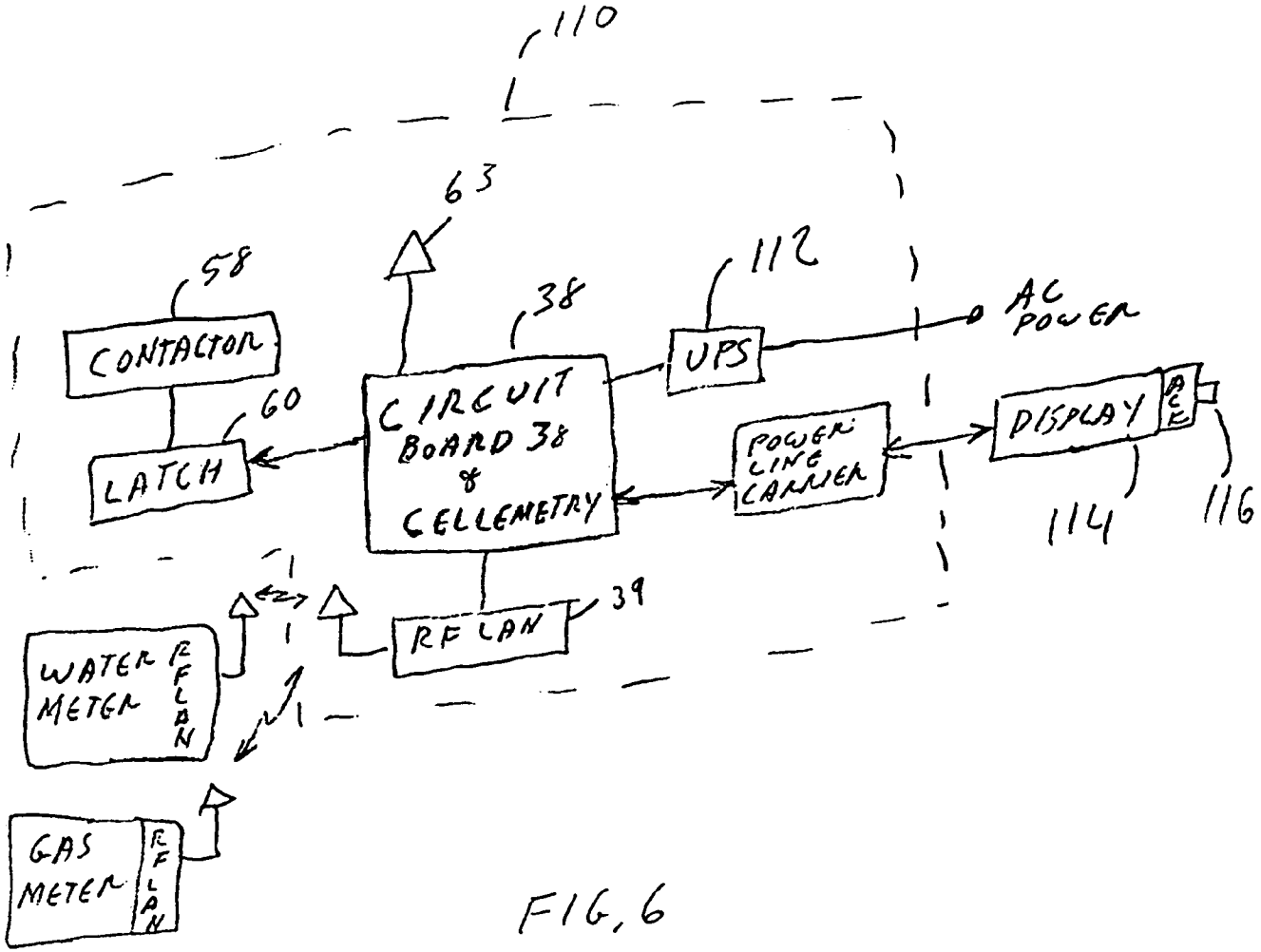
FIG. 6 is a block diagram showing overall construction of a pre-pay electrical utilities system.

In a prepaid system, and referring to FIG. 6, the components of FIG. 3 are incorporated in an electrical meter 110 (dashed lines) with the power supply and battery designated as an uninterruptable power supply (UPS) 112. In addition, there exists in meter 110 in conjunction with circuit board 38 an RF LAN circuit 39 and corresponding antenna 41 coupled as described for FIG. 4. In addition, a power line carrier circuit, such as that manufactured by ECHELON™ corporation for sending signals along a power line provides an indication to a display 114 within the residence R. Display 114 may also incorporate a pushbutton 116 to be pressed by a resident to acknowledge that he/she is notified that only a predetermined number of days of electrical power remain, according to past usage. This would constitute notification of impending cut-off of electrical power where such notification is required. If the resident refuses to press button 116, a utilities worker may call the residence to provide the notification or a utilities worker may be sent to the residence to provide the notification. An incentive to press the button may be provided, such as adding a surcharge to the utility bill if the user must be called to be notified or a utilities worker must be sent to the site.

Figure 6A:
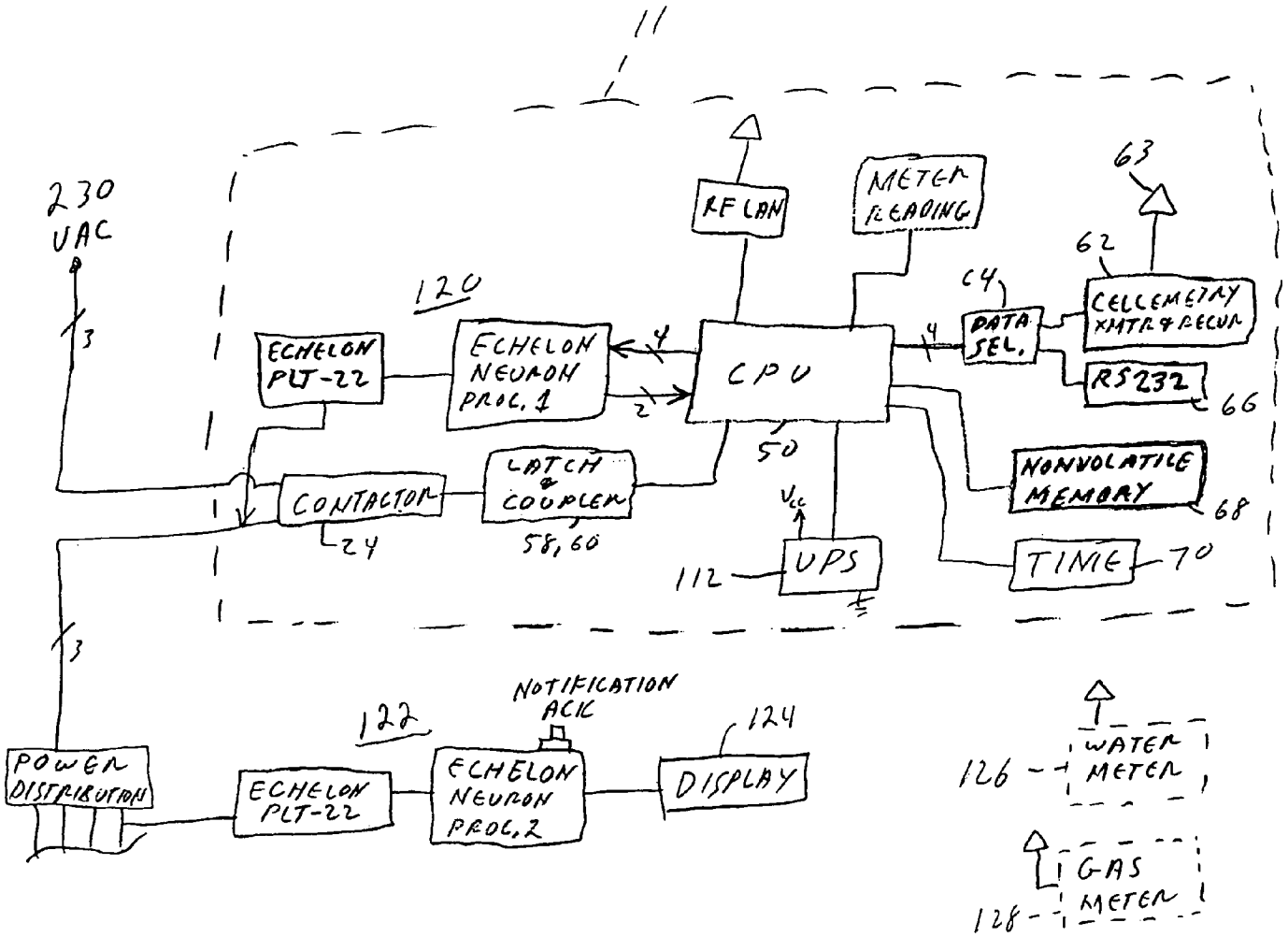
FIG. 6*a* is a block diagram showing details of construction of the pre-pay electrical utilities system of FIG. 6.

Referring to FIG. 6*a*, the power line transmission subsystem is primarily made up of ECHELON CORP components including Neuron processors and respective PLT-22 power line carrier modules. Here, signals are applied directly to the power lines into the residence or business, and received and decoded by a module inside the business or residence. In this system, there are two Neuron-PLT-22 pairs, a first, main pair 120 coupled to microprocessor 50 and a second pair 122 coupled to an LCD display 124 within the residence or business. As stated, these two Neuron pairs communicate over the power lines of the household or other establishment of which electrical power is being metered. In some instances, water and gas meter readings may also be taken as described above, these functions illustrated by dashed line showings 126, 128 and which may also communicate via the RF LAN system as described above. Clearly, where one of these utilities is not installed, then no monitoring of that utility would occur.

In the prepaid system of FIG. 6*a*, the Neuron 120 coupled to microprocessor 50 is typically located in the electrical meter 11 (dashed lines). This neuron 120 obtains a message of "days/dollars remaining" from microprocessor 50 (this message in turn obtained from the central data center) and transmits the message to neuron 122 for display on LCD display 124. Display 124 may be a simple, 2-line alphanumeric display, and typically is mounted in a prominent location the residence that incorporates the prepaid system of the instant invention so that the occupant may easily view quantity of remaining funds or days of utility service that remain available. In addition, it is contemplated that the occupant may deposit funds for utilities at convenient locations, such as convenience stores, grocery stores, or any other such location, or even over the Internet, with these funds being forwarded to the utility company. This would include electronic transactions such as credit cards and debit cards, with the funding for a customer utility account being electronically deposited or registered almost instantly with the utility company. Thus, the resident would have ample and convenient opportunity to prepay a utility bill up to a point in time when the utility service would otherwise be terminated.

Other features associated with a remote Neuron configuration of the instant invention, and as stated, are a "NOTIFICATION ACKNOWLEDGEMENT" pushbutton available to the resident that provides indication that the customer has received a message related to remaining estimated days of service that will be provided prior to disconnection of electrical service. A "TEST" pushbutton is also provided so that when depressed, a message is applied to the LCD display indicative that the "TEST" button is depressed. Such a test button may be installed within the meter housing or collar, or within another housing, so as to only be available to service personnel. Also coupled to main Neuron 120 is a "NEURON RUNNING" LED to indicate to service personnel that the neuron is operational. Neuron 122 periodically transmits a status message to neuron 120, which in turn communicates the status message to microprocessor 50, the status message including health status of the neuron.

Main Neuron 120 is interfaced to microprocessor 50 via 6 discrete I/O pins, four of which providing the display to LCD display 124. A fifth of these pins indicates operational state of the neuron, and the sixth pin is used to indicate that the resident has pressed the "NOTIFICATION ACKNOWLEDGE" pushbutton associated with the LCD display 124. This indication is in turn transmitted to the data center VIA cellemetry™. Typically, as determined by the data center, whenever a last day/dollar received is less than five days or $50 on the utility account/billing, a warning message will be applied to LCD display 124 to request that the resident press the "NOTIFICATION ACKNOWLEDGE" pushbutton. In the event the occupant does not press the "NOTIFICATION ACKNOWLEDGE" pushbutton when funds are almost depleted, an indication may be provided to personnel in the data center that the "NOTIFICATION ACKNOWLEDGE" at that residence or establishment has not been pressed. Responsive to this indication, a telephone call, or other physical check of the establishment or residence may be made. When the resident pushes the "NOTIFICATION ACKNOWLEDGE" pushbutton, neuron 122 detects this action and returns the LCD display to the dollar/day display. Also, if "4/5 DAYS REMAINING" is the last update to display 124, the software will send a "NOTIFICATION ACKNOWLEDGE" message to neuron 120. If either of the "TEST" buttons (not shown) are pressed, a "TEST MESSAGE" signal will be provided to display 124 on a first line thereof and an indication of which neuron on which the "TEST" button was pressed. The first 4 pins are polled by neuron 120 on a continuous basis, and whenever the value changes to non-zero, the new setting will be communicated to neuron 122 over the power lines of the residence or other establishment and displayed on LCD display 124. When neuron 122 receives a day or dollar setting message, it will output the indicated "DAYS REMAINING" value on a top line of display 124 and indicate "FUNDS REMAINING" on the bottom line. If neuron 122 receives an all 0 message, it will toggle the display between the last dollar/day display and a display indicating that there is a problem in the system and the resident needs to call for service. If neuron 122 has not received a dollar or day update in accordance with a predetermined schedule, a warning message is provided to warn the resident to call for service. The interface between neuron 122 and LCD display 124 is in an asynchronous serial RS-232 format as designated by the LCD manufacturer.

Figure 6B:
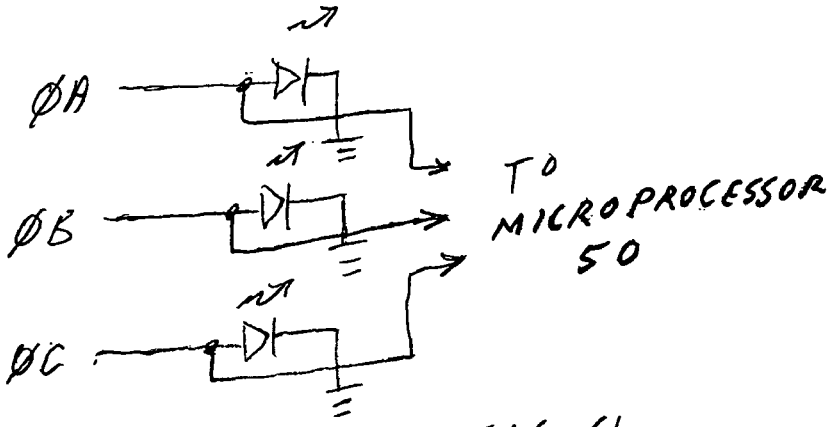
FIGS. 6*b*, 6*c* and 6*d* are schematic illustrations showing how various electrical utilities devices may be interfaced to a data collection system.

With respect to other applications within an electrical utility, phase fault detection may be accomplished simply by monitoring conventional indicator lamps coupled to each of the respective phases, these lamps typically mounted on a transformer for the phases. As shown in FIG. 6*b*, these indicator lamps are typically photodiodes, with a respective photodiode being illuminated when power on an associated phase is lost. Applicant monitors the phases by connecting to the anode side of the photodiodes so that the diode drop is provided to a respective I/O port of microprocessor 50 when the diode is illuminated. Buffering, isolation and other conditioning components may be included in lines to the microprocessor as needed. When microprocessor 50 detects a power loss of any of the three phases, a CELLEMETRY™ message is immediately developed and sent to the central data location.

Figure 6D:
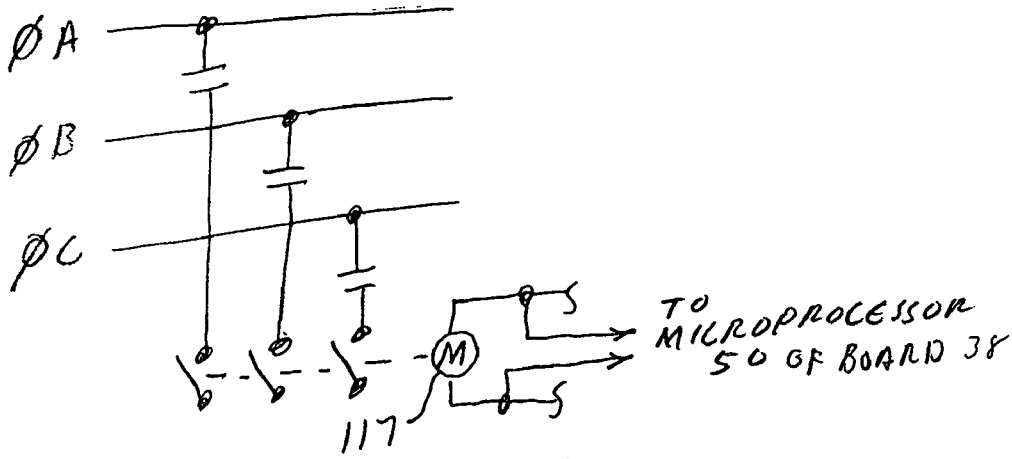
Figure 6C:
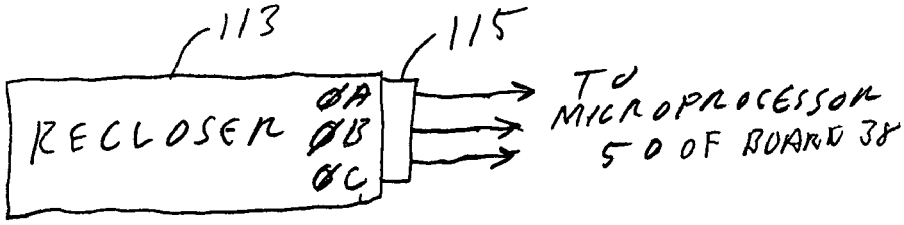

With respect to reclosers, FIG. 6*c* shows a recloser 113 representative of reclosers coupled to power lines. In many of these reclosers, an RS 232 serial port 115 is provided to connect a time and event recorder so as to capture a history of operation of the recloser. Applicant simply interfaces this port to microprocessor 50 of circuit board 38 with the appropriate software so that the I/O lines are inputs that indicate to the microprocessor when the recloser operates. Responsive to such indications, CELLEMETRY™ transmissions are developed that are relayed back to the data center, and which indicate when the recloser operates, and whether or not the recloser has disconnected power to lines that it services.

FIG. 6*d* shows connection of I/O lines of microprocessor 50 of circuit board 38 to a motor 117 controlling switching of a capacitor bank for power factor control. While a simple parallel connection is shown, it is to be understood that appropriate isolation of motor current and voltage from the microprocessor would be done, as should be understood by those skilled in the art. In instances where operation is automatic, a CELLEMETRY™ signal is developed that is sent to the data center indicating operation of the capacitor switch motor 117. Where the capacitor motor 117 is not automated, CELLEMETRY™ signals are sent to the remote unit associated with motor 117 to cause operation of the motor.

In any of the above embodiments, indications of operation may be stored in memory for future transmission, or transmitted immediately.

Figure 7:
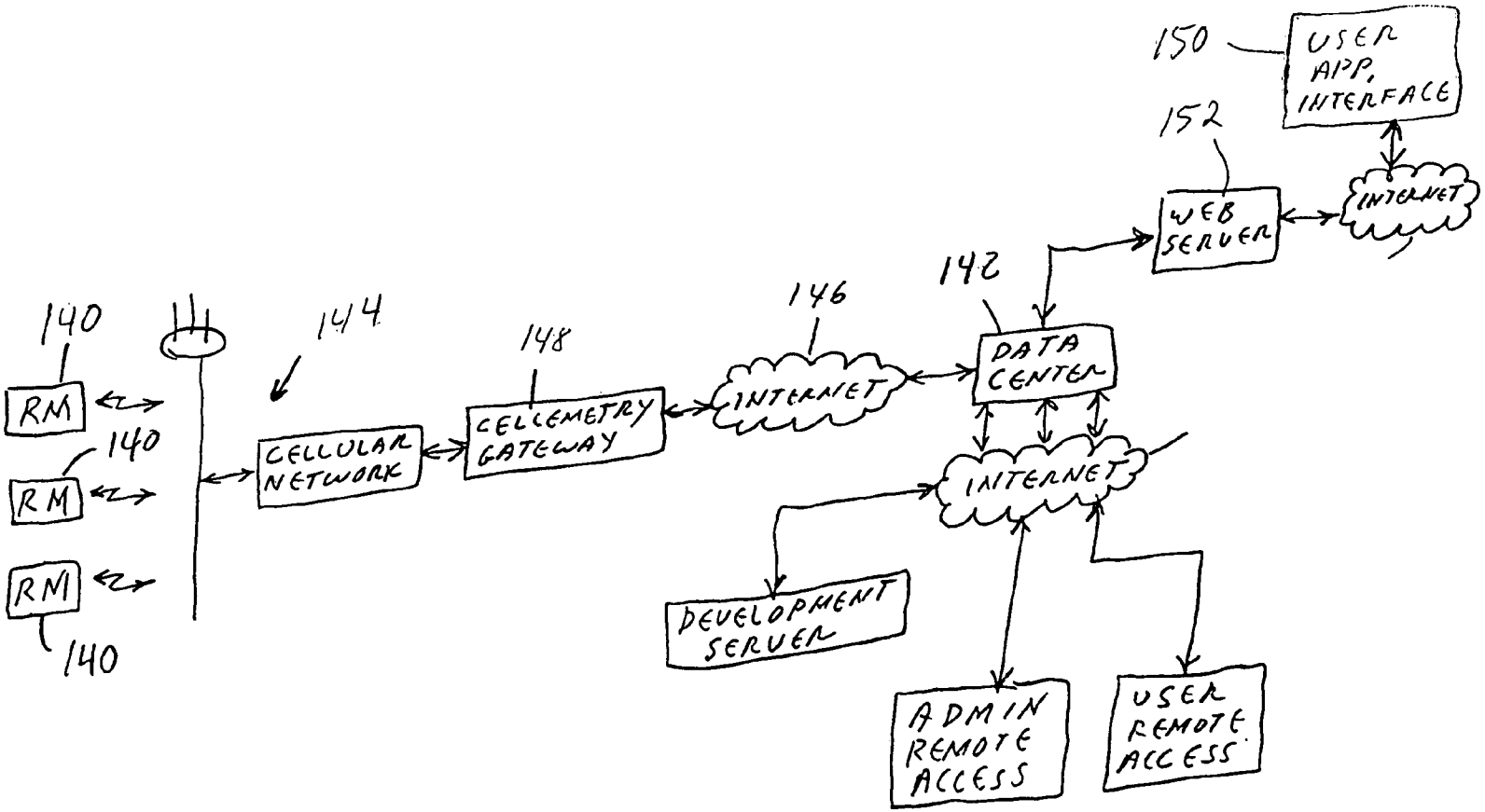
FIG. 7 is a block diagram showing overall construction of a data collection system of my invention.

Referring now to FIG. 7, the other parts of the system, including the data center, will now be described. FIG. 7 illustrates an overview of a basic system of one embodiment the present invention. Here, remote modules or systems 140, designated RM, are wirelessly connected as described above to the cellular telephone system 12 via a CELLEMETRY™ radio transceiver, and incorporated into a collar 10 (FIG. 1). The CELLEMETRY™ radio in the electrical meters and pole-mounted collection points may be a single band, dual mode CELLEMETRY™ transceiver part number CMM 6010, manufactured by STANDARD RADIO located in San Diego, Calif. However, a dual band, dual mode transceiver part number CMM 6200 by the same manufacturer may also be used. Dual band, dual mode transceivers allow use of the control channel for low-cost communications, with the second band, dual mode channel used to transmit larger packets of data, up to 5k bits or so for photos and data from remote modules used in security applications (security sensors, industrial meters, etc.). In addition, other similar CELLEMETRY™ radio transceivers (or transmitters where data flows only to the central data center) may be used, the selection of which being obvious to one skilled in the art. In any case, the CELLEMETRY™ transceivers in remote units 10 receive messages in the form of wireless pages that include a mobile identification number (MIN). The page is issued from a data center 142 as a response or request for action, and the transceiver sends data and responses in the form of 32-bit registrations back to the data center. It is to be particularly noted that these communications are wireless communications transmitted only over the overhead control channels of the cellular telephone system, and do not utilize the voice channels in any way.

From the cellular telephone system 144, the data is interfaced to the Internet 146 by a conventional cellular gateway 148, which converts and aggregates registrations from the remote units 140 into IP packets and sends the packets to Internet 146. From Internet 146 the IP packets carrying registrations are picked up by Applicant's data center 142, one function of which being a central collection point of registrations, and thus data, from the remote units 140.

In general, there may be two types of remote units, a first type being bidirectional in that data may be generated and forwarded to data center 18 as a registration. Responses or requests for an action may also then be sent from the data center as one or more pages to the remote units, which then act on the request or response. Likewise, pages conveying data may be sent from the main data center to the remote systems, which may respond by sending one or more registrations back to the data center. Examples of uses of the remote units which are illustrative and not intended to be limiting, are to read electrical, water or gas meters, the modules also having a capability of disconnecting water, gas or electricity responsive to commands from the data center. In addition, in areas where electricity is billed at a higher rate during certain times of the day, i.e. peak hours, time of use of electric meter readings may be taken before and after such peak hours in order to meter electrical usage during such peak hours. Further, Applicant's system may be used to perform conservation functions, such as electrical disconnections of hot water tanks at residences during peak hours of electrical usage. Such conservation techniques assist in preventing "brown outs" during the peak usage hours. Power outages may also be reported to the data center, which may then notify a resident via a cellular page or Internet communication, such as email. These communications indicative of power outages may also be sent directly to the resident from the cellular system. Also, the utility company may be notified of such an outage. In addition, notification may be made when power is turned "on" at a residence or other establishment after a power outage. This is useful, for example, in commercial processes such as tire manufacturing wherein a power outage and subsequent restoration may result in defects in a batch of tires being processed when the outage occurs. Other applications include remote switching of capacitor banks in electrical utilities systems, monitoring operation of recloser switches, fault detection in electrical utilities systems, reading transducers of any kind, mobile asset monitoring using GPS, automatic meter reading, prepaid meter reading, and commercial meter reading. As should be apparent, some of these functions may be grouped together; for instance electrical failures may be reported in areas where prepaid or automatic meter reading systems are already in place. This would allow efficient localization of power failures, with utility companies being almost immediately notified of power failures when and where they occur.

Another type of remote module also collects data and sends the data back to the data center, but it may be programmed to act on its own. Illustrative examples of this type remote module are those that may be coupled to capacitor control banks utilized by electrical utility companies. Here, capacitor banks may be connected or disconnected by remote modules automatically, and messages related to such connection and disconnection developed by the remote module and sent back to the data center. Either type module may be used in surveillance applications wherein an illuminating light, which may include visible and infrared illumination, a camera and recording device may be activated automatically responsive to a motion sensor or intrusion type, and a registration indicative of such activation sent to the data center. The video may then be put on a monitor or sent over the Internet to interested parties. This is advantageous inasmuch as while it is obvious that a camera may be readily disabled by a terrorist or other intruder, the registration indicates a time (timestamp from cellular system) that the event occurred so that, for instance, water in a water storage tank may be isolated from a municipal water system until the water in the tank is tested to ensure there have been no hazardous materials introduced therein.

In order to observe the functions performed by the remote units or to command one or more of them to implement a specific task, a user application interface 150 is provided. Application interface 150 may be in the form of an interactive web page displayed any suitable Internet browser, or in any other form usable by a customer. Also, where the interface 150 is loaded into a remote client system, as where Applicant provides a monitoring or surveillance service, the end user may connect to data center 142 via Internet 146 for accessing a respective Web page containing information related to remote units 140.

Also connected to data center 142 is a web server 152 that is provided with a public URL for general public access, and which may contain links for users that are password protected.

Figure 8:
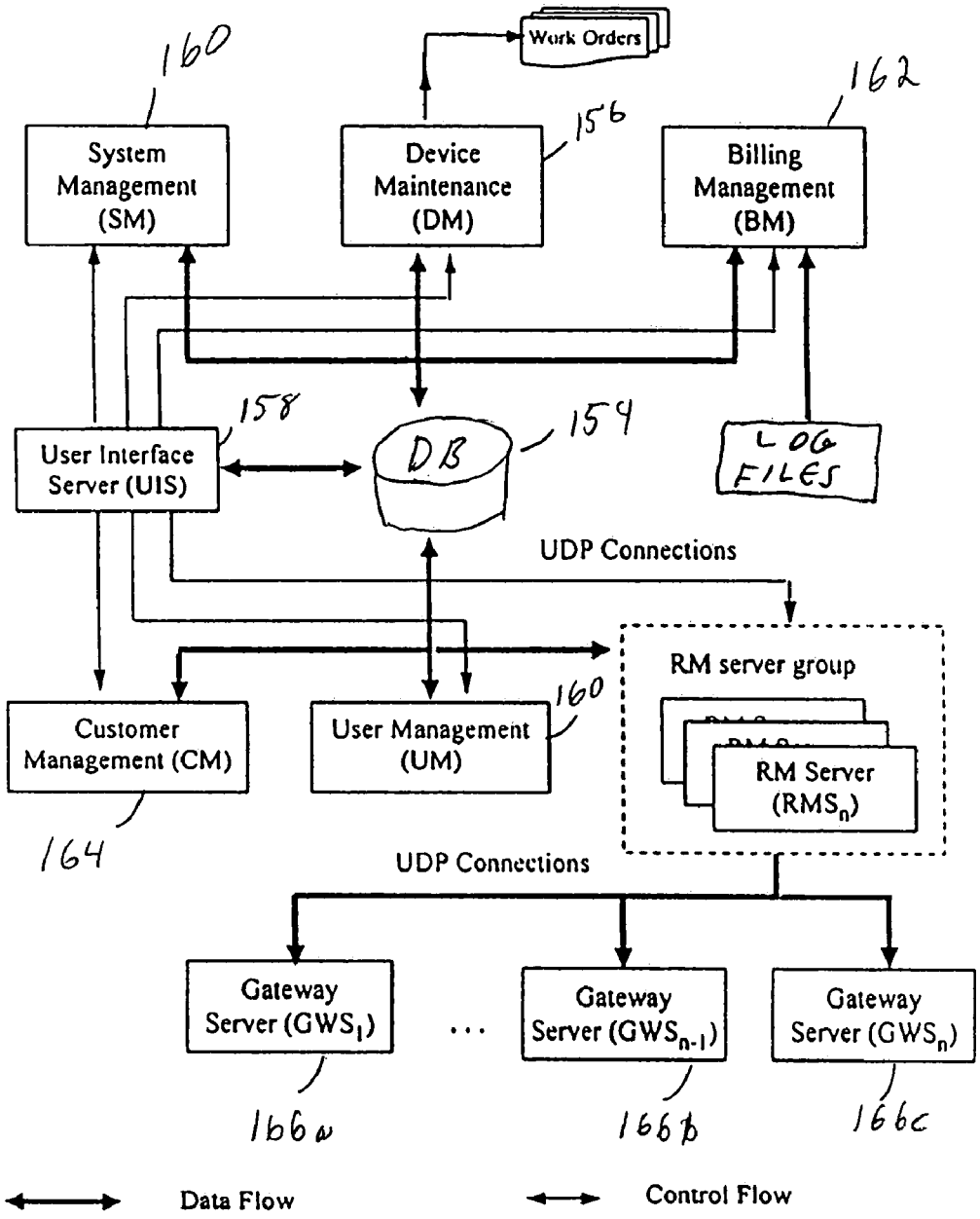
FIG. 8 is a block diagram showing general architecture of a data collection center of my invention.

Referring now to FIG. 8, one possible configuration of architecture of a central data system of the present invention is shown. Here, data flow is represented by thick lines and control flow is represented by thin lines. A database 154 is conventionally used to store information about the system. Included in the database are location of all fielded or to be fielded remote systems, this information including a street address or the like, such as a GPS indication, where each remote system is installed and a description of physical location of each remote unit at that address. On a prepaid utility system, there would typically be a remote unit capable of reading up to four utility meters, i.e. electrical, gas and two water meters at each residence or business. Status of work orders for installation of remote systems, including time and date of the installations, is maintained. Health status, i.e. operable parameters, of all remote systems is maintained, as determined by return registrations and non-responses by the remote systems. This health status includes "BATTERY LOW" and "TAMPERING" indications and indications of internal remote unit component failure. A meter type and meter model connected to each remote system is maintained, with each RF subsystem at a particular residence or business establishment having four register locations accessible for reading by the microprocessor. Typically, readings for the electrical meter are always coupled to the first register. The other three registers are reserved for water and gas meter readings, although in other applications these registers may be used to indicate activation of remotely located cameras by motion sensors, movement of trip wires or trip devices, motion sensors positioned to record activity on water tank ladders, pressure sensors, voltage measurements in electrical utility capacitor banks used to control power factor, or any other application wherein a switch closure or digital measurement is taken. Enablement status of each remote system is maintained for power outage/restoration reporting, along with each remote systems connect/disconnect status.

With respect to meter reading and funding, the last meter reading of each remote system, including time and date of the reading as well as the meter face value is maintained so that in these systems there is no need to store the meter readings in a memory at the meter, except for buffering purposes. The date and time of the last activation of the "WARNING ACKNOWLEDGE" pushbutton for each remote system is maintained. Also, the last "DOLLAR/DAY REMAINING" value sent to each remote system is maintained, along with the date and time of such sending.

Coupled to the database, and represented by boxes, are software routines and hardware labeled DEVICE MAINTENANCE (box 156), USER INTERFACE SERVER (box 158) and USER MANAGEMENT (box 160). As shown, data flows between the database 154 and routines 156, 158, and 160. The DEVICE MAINTENANCE software 156 maintains a device model library and configuration information library for all devices. As stated, these devices may be electrical, gas or water meters, RF devices, remote modules, mobile assets locatable via GPS, or any other similar devices. Devices internal to a residence or business may include security alarms, HVAC controls, smoke alarms and other devices, and may be connected to the communications module (RM 140 of FIG. 7) via power line carrier transceivers as shown and described above for electrical meters. Adding a new device model into the device model library includes creating new tables related to this new device model in the database and installing new software processing modules. The USER INTERFACE SERVER 158 provides a web-based interface accessible by a customer. User inputs are received via a web server, which originates a transaction for each authorized user's operation. All transaction requests are routed to corresponding system modules for further processing. User Management software 160 manages the user's accounts, including opening/removing accounts, setting privileges, initializing, and a modifying the user's personal information.

Data also flows to and from boxes marked SYSTEM MANAGEMENT 160, BILLING MANAGEMENT 162, CUSTOMER MANAGEMENT 164, and the GATEWAY SERVERS **166*a*-166*c*. SYSTEM MANAGEMENT 160 serves to assume responsibility for managing and configuring the data center system. The BILLING MANAGEMENT 162 module associates usage, i.e. issued pages from the data center and received messages from remote modules to a customer, such as a utility company, for purposes of billing. CUSTOMER MANAGEMENT box 164 creates and maintains customer information in the database. As stated, the customer is typically an organization responsible for being responsive to the remote units in one or more aspects, such as billing, meter reading, surveillance, emergency services or any other such billable service. The GATEWAY SERVERS 166*a*-166*c* interface the data center to different communications networks, such as the Internet and cellular IS-41 telephone system networks. These servers send control packets to or receive response/status packets from the IS-41 communication network gateway. The gateway server also checks ownership of the incoming packets using an identification embedded in the packets, and relays the packets to respective remote module servers for further processing. The gateway servers transform operation requests from the remote module servers into outgoing packets recognizable by the communications network. Remote module servers process all packets from remote units 10** so that data in the packets is either stored in the database or fed back to the central data system users.

As stated, Applicant's system uses the CELLEMETRY™ short messaging system over control channels of the cellular telephone system through the NUMEREX™ gateway in Atlanta, Ga. NUMEREX™ maintains an almost 100 percent coverage in the United States, and in some areas has dual channel capability. Within this system, Applicants use a 3-watt radio transceiver to communicate with the cellular telephone system.

The CELLEMETRY™ data service uses the overhead control channels of the cellular telephone system for transport of messages. These control channels are typically used, in both directions, to transfer information necessary for call initiations between the cellular customer and base station.

There are two types of control channels, each named according to direction of data flow. The forward control channel conveys messages from a base station to a cellular customer, while the reverse control channel conveys messages from the cellular customer to the base station. Since the control channels are underused even during the busiest times of cellular telephone use, there is sufficient bandwidth for Applicant's system to operate concurrently with cellular telephone use. Data from NUMEREX™ indicates that typically during the busiest times of cell phone use, the control channels are only used to about 10 percent capacity.

With respect to the overhead control channels, when a roaming, i.e. out of its home cell system, cellular telephone is first turned "on", it recognizes the fact that it is out of its home cellular system, and sends its mobile identification number (MIN) and its electronic serial number (ESN) to the system it is in via the reverse control channel. The cellular system the phone is currently in recognizes that the mobile identification number is a roaming number and routes the mobile identification number and electronic serial number of the roaming cell phone to the roaming phone's home system via the Intersystem Signaling Network (ISN-41), which links all cell phone networks in the United States and in most foreign countries together.

In the CELLEMETRY™ system, the CELLEMETRY™ radio functions as a roaming cellular telephone, except that the mobile identification numbers and electronic serial numbers of the CELLEMETRY™ radios are routed to a CELLEMETRY™ gateway coupled to the ISN-41 network. The CELLEMETRY™ mobile identification number identifies the CELLEMETRY™ radio to the system, and the electronic serial number is used, in Applicant's system as a data message to carry meter readings and indicate events such as activation of motion sensors, etc. The CELLEMETRY™ gateway provides a timestamp to the electronic serial numbers and the ISN-41 network adds a coarse indication as to location of the origin of the message. The CELLEMETRY™ gateway and SS7 cellular switch may also be configured to prioritize the messages, with messages such as alarm messages being immediately processed, and other messages such as meter readings being stored and transmitted all at once as a batch file, possibly once a day.

A significant advantage of use of the overhead control channels is that the CELLEMETRY™ data service never employs a voice channel for communication, and is transparent to all cellular telephone users. CELLEMETRY™ transmission utilizes an existing system throughout the United States and requires no modification or extra equipment installations to the cellular system, only standard database translations similar to those of a cellular telephone. Thus, a CELLEMETRY™ remote device may be installed wherever Cellemetry™ service is present (>99% of US) and be operational from the first day, and in many instances within 30 minutes, of installation. Since control channel transmissions are digital by design, they are inherently more reliable. This reliability is increased by each transmission being transmitted five times, with three identical received messages of these five causing acceptance of the message as correct. Also, frequency reuse for the control channels is enhanced so that it is more robust than for the voice channels. Further yet, radio transmissions over the control channels is at higher power levels so that the control channels are operational when the voice channels are not.

The data elements that are conveyed between the remote units and the CELLEMETRY™ gateway are the mobile identity number, which is sent to the remote unit over the forward control channel by the data center, and the electronic serial number, which is sent to be data center by the remote unit over the reverse control channel. The mobile identity number is a 10-digit telephone number very similar to a standard telephone number, while the electronic serial number is a 32-bit binary number. For CELLEMETRY™ applications, the mobile identification number becomes an equipment identification number and the electronic serial number becomes a data packet. Particularly with respect to Applicant's system, each remote unit such as units 140 (FIG. 1) may have stored therein several mobile identity numbers, one of which being a main, unique account identifier number that causes that particular remote unit to be addressed, or "wake up". The others of these mobile identification numbers stored or assigned to each remote unit are global or universal numbers associated with a particular function to be performed by that remote unit. Thus, when an addressed remote unit receives, from the data center over a forward control channel, a mobile identity number associated with a function the remote unit is programmed to perform, the remote unit then performs that function. In the instance where the remote unit is programmed to return data to the data center, the data is encoded into an electronic serial number and the electronic serial number sent as a registration to the data center via the reverse control channel. As such, each remote unit functions similarly to a roaming cellular telephone with respect to the cellular telephone system. The mobile identity number of a remote unit is used to route the mobile identity number and the electronic serial number associated with that remote unit through an SS7 cellular switch to a specific port of the CELLEMETRY™ network, this port in turn being connected to the CELLEMETRY™ gateway and the Internet. In addition to the mobile identity numbers and electronic serial numbers, Applicant may also use the caller ID function, which provides 10 additional BCD digits to transmit control information.

Referring now to the following tables, structure of messages sent between data center 154 (FIG. 8) and remote units is shown by way of example. As stated, CELLEMETRY™ is used to transmit data between the remote units and the data center. When a message is to be sent by the data center to a remote unit, the message is in the form of a mobile identification number. As such, a first unique mobile identification number is transmitted to address a particular remote unit or a plurality of remote units, and a second, universal mobile identification number is transmitted to cause the addressed remote unit/units to perform a function associated with the universal mobile identification number.

In one contemplated scheme, the universal mobile identification numbers are used in command sequences to command a particular remote unit or a plurality of remote units within a particular area. The universal mobile identification numbers are allocated once for a cellular switch, and may be allocated so that the base number starts at an even hundred (last three digits of 100, 200, 400, 600, 800) and consumes 160 consecutive mobile identification numbers. The universal mobile identification numbers are used in sets of mobile identification numbers. Each set provides a specific command to the remote unit, and starts at a mobile identification number relative to the universal mobile identification number base number. This allocation is required due to limited RAM space in the remote unit microprocessor. The universal mobile identification number sets, how many mobile identification numbers are required in each set and offset of set from the base are shown in the following Table 1.

TABLE 1

| # MIN's in Set | MIN Set Description | Set beginning MIN # |
|---|---|---|
| 100 | TOU Schedule, TOU Month/Day, & TOU Schedule Number Set | xxx xxx xe00 |
| 10 | Commanded Meter Read Set | xxx xxx xo00 |
| 10 | RM Status & Disconnect Set | xxx xxx xo10 |
| 20 | Load Shed Set | xxx xxx xo20 |
| 10 | Toggle TOU Enablement Set | xxx xxx xo40 |
| 10 | TOU Sequence Command Set | xxx xxx xo50 |
| 160 | TOTAL Universal MIN's | |

For commanded meter reading, when a remote unit receives a page including its unique mobile identification number and a page including a commanded meter read mobile identification number set, the remote unit registers the indicated meter's face value and if enabled, the period time of use (TOU) reading, as shown in the following Table 2 of unique mobile identification numbers followed by respective universal mobile identification numbers.

TABLE 2

| | |
|---|---|
| xxx xxx xo00 and xxx xxx xo01 | Read Meter 1 Face and TOU (if enabled) |
| xxx xxx xo02 and xxx xxx xo03 | Read Meter 2 Face and TOU (if enabled) |
| xxx xxx xo04 and xxx xxx xo05 | Read Meter 3 Face and TOU (if enabled) |
| xxx xxx xo06 and xxx xxx xo07 | Read Meter 4 Face and TOU (if enabled) |
| xxx xxx xo08 and xxx xxx xo09 | Read Meter 5 Face and TOU (if enabled) |

For prepaid metering with connect/disconnect capabilities, the following Table 3 shows a mobile identification set that may be used for such a prepaid system.

TABLE 3

| | |
|---|---|
| Xxx xxx xo10 and xxx xxx x011 | Get RM Model/Version |
| Xxx xxx xo12 and xxx xxx xo13 | Get RM Detailed Status |
| Xxx xxx xo14 and xxx xxx xo15 | Connect (Close Service Relay) |
| Xxx xxx xo16 and xxx xxx xo17 | Disconnect (Open Service Relay) |
| Xxx xxx xo18 and xxx xxx xo19 | Spare |

Table 4 shows a mobile identification number set that may be used for controlling opening and closing load control relays.

TABLE 4

| | |
|---|---|
| xxx xxx xo20 and | RM's in Load Control Group 1 command |
| xxx xxx xo21 | Close of load control relays |
| xxx xxx xo22 and | RM's in Load Control Group 2 command |
| xxx xxx xo23 | Close of load control relays |
| xxx xxx xo24 and | RM's in Load Control Group 3 command |
| xxx xxx xo25 | Close of load control relays |
| xxx xxx xo26 and | RM's in Load Control Group 4 command |
| xxx xxx xo27 | Close of load control relays |
| xxx xxx xo28 and | RM's in Load Control Group 5 command |
| xxx xxx xo29 | Close of load control relays |
| xxx xxx xo30 and | RM's in Load Control Group 1 command |
| xxx xxx xo31 | Open of load control relays |
| xxx xxx xo32 and | RM's in Load Control Group 2 command |
| xxx xxx xo33 | Open of load control relays |
| xxx xxx xo34 and | RM's in Load Control Group 3 command |
| xxx xxx xo35 | Open of load control relays |
| xxx xxx xo36 and | RM's in Load Control Group 4 command |
| xxx xxx xo37 | Open of load control relays |
| xxx xxx xo38 and | RM's in Load Control Group 5 command |
| xxx xxx xo39 | Open of load control relays |

The following Tables 5 and 6 indicate mobile identification sets for enablement of time of use readings and time of use sequence command mobile identification numbers respectively.

TABLE 5

| | |
|---|---|
| Xxx xxx xo40 and xxx xxx xo41 | Meter 1 TOU Enablement Toggle |
| Xxx xxx xo42 and xxx xxx xo43 | Meter 2 TOU Enablement Toggle |
| Xxx xxx xo44 and xxx xxx xo45 | Meter 3 TOU Enablement Toggle |
| Xxx xxx xo46 and xxx xxx xo47 | Meter 4 TOU Enablement Toggle |
| Xxx xxx xo48 and xxx xxx xo49 | Spare |

TABLE 6

| | |
|---|---|
| xxx xxx xo50 and xxx xxx xo51 | Set Schedule Number Command |
| xxx xxx xo52 and xxx xxx xo53 | Set Weekday Schedule Command |
| xxx xxx xo54 and xxx xxx xo55 | Set Weekend/Holiday Schedule Command |
| xxx xxx xo56 and xxx xxx xo57 | Set Holiday Month/Day Command |
| xxx xxx xo58 and xxx xxx xo59 | Set Activate Month/Day Command |

For scheduling time of use readings, i.e. time of use month/day and the schedule number, mobile identification number set of 100 mobile identification numbers is provided in the following Table 7.

TABLE 7

| | |
|---|---|
| Xxx xxx xe00 and xxx xxxx xe01 | Schedule Number 1 |
| Xxx xxx xe02 and xxx xxxx xe03 | Schedule Number 2 |
| . . . | Schedule Numbers 3 . . . 48 |
| Xxx xxx xe96 and xxx xxxx xe97 | Schedule Number 49 |
| Xxx xxx xe98 and xxx xxxx xe99 | Schedule Number 50 |

Time of use periods end mobile identification numbers, interpretation for the "set weekly schedule command" and "set weekend/holiday schedule command is shown in the following Table 8.

TABLE 8

| | |
|---|---|
| xxx xxx xe00 and xxx xxx xe01 | 12:00 AM |
| xxx xxx xe02 and xxx xxx xe03 | 12:30 AM |
| . . . | Every half-hour increment |
| xxx xxx xe92 and xxx xxx xe93 | 11:00 PM |
| xxx xxx xe94 and xxx xxx xe95 | 11:30 PM |
| xxx xxx xe96 and xxx xxx xe97 | |
| xxx xxx xe98 and xxx xxx xe99 | |

Month/day mobile identification numbers, interpretation for the "set holiday month/day command" mobile identification numbers and "set active month/day command" mobile identification numbers are shown in the following Table 9.

TABLE 9

| | |
|---|---|
| xxx xxx xe00 and xxx xxx xe01 | Month 1 (Jan) |
| xxx xxx xe02 and xxx xxx xe03 | Month 2 (Feb) |
| . . . | Months 3 . . . 11 |
| xxx xxx xe22 and xxx xxx xe23 | Month 12 (Dec) |
| xxx xxx xe24 thru xxx xxx xe29 | |
| xxx xxx xe30 and xxx xxx xe31 | Day 1 of Month |
| xxx xxx xe32 thru xxx xxx xe89 | Days 2 . . . 30 of Month |
| xxx xxx xe90 and xxx xxx xe91 | Day 31 of Month |
| xxx xxx xe92 thru xxx xxx xe99 | |

Eight mobile identification number mask registers in the remote units are used. Assignments for these registers are as shown below.

1. RM default (unique) mobile identification number.

2. RM status and disconnect mobile identification number group.

3. Meter reading mobile identification number group.

4. Load control close mobile identification number group.

5. Load control open mobile identification number group.

6. Toggle meter TOU enablement mobile identification number group.

7. TOU schedule definition mobile identification number group.

8. TOU schedule period, month/day, and schedule number mobile identification number group.

Paging sequences for performing the indicated functions are shown in the following Table 10.

TABLE 10

| Function | Page MIN | Registration ESN |
|---|---|---|
| Read Meter of an RM | 1) RM MIN<br>2) A Meter Reading MIN | 1) Meter Face reading for the meter.<br>2 . . . 7) TOU Periods 1 . . . 6 Readings for the meter, if TOU enabled for the meter. |
| Connect or Disconnect Power at an RM | 1) RM MIN<br>2) Connect or Disconnect MIN | 1) RM Detailed Status |
| Get Detailed Status | 1) RM MIN<br>2) Get RM Detailed Status MIN | 1) RM Detailed Status |
| Get RM Model/ Version | 1) RM MIN<br>2) Get RM Model/Version MIN | 1) RM Model/ Version |
| Toggle Meter TOU Enablement | 1) RM MIN<br>2) A Meter TOU Enablement MIN | 1) RM Detailed Status |
| Load Shed Control | 1) A Load Control Group Open or Close MIN | None |
| Set Schedule Number Command | 1) Set Schedule Number Command MIN<br>2) Schedule Number MIN | None |
| Set Weekday Schedule Command | 1) Set Weekday Schedule Command<br>2 . . . 7) TOU Periods End Time MINs for periods 1 . . . 6 | None |
| Set Weekend/ Holiday Schedule Command | 1) Set Weekend/Holiday Schedule Command<br>2 . . . 7) TOU Periods End Time MINs for periods 1 . . . 6 | None |
| Set Holiday Month/ Day Command | 1) Set Holiday Month/Day Command MIN<br>2) Month MIN<br>3) Day of Month MIN | None |
| Set Activate Month/ Day Command | 4) Set Activate Month/Day Command MIN<br>5) Month MIN | None |

The following Tables 11-14 show bit structures of the electronic serial number registrations sent from the remote units.

TABLE 11

| | | | |
|---|---|---|---|
| 3 3 2 2<br>1 0 9 8<br>0 0 0 0 | 2 2 2 2<br>7 6 5 4<br>Meter #<br>0 . . . 3 | 2<br>3<br>6 BCD Digit Meter Face Values | 0 |

TABLE 12

| | | | | |
|---|---|---|---|---|
| 3<br>1<br>0 | 3 2 2<br>0 9 8<br>Period #<br>1 . . . 6 | 2 2 2 2<br>7 6 5 4<br>Meter #<br>0 . . . 3 | 2<br>3<br>6 BCD Digit TOU Period Value | 0 |

TABLE 13

| | | | |
|---|---|---|---|
| 3 3 2 2<br>1 0 9 8<br>1 1 1 1 | 2<br>7<br>0 | 2<br>6<br>RM Detailed Status | 0 |

TABLE 14

| | | | | | | |
|---|---|---|---|---|---|---|
| 3 3 2 2<br>1 0 9 8<br>1 1 1 1 | 2<br>7<br>1 | 2 2 2<br>6 5 4<br>x x x | 2<br>3<br>RM Model #<br>3 BCD digits | 1<br>2 | 1<br>1<br>RM Version #<br>3 BCD digits | 0 |

In the above tables 11-14, the various fields for the 32 bit electronic serial numbers are shown. In these 32-bit fields, the four most significant digits signify a function to be performed. For instance, in Table 11, where the four most significant digits are all zeros, this indicates to the remote unit that a meter reading operation is to be performed. In Table 12, where three ones and one zero is present, this is indicative of a time of use period value to be read. In Table 13, where all ones are present in the four most significant digit positions and a zero is present at bit 27, this is indicative of a detailed status request of the remote unit. In Table 14, where the four most significant digits are ones and bit 27 is also one, this is indicative of a request for the remote unit to transmit its version and model number.

In Table 11, which as indicated is an electronic serial number for transmitting a meter reading, bit positions 24-27 are used to indicate which of up to four meters (electricity, gas, and up to two water meters) are to be read. As stated above, these four bit positions could be used to indicate which of up to 16 meters are being read. Bit positions 0-23 are used to indicate the meter face value (in a 6 digit BCD format) of the meter being read. In Table 12, as indicated, where bit 31 is zero, bit positions 28-30 are used to indicate a time of use period number, and bits 24-27 indicate which meter is to be read. As described, bit positions 0-23 contain a six digit BCD number indicative of the face value of the meter.

Table 13 shows bit positions for a detailed status report of the remote unit. Here, bits 0-23 indicate the following information:

bit 0: FRAM (ferrous random access memory) currently bad.

bit 1: FRAM currently or was bad.

Bit 2: DS1305 (timing chip) currently bad.

Bit 3: DS 1305 is currently or was bad.

Bit 4: CRAD (remote unit) handling software just have a bad step.

Bit 5: CRAD handling software just had or previously had a bad step.

Bit 6: spare.

Bit 7: new problem detected.

Bit 8: AC power condition, 1-on, 0-off.

Bit 9: AC power changed, 1-on, 0-off.

Bit 10: connect/disconnect switch condition, 0-closed, 1-open.

Bit 11: connect/disconnect desired condition, 0-closed, 1-open.

Bit 12: battery low current condition, 1-low, 0-not low.

Bit 13: battery low accumulated condition, 1-was low.

Bit 14: load control actual positions, 0-closed, 1-open.

Bit 15: power outage enabled, 1-yes, 0-no.

Bit 16: page sequence bad-current.

Bit 17: page sequence bad-accumulated.

Bit 18: service available (always 1).

Bit 19: power outage reporting timing, 1-immediate, 0-with delay based on remote module mobile identification number.

Bit 20: bit 0 of AC offs count.

Bit 21: bit 1 of AC offs count.

Bit 22: bit 2 of AC offs count.

Bit 23: bit 3 of AC offs count.

In the remote module detailed status electronic serial number format, bits 24-26 are spares, although these bit positions are used in other electronic serial number formats. Bits 7-15 should be self-explanatory to one skilled in the art, while bit 16 it is indicative of status of a series of global mobile identification numbers issued in a particular sequence. A problem indication here would typically indicate that one of the pages of the sequence of pages was not received. Bit 18 is indicative of a bad sequence since a last report. Bit 18 indicates status of Cellemetry™ service. With respect to bit 19, a power outage is a high-priority event that demands immediate transmission when the bit is set, and a lesser priority when not set. Bits 20-23 indicate a duration of time AC power is off at a monitored site.

It is contemplated that there are to be about nine message types transmitted over the power line network subsystem. The Echelon network addressing scheme is used for addressing each message. Whenever a domain/subnet/node type messages received by a node, an acknowledge message is returned to the sending node. If it the sender does not receive and acknowledge the message within two seconds of the transmission, then the sender will retransmit the message. Two retries are attempted if there is no response from the addressed node. The following Table 15 indicates the type of message, name of the message, originator of the message call when the messages sent, and address type.

TABLE 15

| Type # | Type Name | Originator | When | Address Type |
|---|---|---|---|---|
| 1 | Day/ Dollar Message | Neuron-main | COP8 Command | Domain/subnet/node to Neuron-remote |
| 2 | Consumer Acknowl-edge | Neuron-remote | Consumer presses 'Consumer Acknowledge pushbutton while '4 to 5 days remaining' is shown and 'FUNDS LOW' message is being displayed. | Domain/subnet/node to Neuron-main |
| 2 | Test Message | Neuron-main, Neuron-remote, Test Device | Test button push on Neuron-main or Neuron-remote. Test device operator command on Test Device. | Domain/subnet/node for 1) Neuron-main to Neuron-remote and Test Device, 2) Neuron-remote to Neuron-main and |

Since there are typically more than one residences or establishments coupled to a power line transformer, there will be several sets of neurons coupled to the power line network. Thus, each set of neurons associated with a particular residence or establishment using power from a power line transformer common to other residences/establishments must be uniquely addressed so the messages between any set of neurons will only be seen by that set. The Echelon domain/subnet/node addressing scheme is used to solve this problem. All main neuron modules will be given a unique domain/subnet/node value, with the node value always being an even number, this number set during manufacture. During installation, verification is made via a test set that the power line interface is functioning, and that communications between the two neurons and communications with the test set are enabled. This ensures that the neurons are able to communicate with each other without interference with/from other neuron sets operating on the same power line transformer.

During this installation test, the test set is plugged into an AC wall outlet, and the SERVICE PIN pushbutton pressed, after which, if the neurons are functioning correctly, an ACKNOWLEDGEMENT is received by the test set. If no ACKNOWLEDGEMENT is received, this is an indication that the neurons are not functioning properly. Setting of the domain/subnet/node address of a main neuron is to be done with a test/install test set device. The domain/subnet/node address given to the remote neuron of the pair of neurons is the same as its companion main neuron coupled to the power line interface except the node value of the remote neuron will be the next higher value, i.e. an odd value, with respect to the even number of the main neuron value.

The LCD display 124 is manufactured by MATRIX ORBITAL Inc.™, part number LK162-12. The display is interfaced to the remote neuron via an RS-232 serial port at 2400 baud. As the display is set during manufacture at 9600 baud, the baud rate must be changed as set forth in the display user's manual. This change must be performed prior to integration with the remote neuron.

As earlier stated, the meter reading RF subsystem may include nominally up to three units per residence or establishment, with a fourth of these units mounted in the electrical meter along with the circuit board containing microprocessor 54 and CELLEMETRY™ to radio 50. This remote unit is required regardless of whether any other remote RF subsystems are installed. The RF subsystems monitoring water and gas meters communicate with the remote module over an 837-916 MHz radio link.

As the remote RF units are battery-powered, the remote RF units will be in a "sleep" mode most of the time, with an on-chip timer waking the chip once each hour, or at any other predetermined interval, for a meter reading and transmission cycle. Each reading is transmitted three times to provide redundancy.

Since all RF transmissions are on the same frequency, each remote unit must detect whether there is data currently being transmitted by another remote unit in a nearby residence or establishment. Here, before each transmission from a remote water or gas RF unit to a main remote unit, a check is made as to whether no other water or gas remote within reception range is transmitting. If a transmission from another water or gas remote RF unit is detected, the remote RF unit attempting to transmit will wait a random number of seconds prior to attempting another transmission. This sequence of waiting until no transmission is detected will repeatedly occur until no other transmission is detected, after which the remote unit in need of transmitting will transmit to the respective remote RF unit. Typically, microprocessor 54 is programmed to transmit the meter readings once a day back to the data center where the readings are associated with a customer in the database. Where a meter fails to report, as where the signal is blocked, then a report is generated that is put in a maintenance queue that indicates to service personnel that the meter may need servicing. In other instances, such as where "peak usage" is monitored, one or more meter readings may be made and transmitted back to the data center, or the microprocessor may be programmed to read the meter at the beginning and end of the peak hours and send a single message indicating usage during peak hours.

In other electrical utility applications, remote units coupled to capacitor banks of small and large substations and on electrical poles may be used to control capacitor switching in order to adjust power factor at various points in an electrical distribution system. Related to this and to the prepaid/automatic meter reading system as described supra, is a fault detection system wherein remote units may be located to monitor automatic reclosers and circuit breakers on electrical utility substations and individual electrical branch lines on utility poles or underground electrical systems servicing neighborhoods or other similar localized areas. Here, any information related to electrical power failure or repeated automatic attempts to reconnect electrical power may be reported back to the data center via the overhead control channels of the cellular telephone system. Likewise, with respect to water systems, motion detectors used in conjunction with remote systems similar to that disclosed may be used to detect intrusion upon water storage tanks or areas proximate water intakes for water systems, these intakes many times located to draw water from rivers, lakes or other surface water reservoirs. Again, any intrusion into these areas or onto a water tank would result in an alarm signal transmitted over the overhead control channels of the cellular telephone network and through the Cellemetry™ to gateway to the Internet and ultimately to the data center.

In another similar application, remote monitoring of utility crews or other emergency personnel during severe weather, earthquakes or other natural or manmade disasters may be undertaken in conjunction with the GPS (Global Positioning Service). Here, each service vehicle is equipped with a GPS receiver capable of providing an electronic output indicative of its location, this output coupled to a remote unit as described herein. During an emergency or at other times, a global page may be sent out from the data center, over the Internet and forward control channel instructing all mobile units to report their position, with each mobile unit reporting its position in an electronic serial number via the reverse control channel and back to the data center as described. As this occurs in near real time, crews most proximate a location in need of service may be dispatched posthaste to the location.

As should be apparent from Applicant's disclosure, practically any monitoring service may be accomplished by installation of a remote unit as disclosed herein, with communications to/from the remote units being strictly over the overhead control channels. As no voice communication channels are involved, communication costs are greatly reduced (as low as 0.3 cents/message), and the remote units are relatively inexpensive, in the $100.00-$200.00 range at today's prices. Installation is generally simple, and the system may be operational within 30 minutes of installation, with the only modification to the cellular system being simple software translation tables for correctly routing the mobile identification numbers and electronic serial numbers to the cellular gateway. Further, notifications of alarms or reporting of meter readings or the like may occur by pages, email or otherwise transmitted over the Internet.

Figure 9A:
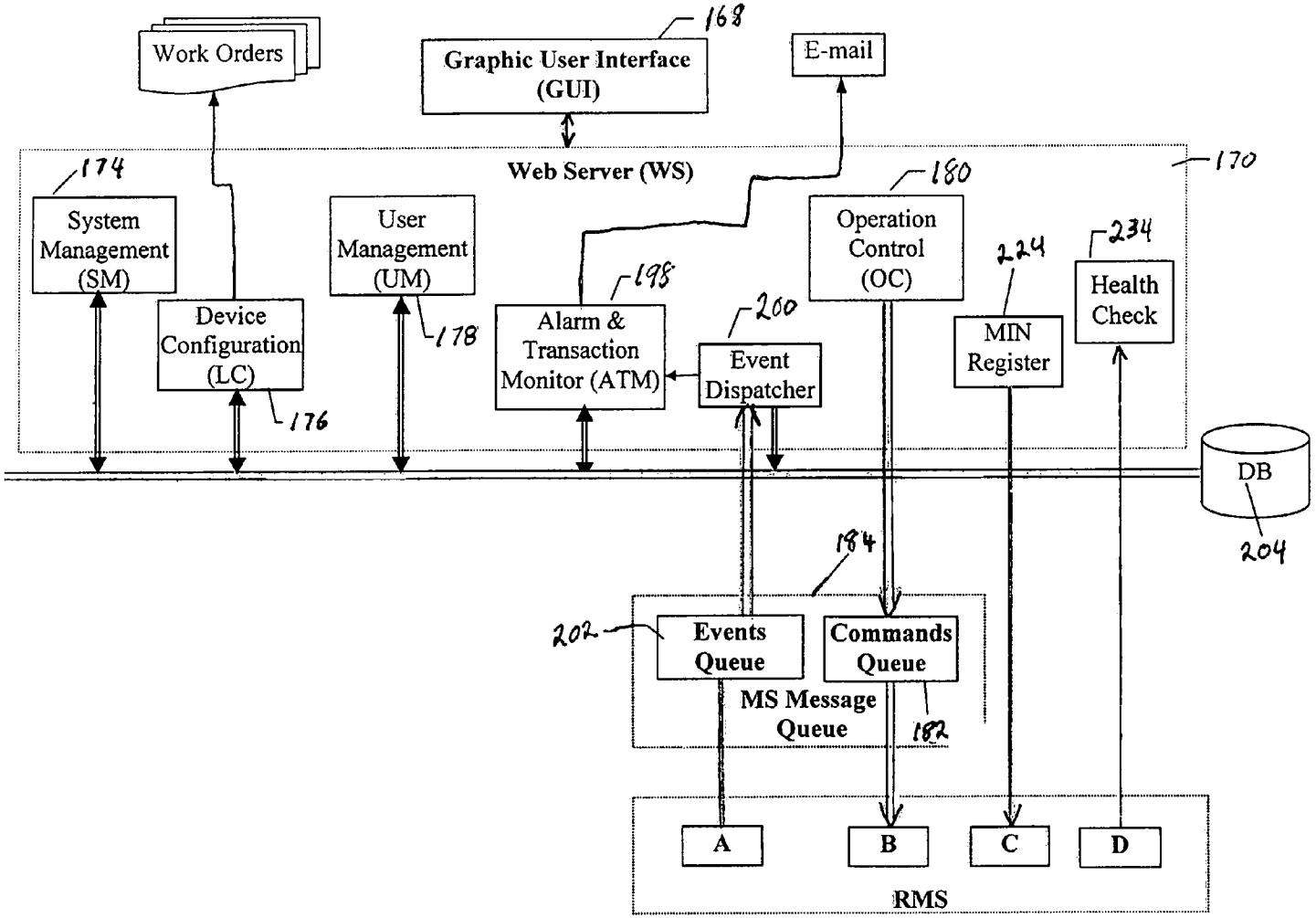
FIGS. 9*a*, 9*b* and 9*c* are block diagrams showing detailed architecture of a data collection system of my invention.
Figure 9B:
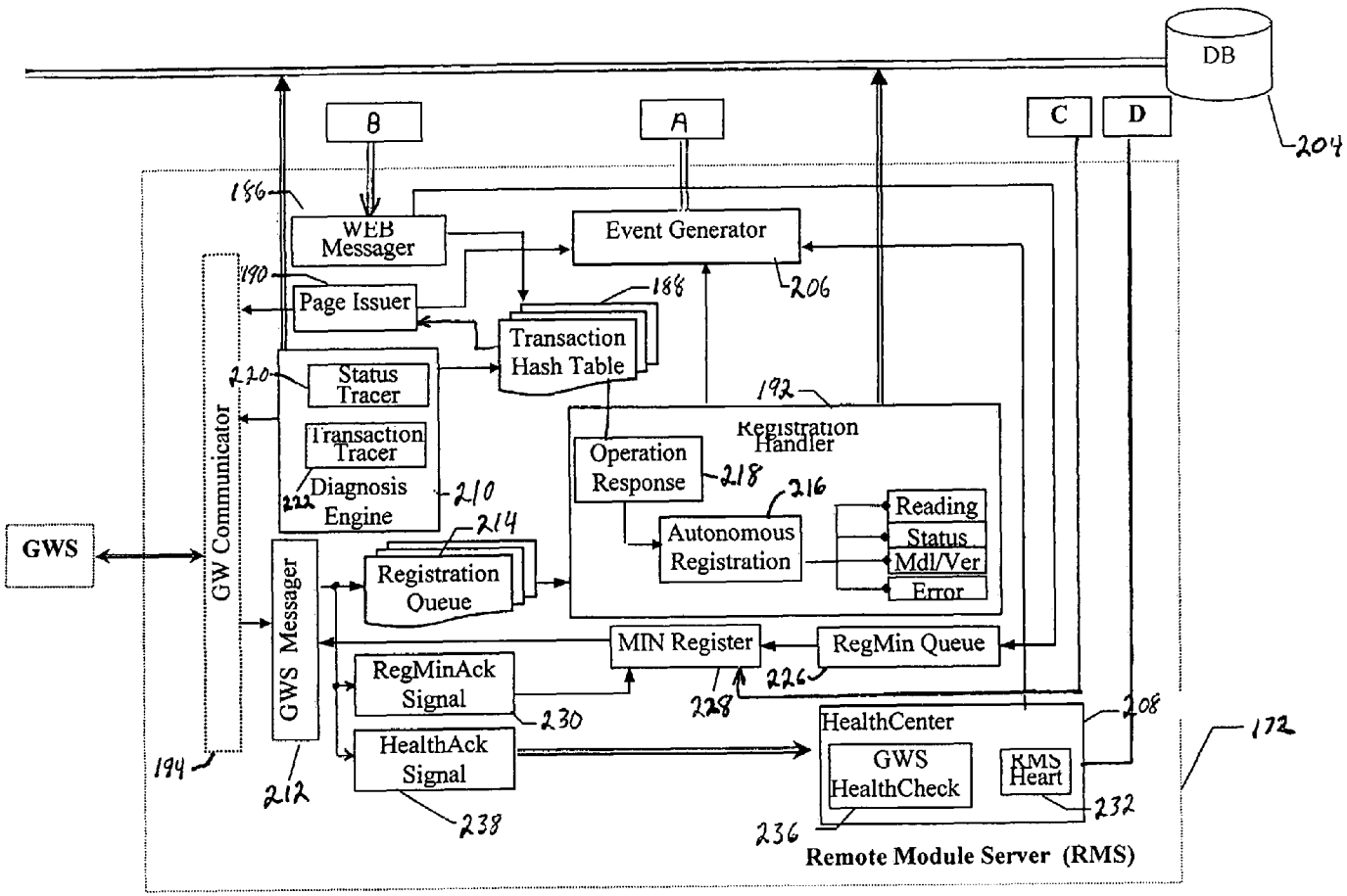
Figure 9C:
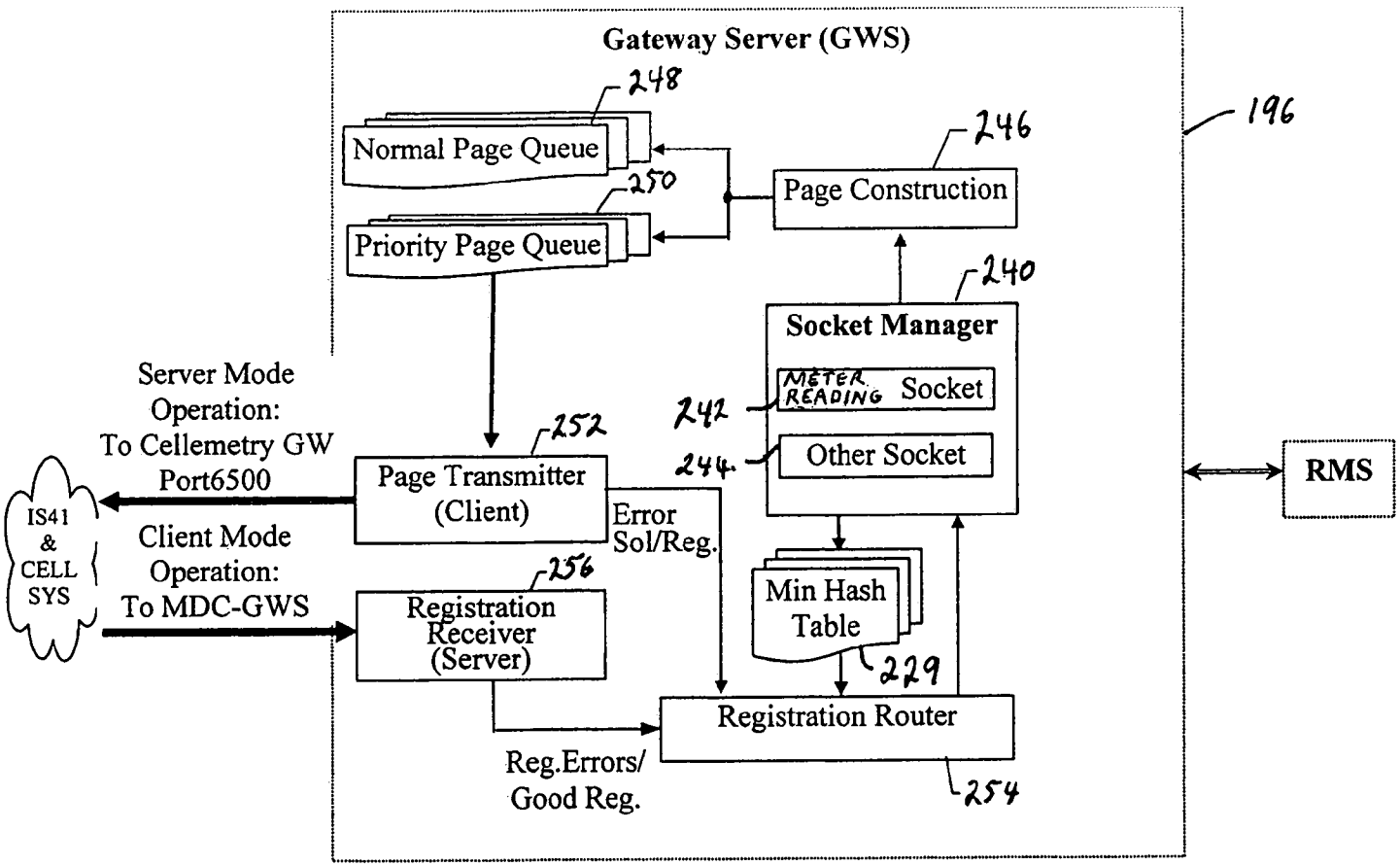

With respect to the data center of FIG. 8, reference is now made to FIGS. 9*a*, 9*b* and 9*c*, which more specifically illustrates operation of the data center and related systems. Here, graphical user interface 168 (FIG. 9*a*) may include any operating system, such as Windows 2000™ or Windows N™. Other operating systems, such as LINUX™ and UNIX™ may also be used as would be determined by a skilled programmer. Any browser, such as Internet Explorer™, Netscape™, Eudora™, Mozilla™ or another as determined to be appropriate by a skilled programmer may be used. As stated, interface 168 may be in a client company computer, in addition to an interface 168 in the service company system. Web servers or general-purpose computers 170 generally configured as shown and described may be in a client company location. Further, web server 170 and remote modules server 172 (FIG. 9*b*) may be configured as software modules that may be installed on a client company's computer system. Further yet, a plurality of remote module server software modules and web server modules may be installed in one or more computer servers of my service company.

For web server 170, VISUAL STUDIO™ ASP NE™ may be used as a programming language. VISUAL C#™ may be used to develop remote module server 172. VISUAL C++™ may be used to develop the gateway server, and MICROSOFT™ SQL SERVER 2000 may be used for the database. For database access, ADO.NET may be used, and HYPERTEXT MARKUP LANGUAGE™ (HTML) may be used for generating reports. Of course, other programming languages may be used, as would be determined by the particular computers and server systems of other applications.

Graphical user interface 168 communicates with web server 170, which also contains service routines or modules for system management 174. System management 174 generally performs management functions, such as system parameter configuration, i.e. TCP/IP port setting, maintenance of lookup tables, system timer control, monitors system performance and manages logs and alarms.

Device configuration 176 provides for adding and deleting discrete remote units, such as electrical meters, collection units, capacitor bank switches, remote units configured for surveillance and any other application. Typically, these functions are performed at an administrative level. User management module 178 allows management of users by administrators and provides administrative privilege control so that operators may be added and deleted and passwords for operators and administrators selected or assigned.

Operational control and monitor module 180 relates to routine functions of the system, such as sending commands that connect and disconnect electrical power, operate capacitor bank switches and perform other functions. Also, this module handles alarms that are presented to operators, and handles other requests from operators of the utility or other company. For issuing commands, module 180 communicates with command queue 182 of the message queue 184. The command queue 182 in turn provides queued command information to web messenger 186. Messenger 186 aggregates MIN numbers so that up to 8 transactions (MIN default numbers for particular remote units or a single global MIN number) may be sent in a single page, with a command MIN (connect, disconnect, etc.) being the ninth MIN number. As such, up to 8 remote units may be "awakened" by the default MIN numbers, with these activated remote units commanded to perform the transaction defined by the ninth MIN number. Here, a transaction is defined as the process of causing a remote unit to perform an action, and receive and process a response from that remote device indicating that the action was accomplished. As such, each transaction is assigned an ID number that includes identification of the remote unit associated with that transaction, given a time stamp and includes a status flag that is used to indicate the transaction's status to various components of the system.

As it generally takes a minute or so for a page to be sent, pages containing the same MIN number, as where a command or request is incorporated into two pages and the pages must be received by the remote unit sequentially, must be spaced apart in time to avoid the possibility of the second page being transmitted prior to the first page. Also, one or more bit positions in the MIN number may be used to indicate to the cellular system where in a sequence a page is to be inserted. Further, the commands may be prioritized in remote module server 172, as where a command or request for data relating to a surveillance system or a request for data relating to an electrical power outage is tagged as a higher-priority message. Such a priority code may range from low, medium and high, thus requiring only two bits to transmit priority information. In other instances, priority may be either low or high, requiring only one bit to transmit priority information. As such, lower priority commands, such as a request to read a meter or obtain daily usage, may be sent when there are no existing higher priority commands to be sent.

The transactions are stored in a transaction hash table 188, after which the commands are obtained by page issuer 190. Hash table 188 incorporates several algorithms such as sorting pages in accordance with a priority scheme, for searching for one or more transactions that generate an error in the system and passing the error to registration handler 192, associating a received registration to a respective sent command and determining an origin, i.e. a source, of commands in the instance where multiple diverse systems are used. Page issuer 190 communicates the commands to the gateway server communicator 194, which in turn issues the pages, as by a conventional TCP/IP socket interface, to gateway server 196 (FIG. 9*c*).

Alarm and transaction monitor 198 in web server 170 receives alarms, alerts and similar messages from remote modules and the system in general and provides them to operators of the system. These alarms may be generally indicative of failures of devices connected to a respective remote module, such as a railroad switch heater, a water, gas or electrical meter or surveillance device. In addition, responses to inquires, such as status requests, are provided to operators via alarm and transaction monitor 198. Further, software and hardware errors of the system are reported via alarm and transaction monitor 198. These alarms, inquiries and error messages are provided to monitor 198 by event dispatcher 200. Generally, event dispatcher 200 obtains event data from event queue 202, which temporarily stores transaction results and alarm messages, and associates transaction results messages with a respective MIN number and transaction ID obtained from data base 204. In addition, the event dispatcher correlates a result with a user in the event where multiple, diverse systems to are incorporated in a single service company system.

Event data received by event dispatcher 200 is generated by event generator 206 (FIG. 9*b*), which receives inputs from health center 208, registration handler 192, diagnosis engine 210 and page issuer 190. With respect to health center 208, any failure with respect to overall operation of the system and errors that are returned will elicit an alarm by health center 208, which alarms and errors being passed to event generator 206. With respect to commands and requests, page issuer 190 provides a return indication to event generator 206 that the page containing one or more commands or requests was successfully sent. If the page was not successfully sent, an acknowledgement signal from the gateway server is not received and the command or request is not deleted from hash table 188. This results in two attempts to resend the page, after which an error is generated. A received acknowledgement response to sending a page to a remote unit is passed to gateway communicator 194, and subsequently to gateway server messenger 212. Messenger 212 provides the acknowledgement signal in the form of a registration, and places the registration in registration queue 214. From there, registration handler 192 periodically polls registration queue 214, and picks up the registration and processes the registration as will be described.

Registration handler 192, responsive to an incoming registration, provides an indication of such to event generator 206 that a registration has been received. Incoming registrations from gateway server 196 that are solicited, i.e. responsive to commands and inquiries, are received by gateway communicator 194 and passed to registration queue 214. From queue 214 the registrations are passed to registration handler 192. Here, operation response 218 associates a transaction in hash table 188 with the registration for the MIN of that transaction and changes status of the transaction to "completed". This results in the transaction being deleted from hash table 188, although the transaction may be stored in a log or history file in the database. Where the registration is unsolicited, i.e. from an alarm or status change, the registration is compared by autonomous registration module 216 with previous readings to determine what the change of status is, as in a surveillance system where a motion detector is tripped. This change of status is then provided to an operator. Where the registration contains an error message, then the information is sent to event generator 206 to be provided to an operator. In registration handler 192 are temporary storage areas for storing information related to remote units of the system. For example, status is an area where status information of remote units is stored, this information related to power, battery levels and relay and switch positions. MDL/VER is storage for the model numbers and versions of the remote units. ERROR is temporary storage for error messages, and which may generate a warning and store the error message in a log file.

Diagnosis engine 210, containing status tracer 220 and transaction tracer 222, traces transactions to insure they are acted upon and monitors health of the remote modules and network communications. Here, transaction tracer 222 periodically polls transaction hash table 188 for transactions that have been marked as completed by operation response 218, and deletes completed transactions from the hash table. Where a transaction has been acted on in server 172 but no acknowledgement of such was sent by either the cellular system or the gateway server, then transaction tracer 222 waits for a predetermined period of time, such as 2 minutes, and if a confirmation has still not been received, then it causes the transaction to be resent. This delay and resending occurs twice, and if no confirmation is received after the last resending, then transaction tracer 222 causes an alarm to be generated via event generator 206. Status tracer 220 monitors health of the remote units, each of which being typically programmed to transmit a health signal at predetermined intervals, i.e. once a day or once a week or so for remote modules such as in a meter reading application, or at other intervals depending on the application.

MIN register 224 provides temporary storage for adding and deleting MIN numbers for devices in the field that are added or removed. In this instance, when a new device is fielded, a new MIN number is assigned to that device. This new MIN number may be added by an administrator of the service company, or by an operator or administrator of the end user company. The new MIN number is added through device configuration 176, from which the MIN number is added to MIN register 224 and database 204. Register 224 is periodically polled by web server messenger 186, and obtains the MIN number and places it in register MIN queue 226. When a MIN number is found in queue 226 by MIN register or hash table 229, as by polling, the new MIN number is picked up and passed to gateway communicator 194. Communicator 194 in turn passes the new MIN number to gateway server 196 where it is stored in MIN hash table 229. MIN register 224 is also used during initialization of the system. Here, all MIN numbers for all remote devices associated with fielded systems, such as the meter reading systems, capacitor bank switching and surveillance systems, are obtained from database 204 by MIN register 228 and passed to MIN hash table 229 in gateway server 196.

While a direct pathway is shown (for clarity) for transferring MIN numbers from register 224 to register 228, the actual data pathway is through command queue 182, web messenger 186, transaction hash table 188 and registration handler 192. Here, the new MIN number from device configuration 176 is inserted into command queue 182 by MIN register 224. Web messenger 186 then notifies MIN register 228 that a new MIN is being added. MIN register 228 then passes the new MIN number to gateway communicator 194, from which the Min number is passed to gateway server 196 and stored in MIN hash table 229. Such new MINs, when added to server 196, are acknowledged by register min ACK signal 230, which notifies MIN register 228 that the new MIN was successfully registered in hash table 229.

The remote module server health check signal from box 232 to health check module 234, while also shown as a direct connection from remote module system heart 232 for clarity, is in fact sent through event generator 206 and event queue 202 to health check module 234. This signal is provided from the remote module server 172 to rms heart module 232, and indicates health of the remote module server. Health check module 234 in web server 170 monitors general health of the remote modules. Gateway server health checker 236 monitors health of the gateway server, and receives health information via gateway server messenger 212 and health acknowledgement signal 238. In this system, upstream components check health of downstream components, i.e. web server 170 checks health of remote module server 172, server 172 checks health of gateway server 196, etc. If there is a problem with any of the components then an error message is sent to an administrator via event generator 206.

As described, transaction information for sending a page is developed in operational control module 180, as when a command, such as to energize or de-energize one or more heaters, read particular water, gas or electrical meters, etc., may be initiated by a user logged into graphics interface 168. In other instances, operational control module 180 may be programmed to automatically send pages to the remote devices, as where meters are being read. The transaction information for a page is passed to command queue 182 where it is held until called by web messenger 186 and passed to hash table 188, where it is stored until called by page issuer 190. Page issuer 190 issues a page to gateway communicator 194, which in turn passes the page information to gateway server 196. In addition, page issuer 190 provides notification to event generator 206 that a page was issued, and event generator 206 in turn provides notification to the operator as to whether the page was successful or not. Gateway server 196 receives commands and inquiries from remote module server 172, and passes these commands and requests through the Internet to the CELLEMETRY™ gateway. From the other direction, responses and registrations are transmitted by the IS-41 and cellular phone system to the CELLEMETRY™ gateway and through the Internet where they are passed to gateway server 196.

Server 196 receives page requests from remote module server 172 via a socket manager 240 (FIG. 9*c*), which may use a TCP/IP socket communicator. Socket manager 240 may be provided with discrete socket modules for handling different systems, such as meter reading socket module 242, with other system socket modules, i.e. for capacitor bank switching, surveillance, etc., represented by "other socket" 244. It should be noted that these discrete sockets function similarly, so that such socket modules may easily be developed and added or deleted as needed to the platform as additional applications are added to the system. Where there are different remote module servers, which as described may be either in separate computers or configured as modules in one computer, the boxes marked STATUS, MOD/VER and ERROR are constructed to be specific to that system. Additional boxes may be added, for example in the meter reading application a box labeled METER READING would be symbolic of a memory region where gas, electric and water meter readings would be stored.

The pages are configured into pages at page construction 246, and placed in one of queues 248, or priority page queue 250.

These queues receive the pages as determined by the priority scheme in hash table 188. Here, pages stored in priority page queue 250 are sent first, and when empty, pages from normal page queue 248 are sent. Page transmitter 252 passes the pages to the CELLEMETRY™ gateway to the Internet, from which the page is routed by the IS-41 and cellular system to the remote module associated with the MIN number of the page. If an error occurs, page transmitter 252 provides the MIN number associated with the error to registration router 254, which in turn associates the error with the MIN number of the remote device from hash table 229. Hash table 229 maintains a record of all MIN numbers associated with the socket resources of all remote modules of the system. Registration receiver 256 receives registrations from the remote modules, and passes them to registration router 254, which associates the registration with a corresponding remote server by looking up the default MIN of the remote server in hash table 229. The registration is then passed to socket manager 240 for transmission to remote module server 172 to be processed as described.

A series of flowcharts will now be described, with functions of these flowcharts being generally related to remote server 172 in the block diagram of FIGS. 9*a*, 9*b* and 9*c* and the screen images of FIGS. 12-46.

Figure 10:
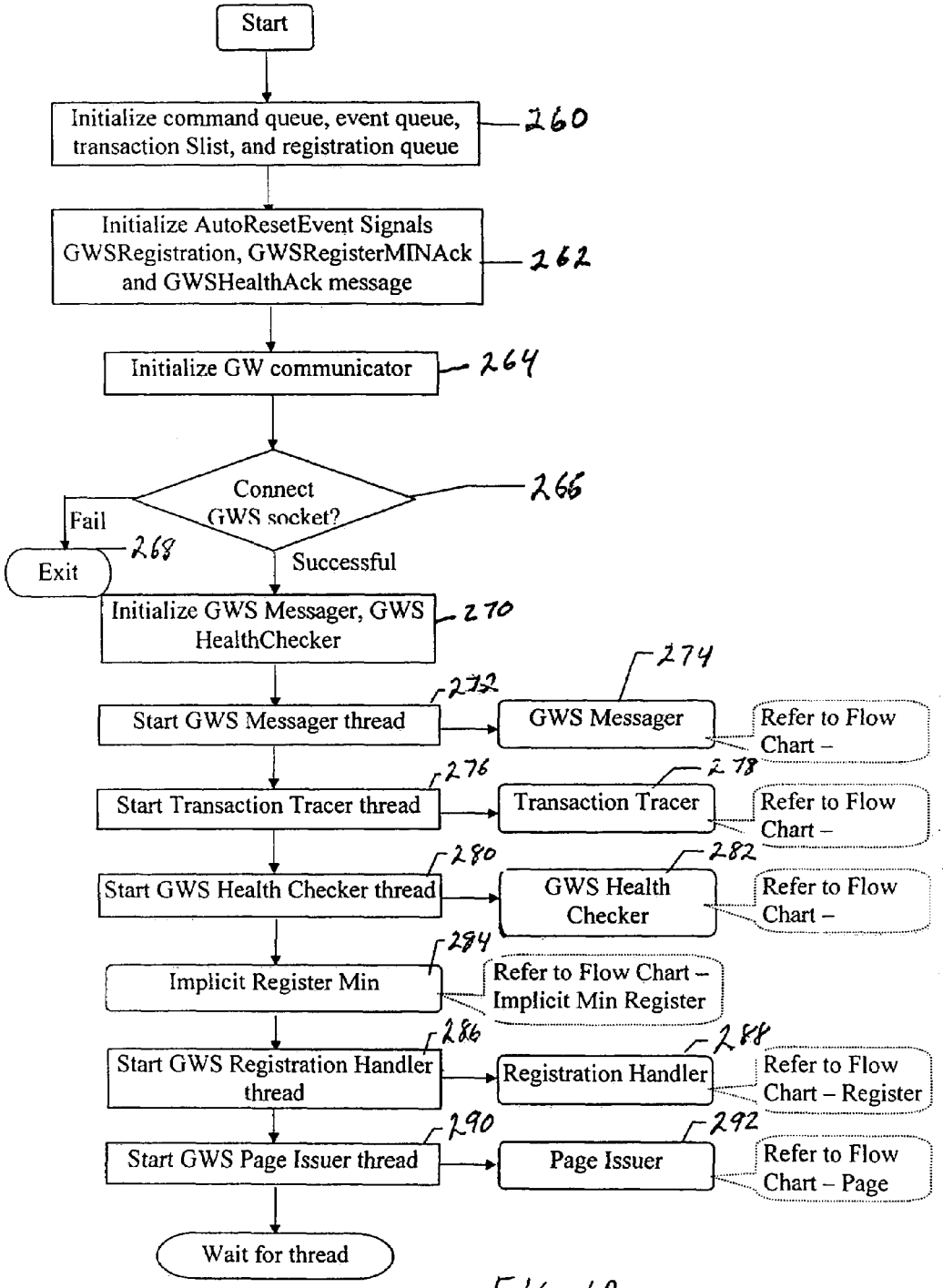
FIG. 10 is a flowchart showing initialization sequences of a data center of my invention.

Here, FIG. 10 shows an initialization sequence. First, at box 260, the command queue, event queue, and transaction hash table 188 (FIG. 9*b*, the hash table 188 labeled Slist at box 260 of FIG. 10), and registration queue are initialized, and where appropriate populated with default values. Next, at box 262 the autoresetevent signal, GWSregistration, GWSregisterMINack signal and GWShealthack message are initialized. At box 264 the GW communicator is initialized to establish the socket connection to the gateway server. At box 266 an inquiry is made as to whether the socket connection to the gateway server was successful, and if unsuccessful, then the program returns a FAIL signal and exits at box 268. If the connection was successful, then at box 270 the gateway server messenger and gateway server health checker are initialized. At box 272 the gateway server messenger thread is started, allowing the gateway server messenger to run at box 274. At box 276 the transaction tracer thread is started, allowing the transaction tracer to run at box 278. At box 280 the gateway server health checker thread is started, allowing the gateway server health checker to run at box 282. At box 284 the implicit register MIN, i.e MIN register 224 (FIG. 9*a*) retrieves all MIN numbers for the remote modules from database 204 and passes them via the gateway communicator 194 (FIG. 9*b*) to hash table 229 (FIG. 9*c*) in gateway server 196. At box 286 (FIG. 10) the gateway server registration handler thread is started, allowing the registration handler to run at box 288. At box 290 the gateway server page issuer thread is started, allowing the page issuer to run at box 292. It should be noted that the threads of boxes 272, 276, 280, 286 and 290 run as endless loops, i.e when they reach the end, as shown on their respective flowcharts, they loop back to the beginning and run again.

Figure 11:
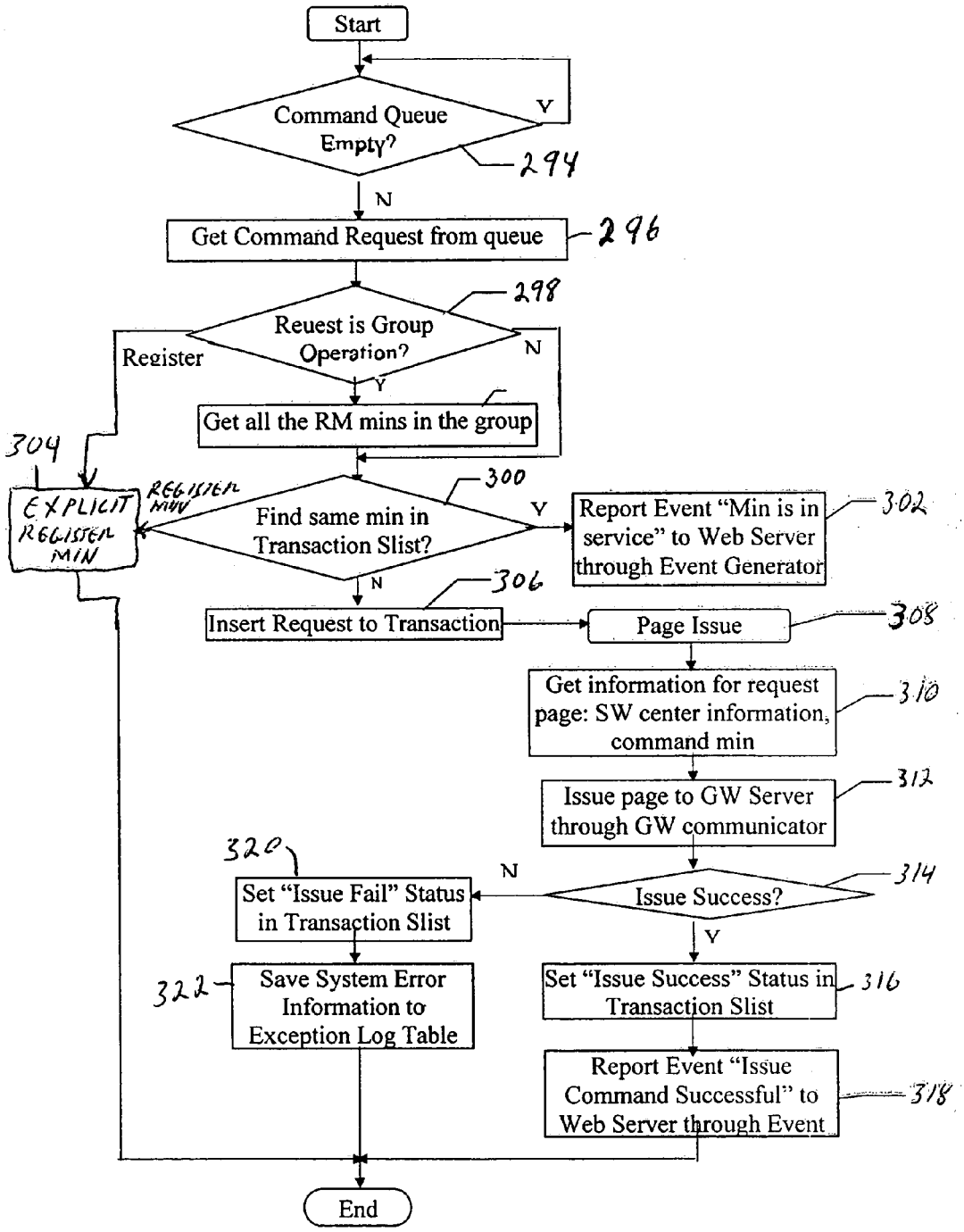
FIG. 11 is a flowchart of one of the processes initialized in the flowchart of FIG. 10.

FIG. 11 is a flowchart of one method by which pages may be issued by the page issuer thread 290 that was initialized in FIG. 10. At box 294 the query is made as to whether the command queue 182 (FIG. 9*a*) for issuing commands to remote modules, such as a railroad heater remote module, an electrical meter remote module or any other remote module of Applicant's system, is empty or if commands are present in the queue. In the instance where the command queue is empty, the program simply loops back at box 294 (FIG. 11) to ask the question again. If the command queue is not empty, as indicated by a "NO" answer at box 294, meaning that at least one command is in the queue, such as a command to connect or disconnect electrical power, to read a meter or get status information from a remote module, then the command request is retrieved by web server messenger 186 FIG. 9*b*) from the command queue 182 at box 296 (FIG. 11). At box 298 the question is posed as to what type of command has been retrieved. If the command is an individual command, i.e. a command to a discrete remote module, such as to connect or disconnect a specific residence or business or switch a specific capacitor bank for a utility system, then the program loops to box 300 where the question is asked as to whether the same MIN is in the transaction hash table 188 (FIG. 9*b*), meaning that the remote module is busy processing a previously-issued command. If the MIN is found in the status list of hash table 188, then the answer at box 300 (FIG. 11) is YES, meaning that the action is in progress. Here, while the action at the remote module takes little time to accomplish, sending the page and receiving an associated registration may require a minute or more. Thus, at box 302 a report is generated via event generator 206 (FIG. 9*b*) indicating that the requested MIN is already being processed, with this report being shown as a PENDING indication in an indicator 470 of the screen of FIG. 36. Similarly, where a group of MINs are requested, as where a plurality of meters are commanded to be read, and one or more such readings are already in process, then corresponding reports are generated through event generator 206 (FIG. 9*b*).

If the command type is a register MIN (box 304), as where a new remote module is added to the system, a MIN number is added to database 204 (FIG. 9*a*, 9*c*) for the new remote module. In this instance, the new MIN number is added to MIN register 224 (FIG. 9*a*), which in turn provides it to MIN register 228 (FIG. 9*b*) where it is passed via gateway communicator 194 and socket manager 240 (FIG. 9*c*) to hash table 229 of gateway server 196. Where the answer at box 300 (FIG. 11) is NO, meaning that the transactions are not in progress, then the program falls through to box 306 where the request or requests is/are inserted into the transaction hash table 188 (FIG. 9*b*). This causes, at box 308 of FIG. 11, a "PAGE ISSUE" to be initiated that results in the issuance of a page containing the command MIN. At box 310 the command MIN is obtained along with switching center information for the requested page by page issuer 190 (FIG. 9*b*), and at box 312 of FIG. 11 the page is issued to gateway server 196 (FIG. 9*c*) via gateway communicator 194. At box 314 (FIG. 11) the query is made as to whether the page was successfully issued, as by reception of an acknowledgement signal from the cellular system, and if so then at box 316 "ISSUE SUCCESS" is associated with the respective MIN in transaction hash table 188 (FIG. 9*b*). At box 318 of FIG. 11 "ISSUE COMMAND SUCCESSFUL" is reported to web server 170 (FIG. 9*a*) through event generator 206 (FIG. 9*b*), which reports a successful issue of the command, an indication of which may be obtained by a customer user or service user via field 474 of the screen of FIG. 37, and the program exits. If the issued command was not successful at box 314, then at box 320 "ISSUE FAIL" is associated with the MIN number in transaction hash table 188, and at box 322 error information is saved in an exception log table in database 204, and may be displayed in the field 478 of FIG. 40. In the instance of a major failure, the failure message may be provided by a failure indication in one of indicators 470 as shown in the screen of FIG. 36, in field 474 of FIG. 37 and in an indicator 476 in the screen of FIG. 38.

Figure 11A:
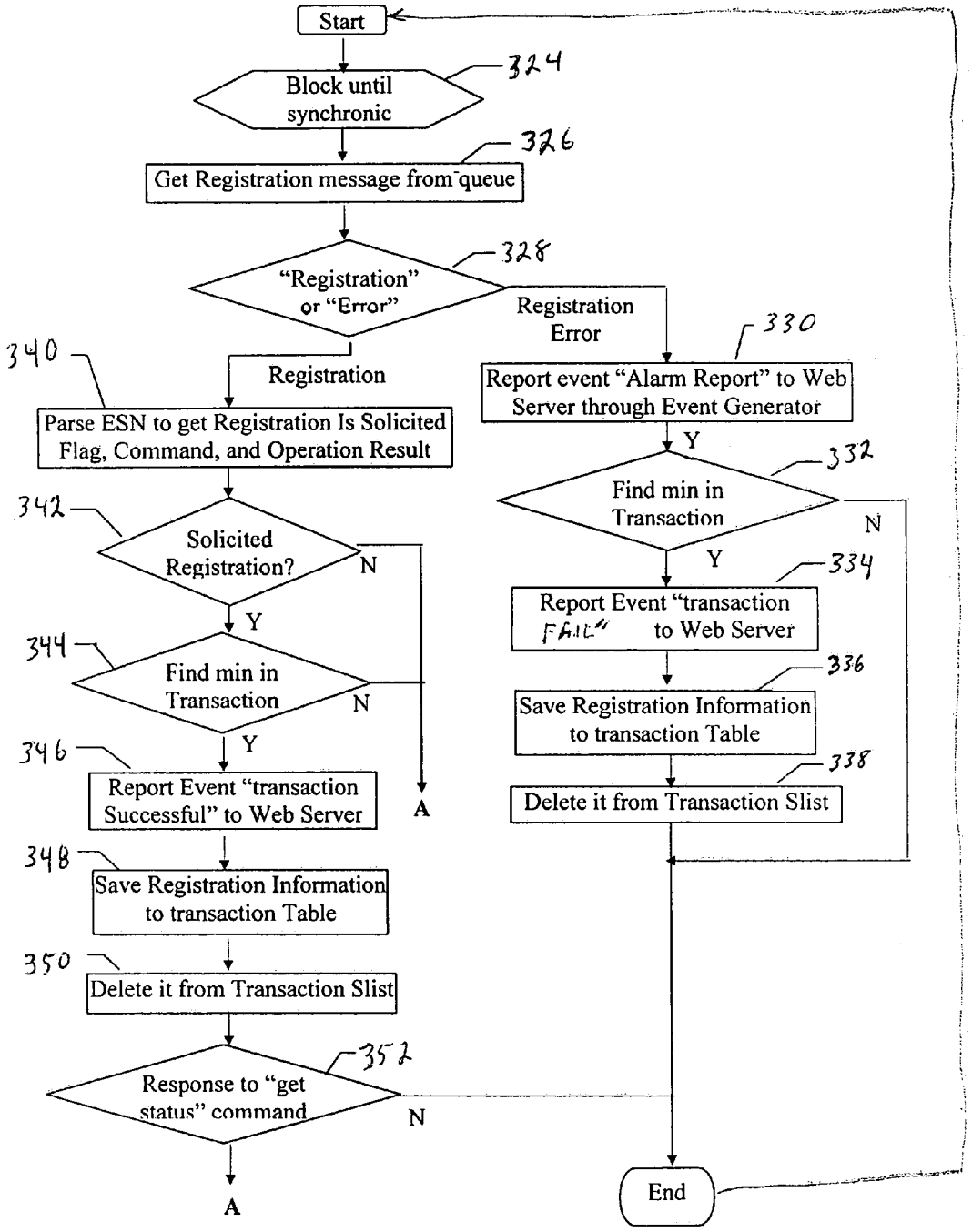
FIG. 11*a* is a flowchart of another of the processes initialized in the flowchart of FIG. 10.

FIG. 11*a* illustrates, by way of example, one possible logic flow for handling registrations, i.e. the registration handler thread 286 of FIG. 10. Generally, this logic flow describes how registration data is obtained from a registration queue, the data being parsed and reports generated containing, where appropriate, an error message that is displayed in field 476 of the screen of FIG. 39, status information that is displayed as an indicator 470 of screen 36 or as an indicator 476 of screen 38, with the status, alarm or other message saved in database 204.

More specifically, at box 324 the registration is buffered in registration queue 214, and gateway server 196 (FIG. 9*c*) notifies registration handler 192 by a synchronic signal that a registration is waiting to be picked up, at which point the registration message is obtained by gateway server messenger 212 (FIG. 9*b*) at box 326. At box 328 the query is posed as to whether or not the message is a registration message or an error message. In the instance where the message is a registration error message, then at box 330 the event "ALARM REPORT" is reported to web server 170 (FIG. 9*a*) via event generator 206 (FIG. 9*b*). As described, the error message may be displayed in field 476 of the screen of FIG.

Figure 36:
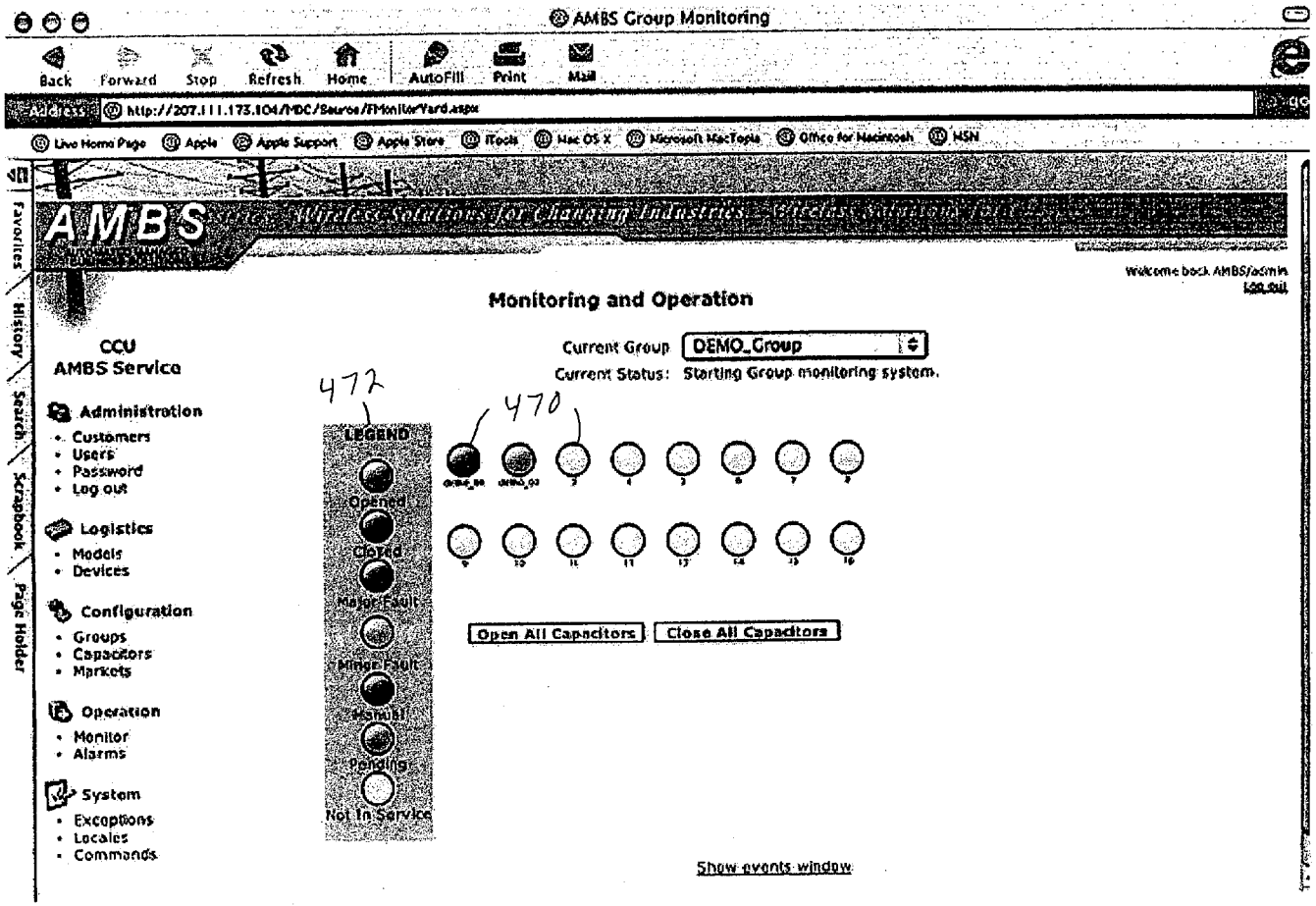
FIG. 36 is an image of a screen for monitoring status and operation of remote units, and which is accessible from the screen of FIG. 13.
Figure 37:
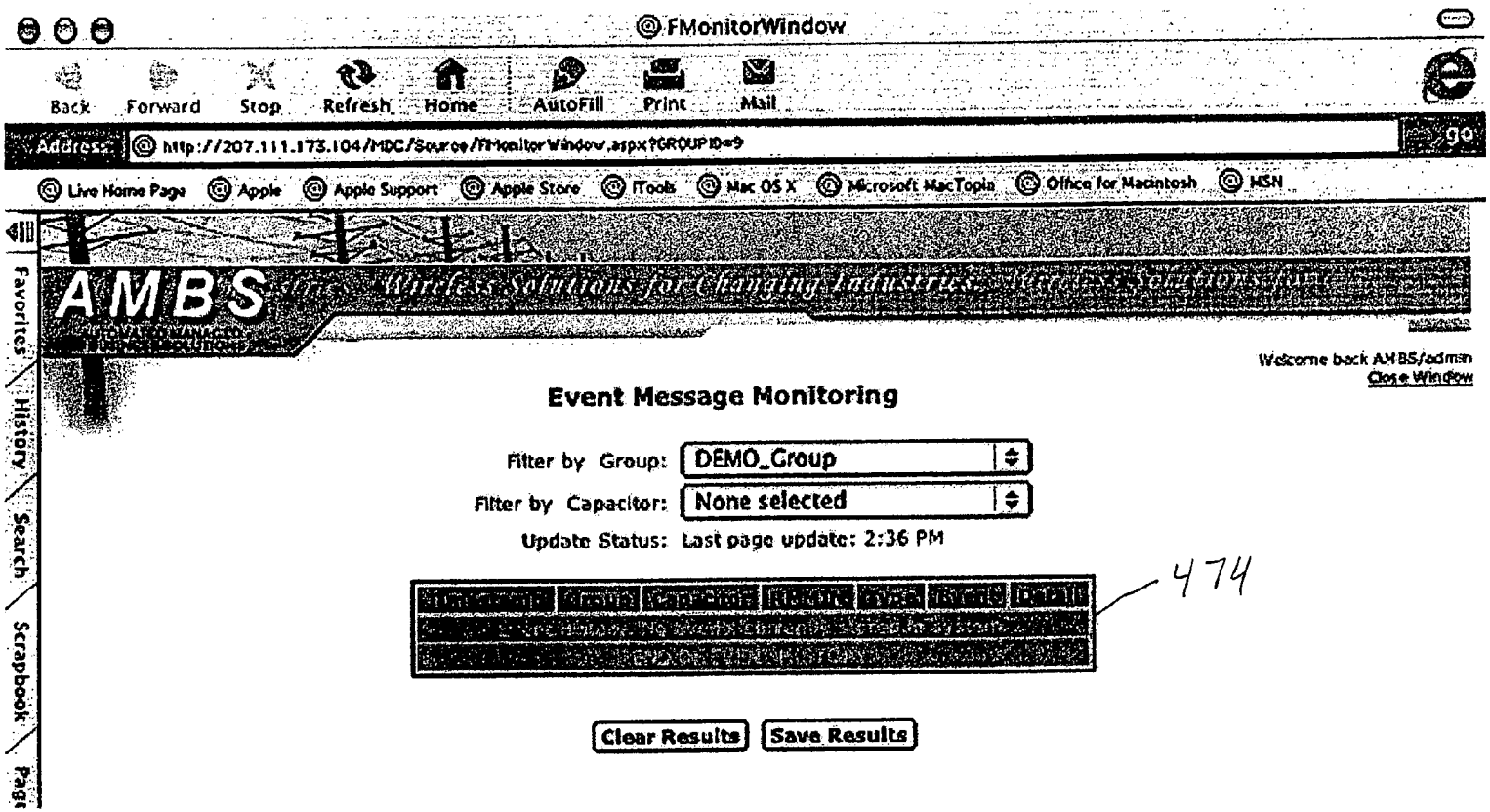
FIG. 37 is an image of a screen accessible from the screen of FIG. 36.
Figure 38:
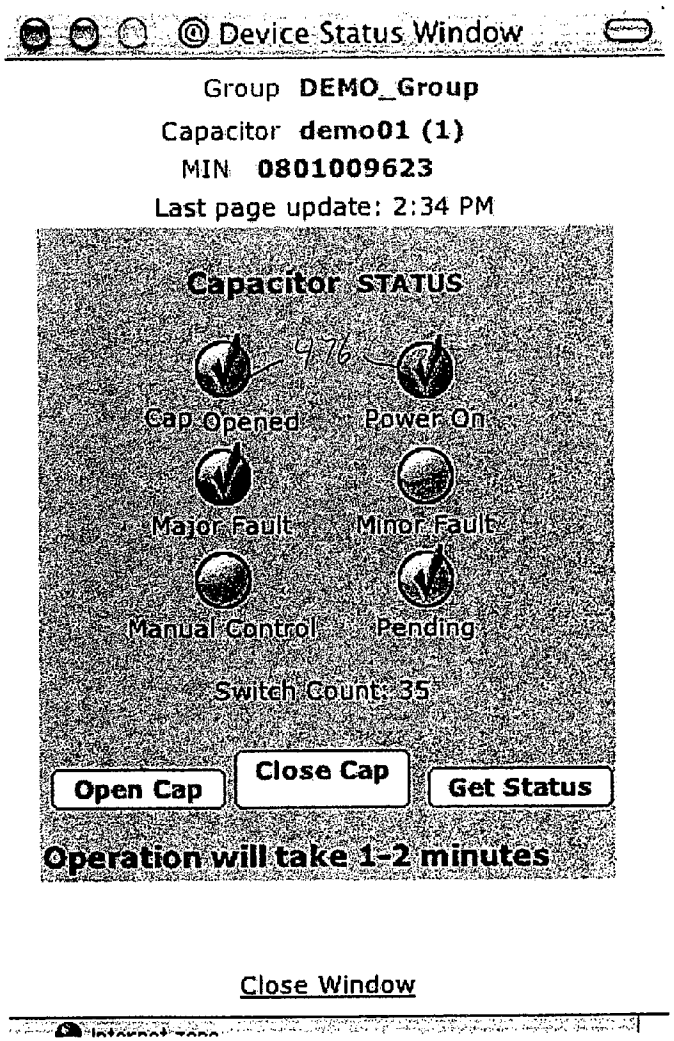
FIG. 38 is an image of a screen accessible from an indicator of the screen of FIG. 37.

39, as a status indication in one of indicators 470 in the screen of FIG. 36 and as an indication in the screen of FIG. 38.

At box 332 (FIG. 11*a*) the inquiry is posed as to whether or not the MIN number is found in hash table 188. If so, then at box 334 "TRANSACTION FAIL" is reported to web server 170 via event generator 206 and an event is reported, as by displaying or otherwise making accessible a message in field 474 of the screen of FIG. 37.

At box 336 the registration information is saved to a transaction table in database 204, and at box 338 the registration error message is deleted from the transaction status list (a data structure in hash table 188). Where the answer at box 332 is NO, then the program loops to the beginning to run again at box 324.

Figure 11B:
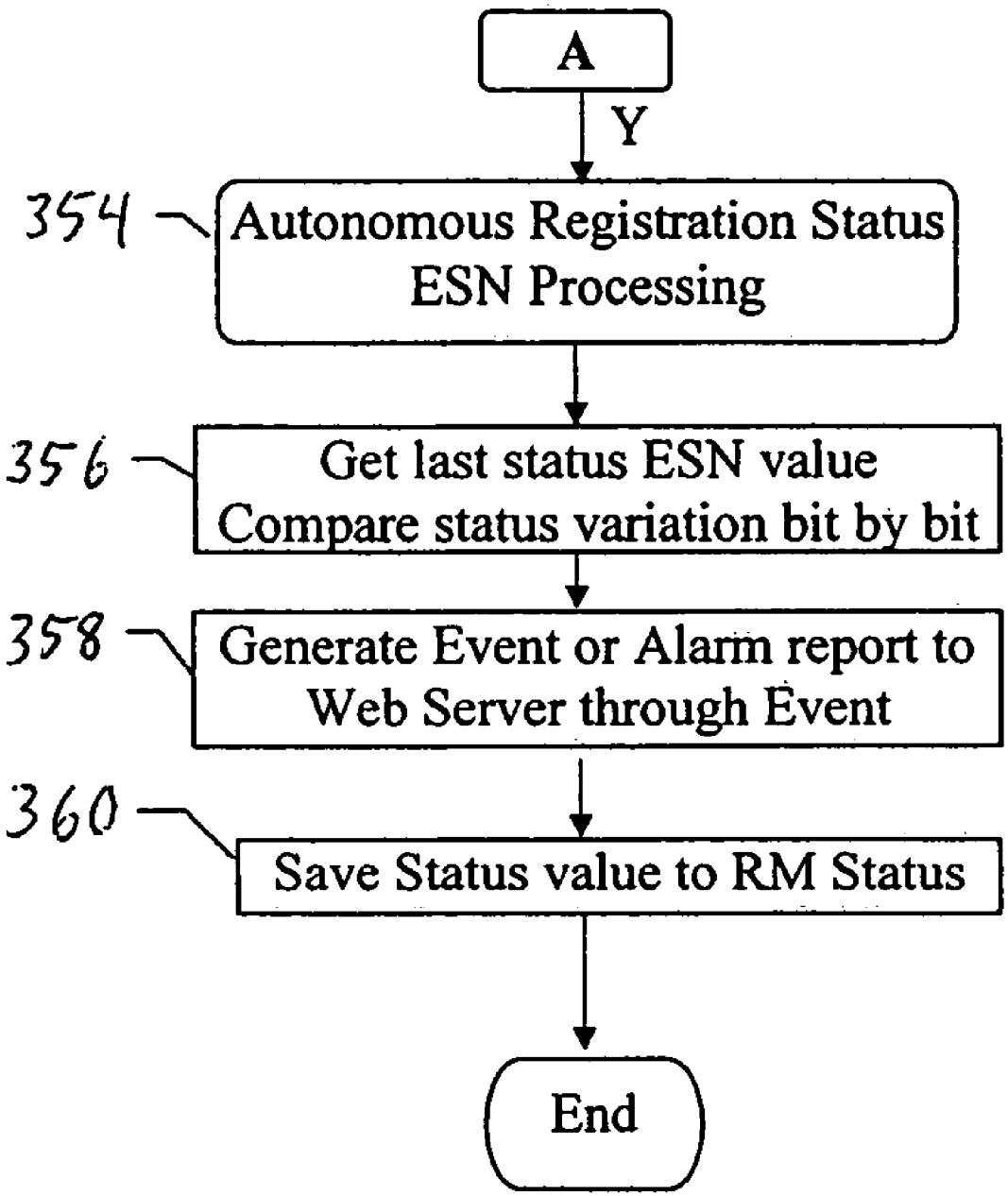
FIG. 11*b* is a continuation of the flowchart of FIG. 11*a*.

As stated, this logic module runs in an endless loop. If, at box 328 a registration was received instead of an error, then at box 340 the ESN number is parsed by gateway server messenger 212 to obtain registration information, i.e whether the command was solicited or unsolicited, the corresponding command type and operation result. At box 342 the question is asked as to whether the registration was solicited, and if so then at box 344 the question is asked whether the corresponding MIN that solicited the registration is located in transaction hash table 188. If so, then at box 346 "TRANSACTION SUCCESSFUL" is reported to web server 170 via a calling function in event generator 206. At box 348 the registration information, i.e. time that the registration was received, status, ESN result, exception, etc., is saved to the transaction table in database 204, and at box 350 the MIN number that solicited the registration is deleted from hash table 188 and the program falls through to inquiry box 352. At box 352 the question is posed as to whether the registration was solicited or unsolicited, i.e. response to "get status", and if the registration was unsolicited then the logic falls through to box 354 (FIG. 11*b*). Where the answer at either of box is 342 or 344 is no, meaning that the registration was not solicited or the MIN number was not found in hash table 188, then the program also loops to box 354 where autonomous registration status electronic serial number (ESN) processing occurs for an unsolicited registration. Here, all registrations have a status field, with the status bits being compared with previous status indications and if different a corresponding alarm generated, which may be displayed in field 476 of the screen of FIG. 39.

At box 356, the ESN value of the registration is compared, bit by bit, with the ESN value retrieved from database 204. If there is a bit change then at box 358 an alarm is generated and sent to web server 170 to be displayed, as by providing an alarm indication in field 476 of FIG. 39.

At box 360 the new status value is saved in database 204. Where the answer at box 352 is no, then the program exits and runs again.

FIG. 11*c* illustrates the process of gateway server messenger 212, which also runs in an endless loop. As stated, this component receives messages from gateway server 196 (FIG. 9*c*) through gateway communicator 194 (FIG. 9*b*) and dispatches messages to different modules such as registration queue 214, MIN register 228 and gateway server health checker 236, each of which subsequently performing their respective functions. At box 362 (FIG. 11*c*) messages are obtained from gateway server 196 (FIG. 9*c*) via the "get message" function of gateway communicator 194 (FIG. 9*b*). At box 364 the question is asked as to what type message has been obtained. For a gateway server register MIN ack message, the logic flows to box 366, for a gateway server registration the logic flows to box 368, and for a gateway server health acknowledgement signal the logic flows to box 370. At box 366, the register MIN ack signal is parsed to obtain the MIN number and ESN string, and at box 372 the MIN register is signaled to indicate that the gateway server register MIN ack message has been received, after which the program exits. Where the message type is a gateway server registration, at box 368 the message is parsed to obtain the MIN and ESN strings. At box 374 the message is inserted into registration queue 214 (FIG. 9*b*), and at box 376 registration handler 192 is signaled to indicate that there is a message in registration queue 214, after which the logic exits. At box 370 the gateway server health checker is signaled to indicate an acknowledgement signal has been received, indicating that the gateway server is up and running correctly. After boxes 372, 376 and 370 the logic flow exits.

Figure 11D:
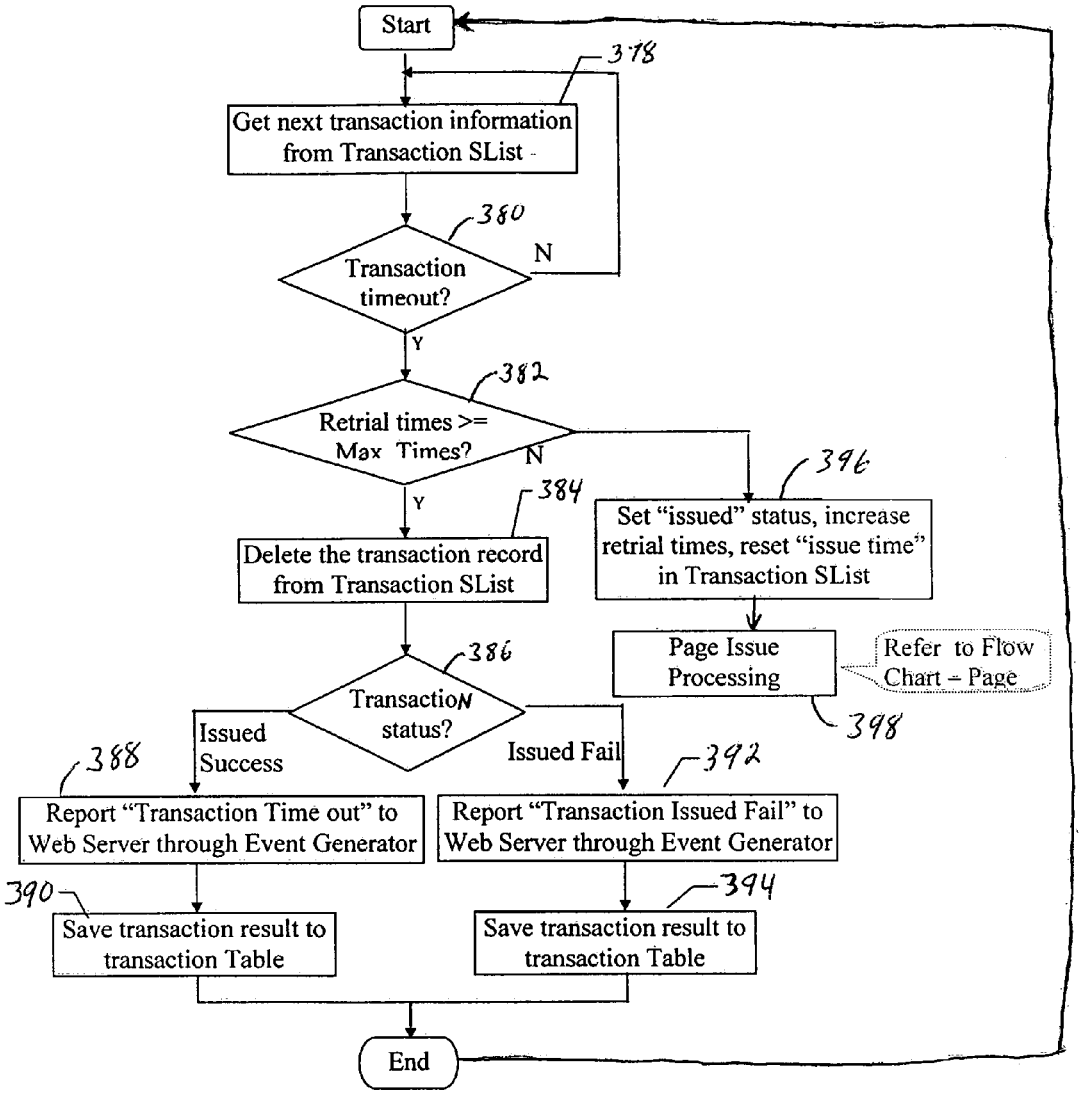
FIG. 11*d* is a flowchart of another of the processes initialized in the flowchart of FIG. 10.

FIG. 11*d* depicts a flowchart relating to insertion of event messages into event queue 202. Again, this logic runs in an endless loop, and occurs when registration handler 192 generates an alarm, event or transaction message. The logic may also be called by page issuer 190, diagnosis engine 210, health center 208, or MIN register 228 whenever these components detect an error. As shown, at box 378 transaction information for the next transaction to be performed is obtained from hash table 188. Where there are a number of transactions to be acted upon, the next action may be selected using the priority scheme as described. At box 380 an inquiry is made as to whether the transaction has timed out, such as when the two minute delay has expired after a page is issued. If the transaction has not timed out in the logic flow loops back to box 378 to obtain the next transaction from hash table 188. Where the transaction has timed out, then at box 382 the question is asked as to whether the maximum number of retries for the transaction has occurred, as where an attempt to send a page to gateway server 196 has been retried twice. If the maximum number of retries has occurred, then at box 384 the transaction is deleted from hash table 188 and the logic falls through to box 386 where the inquiry is made as to whether or not the transaction was issued. If the transaction issued, then at box 388 a report "transaction timeout" is sent to web server 170 (FIG. 9*a*) via event generator 206 and a message is displayed as a SYSTEMS EXCEPTION REPORT in field 478 of the screen of FIG. 40, such message indicating that the transaction issued but received no response. The transaction result is saved at box 390 (FIG. 11*d*) in a transaction table in database 204. If, at box 386 the transaction was not issued, then at box 392 the report "transaction issue failed" is sent to web server 170 via event generator 206, with an appropriate message displayed in field 478 of the screen of FIG. 40. Alternately, a pop-up warning may be triggered at either of boxes 388 and 392. This failed transaction result is saved at box 394 in the transaction table. If, at box 382 the maximum number of retries has not occurred then at box 396 the "issued" status is set in the status field of the transaction in hash table 188, a counter indicating the number of retries is incremented by one and the time delay in the hash table for the page is reset to two minutes. At box 398 the page is reprocessed as shown in FIG. 11.

Figure 11E:
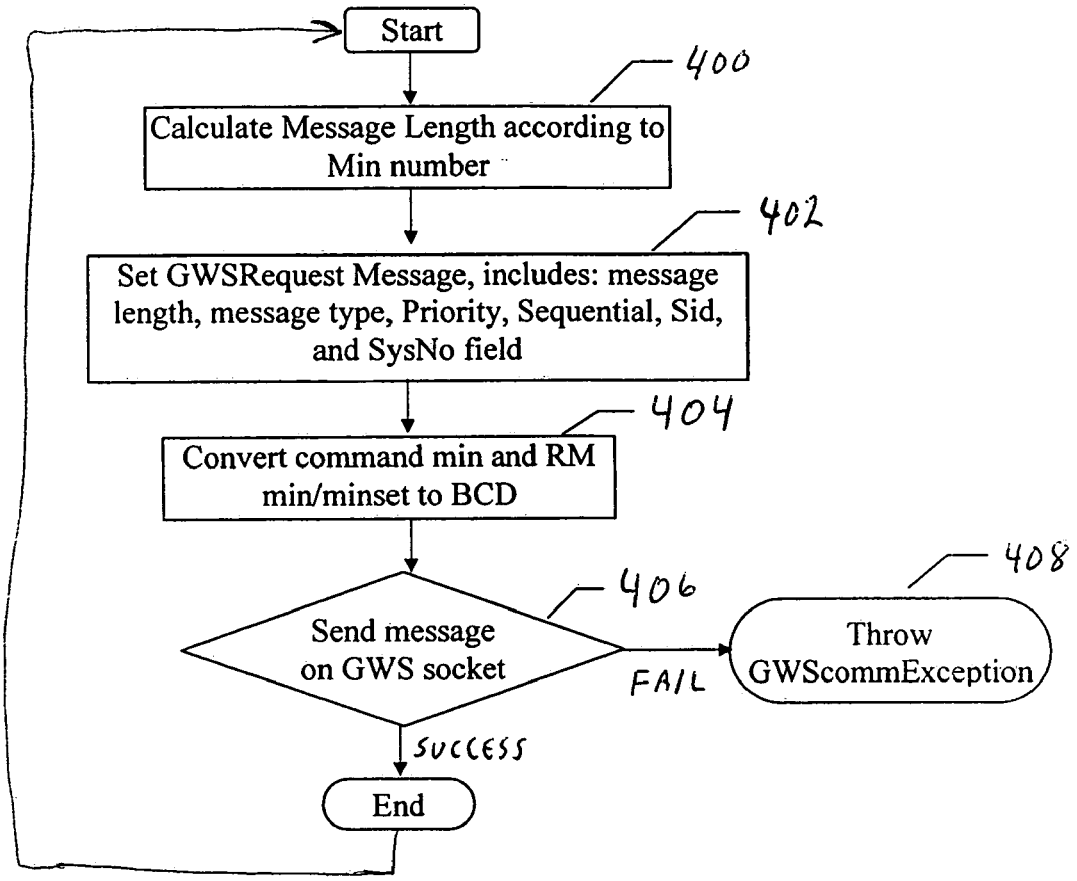
FIG. 11*e* is a flowchart of another of the processes initialized in the flowchart of FIG. 10.

FIG. 11*e* illustrates logic for a functional interface for the remote module server 172 to send pages and receive registrations to and from gateway server 196. Here, at box 400, a message length is calculated according to the message type, i.e. as different type messages may have different length, the length of the message is calculated and memory for the message allocated accordingly. At box 402 the gateway server request message is assembled in the allocated memory, and includes message length, message type, priority, sequential, SID and SYSNO field. Here, with respect to respective positions in fields of the message, priority=1 may represent a high priority level, while priority=0 may represents a low priority level. "Sequential" indicates whether the pages in a transaction are to be issued in sequence or not. Sequential=true may require the gateway server to keep the sequence of the pages in the MIN transaction of in order, while "sequential=false" does not. SID is the mobile switching center system identification number, and is used by the gateway server to construct and route outgoing packets. Thus, all pages in the MIN set for an area served by a common mobile switching center share the same SID. SYSNO defines the mobile switching center switch number, i.e. which service provider, and is also used by the gateway server to construct and route outgoing packets. All pages in the MIN set share the same SYSNO. At box 404 the command MIN and RM MIN/MINSET are converted to binary coded decimal format and at box 406 the query is made as to whether or not to send the page or transaction to the gateway server socket. If the answer is fail, then an exception is developed at box 408 and a corresponding message displayed in the SYSTEMS EXCEPTIONS REPORT field 478 of the screen of FIG. 40.

If the answer at box 406 is success, the page is sent to gateway server 196 and the program loops back to the beginning and runs in an endless loop.

Figure 11F:
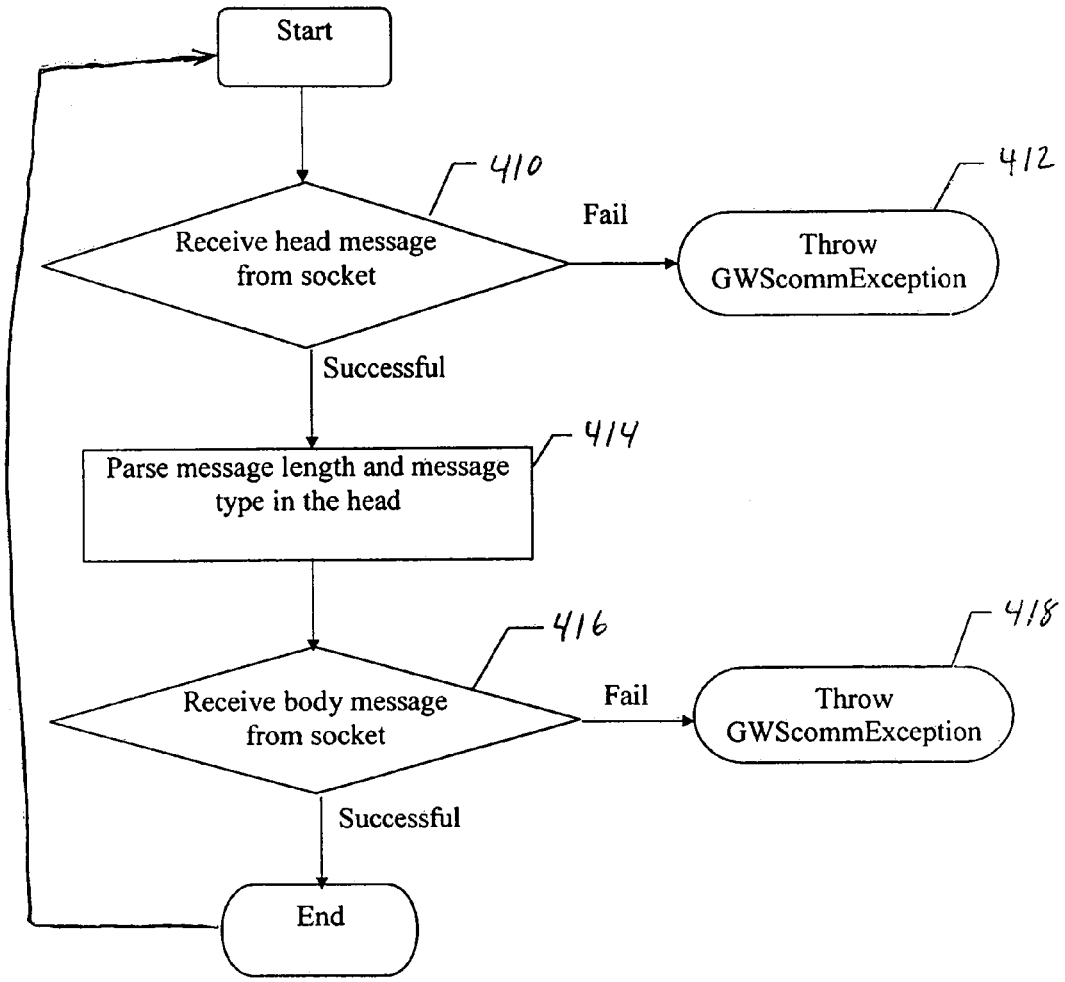
FIG. 11*f* is a flowchart of another of the processes initialized in the flowchart of FIG. 10.

FIG. 11*f* shows logic flow that develops error codes when one or more of a plurality of errors occur. These errors may include gateway internal errors such as buffer overflow, authentication failure, and others related to the gateway server. Other failures that develop error codes are a general modem error, sequence rejected due to an invalid MIN number, an invalid meter ID, an invalid meter number, a bad sequence, an excessive number of dial retries, an excessive number of modem retries, a connection failure, no TLDN allocated (no available modem) and an IS page failure. In the flowchart of FIG. 1 if, at box 410 the header message is received from the remote unit, and the question is asked as to whether reception of the message was successful or unsuccessful. If reception was unsuccessful (fail), then at box 412 a GWS COMM exception is developed, and notification is provided as described in field 478 the screen of FIG. 40 with respect to this error. If reception was successful, then at box 414 the message length and type are read. At box 416 the question is asked whether the body of the message was received, and if not then at box 418 a GWS COMM exception is developed and displayed in field 478 the screen of FIG. 40, and notification is provided as a status indication in one of the indicators 476 (the screen of FIG. 38 or one of the indicators 470 of the screen of FIG. 36). If reception of the body is successful, then the program exits and runs again from the beginning.

Figure 11G:
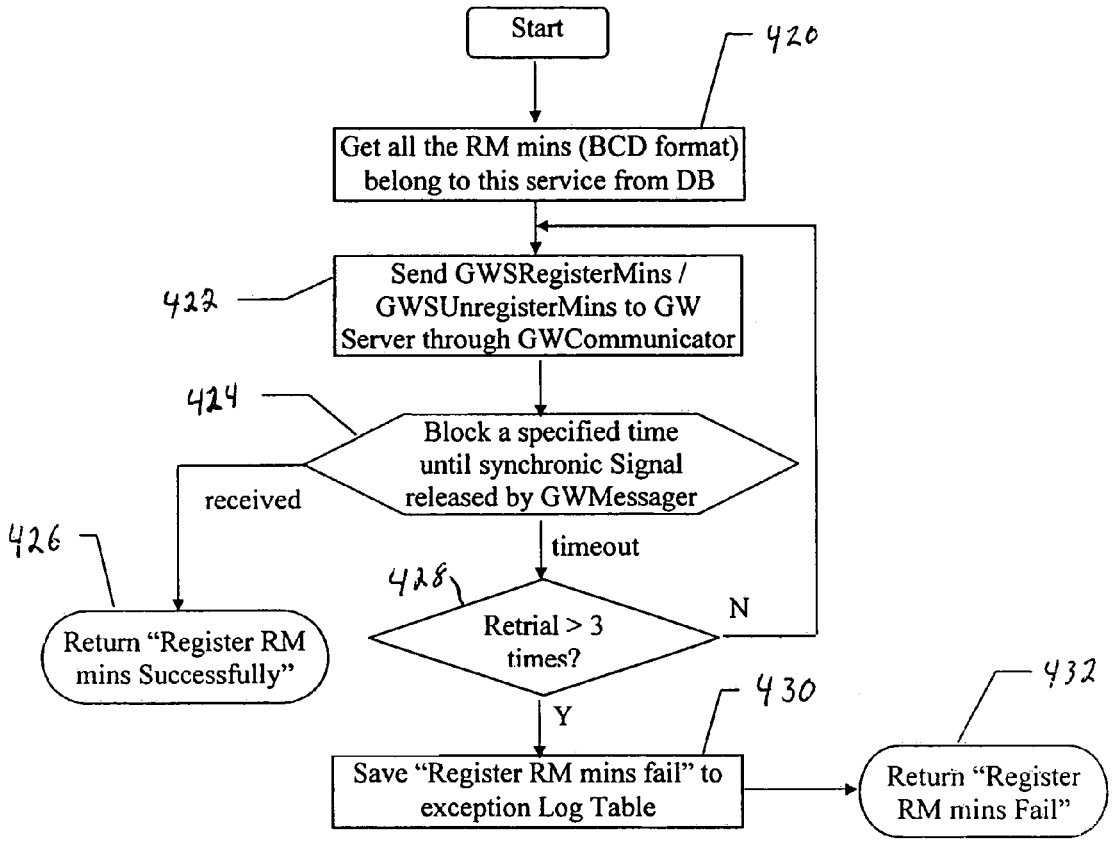
FIG. 11*g* is a flowchart showing processing in the data center of remote unit MIN numbers.

FIG. 11*g* is a flowchart representative of logic flow of remote object calling for web server 170 to register or unregister a single or a batch of MINs in the gateway server. Accordingly, at box 420 all the remote MINs, in BCD format, that belong to the service, such as the automatic meter reading system, are retrieved from database 204 and buffered in MIN register 228. At box 422 the MIN numbers are sent to gateway server 196 through gateway server communicator 194. To remove the MIN numbers from the gateway server, the same path is used as when a new MIN number is registered. At box 424 a wait period is initiated in order to receive a signal by gateway server messenger 212, such signal indicating that the gateway server register MIN ack signal was received. When this signal is received, at box 426 the message "register RM MINS successfully" is returned, meaning that the MIN numbers were successfully registered in gateway server 196. If the ack message is not received then the logic falls through to box 428 where a retry occurs, this retry looping back to box 422. After three retries, the logic falls through from box 428 to box 430 where the error message "register RM mins fail" is stored in an exception log table, and at box 432 "register RM mins fail" is returned and displayed in field 478 of the screen of FIG. 40.

As stated, my system may be easily adapted to multiple applications in addition to automated meter reading systems simply by connecting my circuit board 38 including a CELLEMETRY™ radio, microprocessor 50 with appropriate software configuration, and in some instances a GPS receiver, to a sensor or switch. Some of such applications include automatic surveillance systems of all types where an individual is not actually watching a monitored area, personal security and location devices, control and monitoring of systems such as capacitor banks for power factor balancing, quickly determining areas affected by electrical power outages and others, as should be apparent to one skilled in the arts from my disclosure.

While CELLEMETRY™ is disclosed herein as being a preferred way of communicating between meters and other devices, and a data center via the Internet, other wireless forms of transmission are workable. For instance, other systems of voice and/or data communications channels may be used, such as cellular digital packet data (CDPD), code division multiple access (CDMA) and time division/domain multiple access (TDMA), which use packetized systems for data communications. In addition, another data transmission system similar to CELLEMETRY™ is used by AERIS™, and which also may be used in Applicant's system. Further, satellite communications systems are available for use in Applicant's system, such as ORBSCOM® and the global system for mobile communications (GSM). In these systems, the appropriate communications radio would substitute for the CELLEMETRY™ radio.

A series of screen images (screen shots) will now be described that generally illustrate by way of example operation of a user interface of Applicant's invention. These screens should be taken by way of example only, it being understood that a skilled programmer would know how various sequences of screens would be arranged and what fields should be included in each screen from the foregoing disclosure. Further, it should be understood that for each of the products, i.e a snow melter system, an automated meter reading system, a surveillance system, etc, the arrangements of icons and fields within screens for different products are generally very similar. For instance, a STATUS page would be similar for all the products, with fields similarly labeled, and wherever possible labeled similarly or identically, with these similar or identical fields being to the extent possible in the same locations on the screen between screens for different products.

In general, a customer user selects a product associated with that company by selecting with a pointing device the appropriate radio button. Here, the radio buttons AMR-G, AMR-W and AMR-E refer to automatic gas, water and electric meter reading systems, respectively, while "melter" refers to a snow melter system as disclosed in Applicant's copending patent application Ser. No. 10/613,430, filed Jul. 3, 2003. CCU refers to the capacitor coupling application, and RECLOSER refers to the electrical reclosing system described above. It is to be noted that the products are not necessarily related to a particular utility or customer user, rather, several customer companies may use the automatic meter reading products, surveillance products and/or other products. With respect to other of Applicant's products, CIDS refers to a surveillance system product and GPS refers to a system wherein mobile assets outfitted with GPS units may be accessed, after which particular mobile units may be located and status parameters obtained.

The highest level users, designated for this application as system operators, administrators and users, manage the highest level of software and database operations, and add and delete customer administrators and users. In addition, other system maintenance personnel maintain computers, computer servers and networks associated with the system, in addition to monitoring the network associated with the CELLEMETRY™ gateway.

Lower level customer users may be utility companies, railroad companies and the like. For example, a system administrator or other system operator may add or delete customers such as water, electric and gas utility companies, railroad companies, etc. In general, it is contemplated that that the software and computer system be located at and operated from a central location, although in some instances a diversified system may easily be implemented, for example to implement redundancy, efficiency, to have a de-centralized system less vulnerable to terrorist or "software hack" attacks, or any combination of these and other factors.

Figure 12:
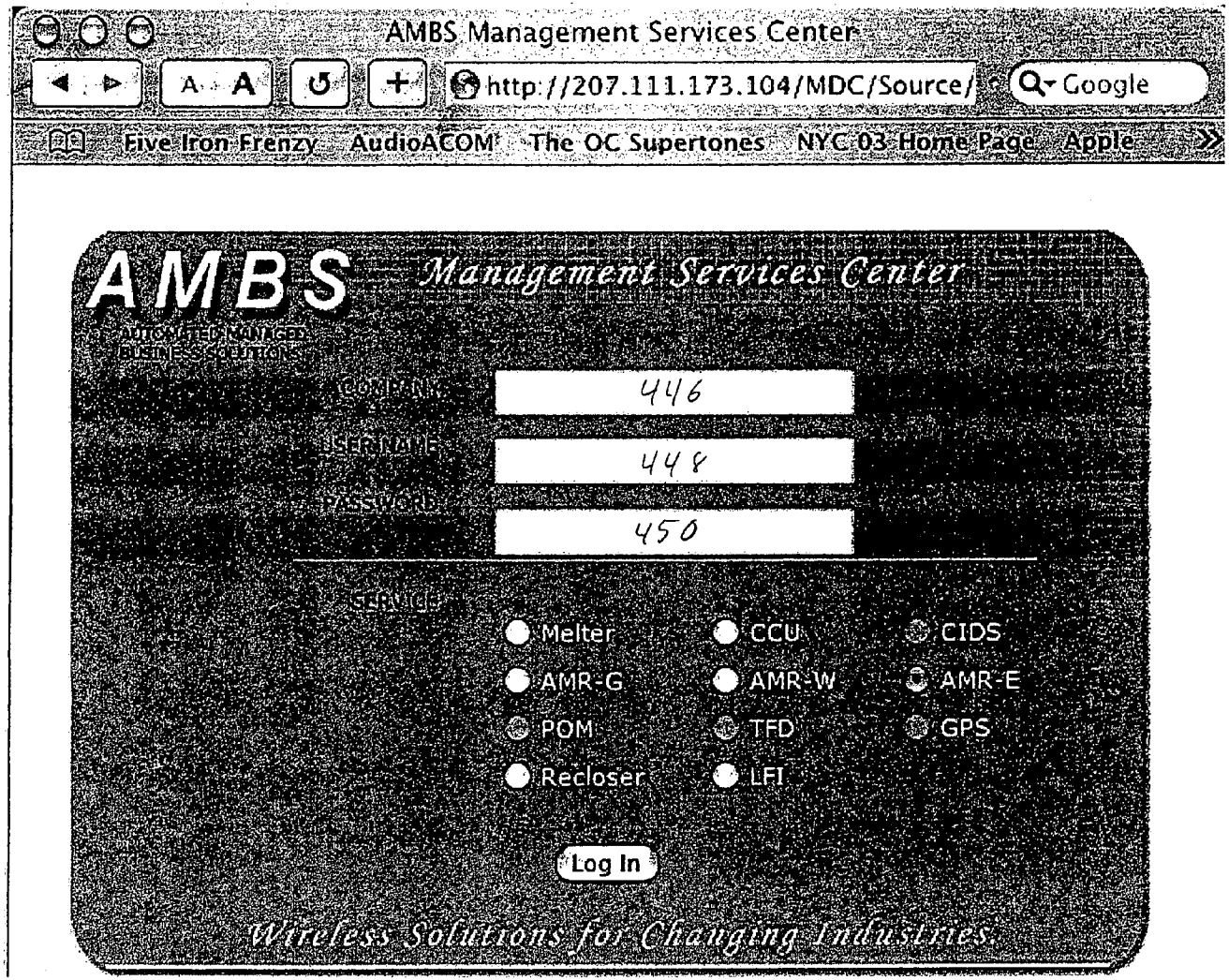
FIG. 12 is an image of a log-in screen of my invention.

Initially, a system user, who as stated may be a system administrator or the like, may access the system from a general purpose computer having loaded therein any conventional browser such as Internet Explorer™, Netscape™, Mozilla™ or other Internet browsers. Here, the URL for the system is entered into the browser (or a shortcut selected), and the system user is presented with a login screen that may be configured as shown in FIG. 12. This login screen is the same for both system users and customer users. Here, where the user is a system user wishing to manage aspects of a customer, the system company name, user name and password fields 446, 448, 450, respectively, are provided by the system user, after which the system user is presented with the screen of FIG. 13. Where the user is a customer, the appropriate radio button or buttons are selected to indicate which product the customer wishes to manage, as will be further explained.

Figure 13:
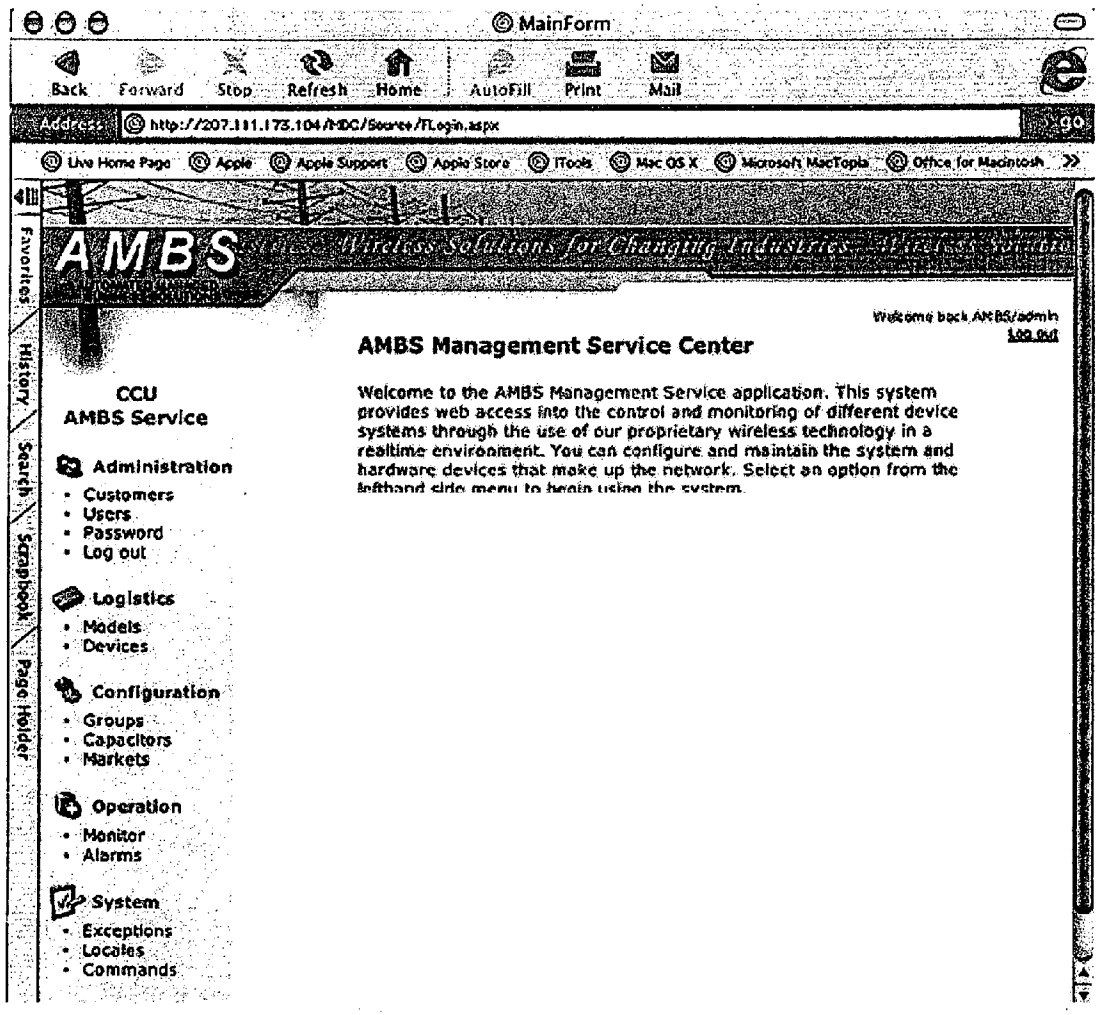

As seen at the left of the screen of FIG. 13, there are different catagories labeled ADMINISTRATION, LOGISTICS, CONFIGURATION, OPERATION AND SYSTEM, these catagories related to systems operations and accessible by various users according to their assigned privileges. Under each of these catagories are listed sub-catagories related to the category. To operate Applicant's software, a user selects a category and then a sub-category to bring up the relevant screens.

Figure 14A:
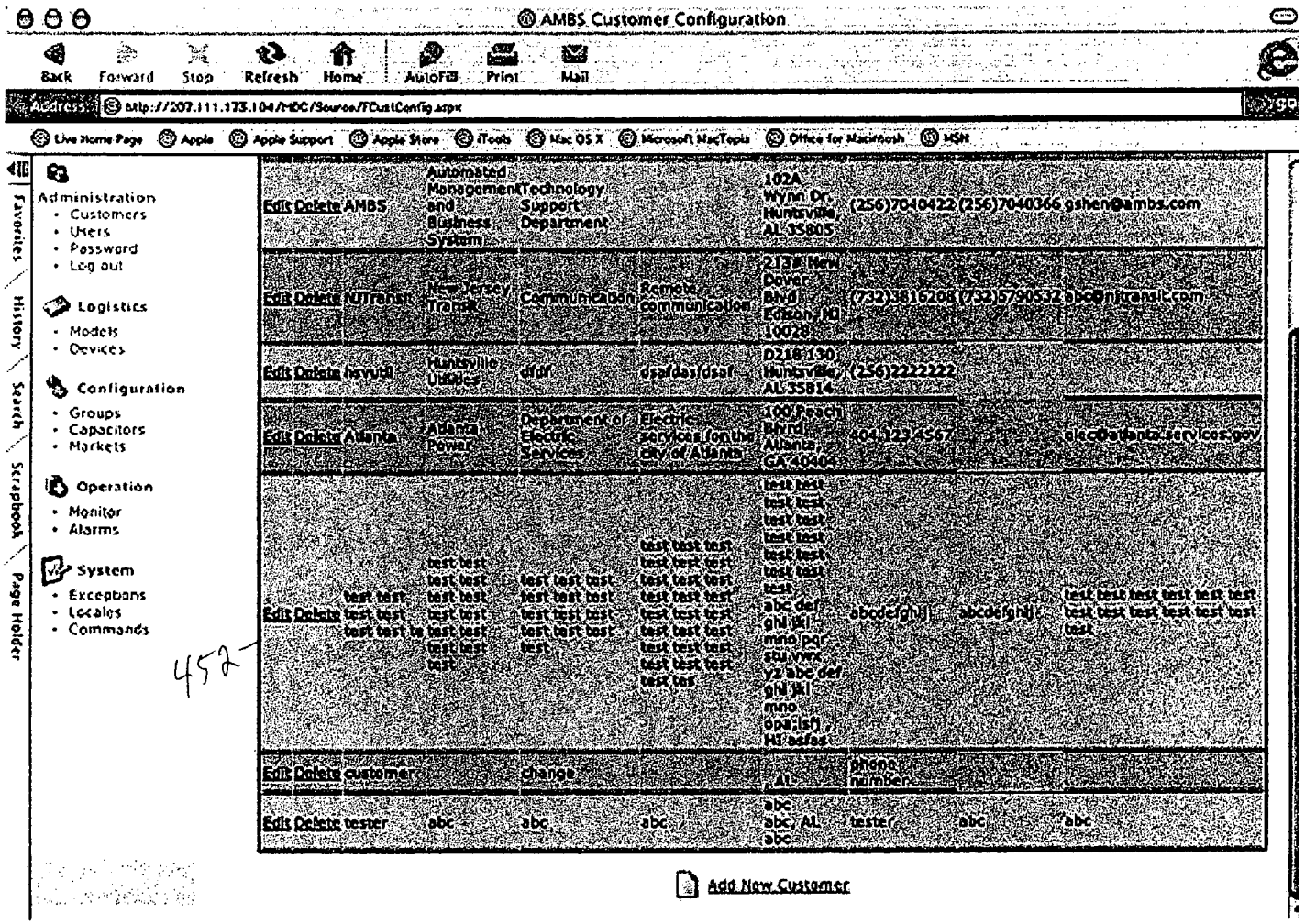
FIG. 14*a* is an image of a continuation of the screen of FIG. 14.
Figure 15:
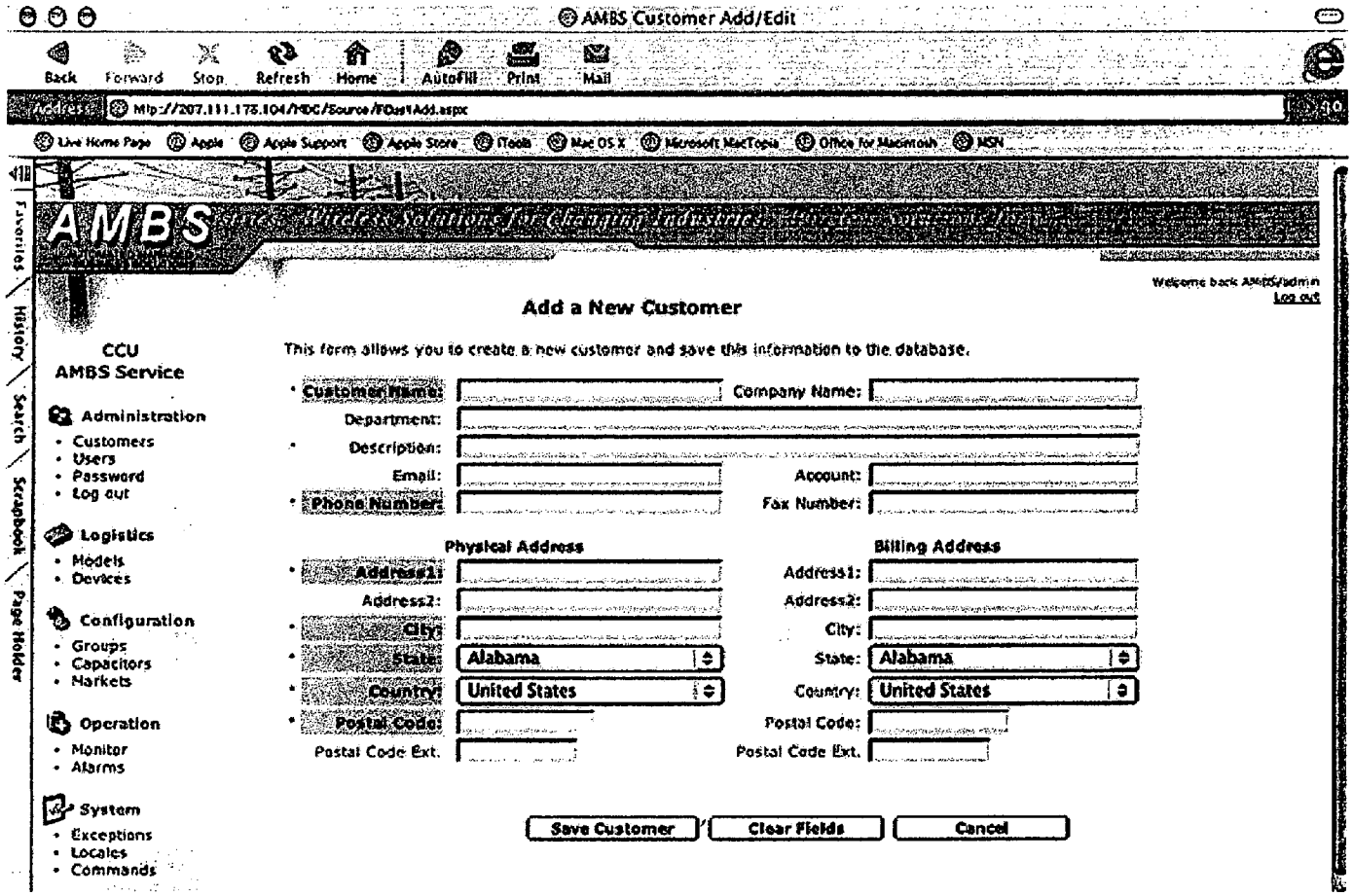
FIG. 15 is an image of a screen accessible from the screen of FIG. 14*a*.
Figure 16:
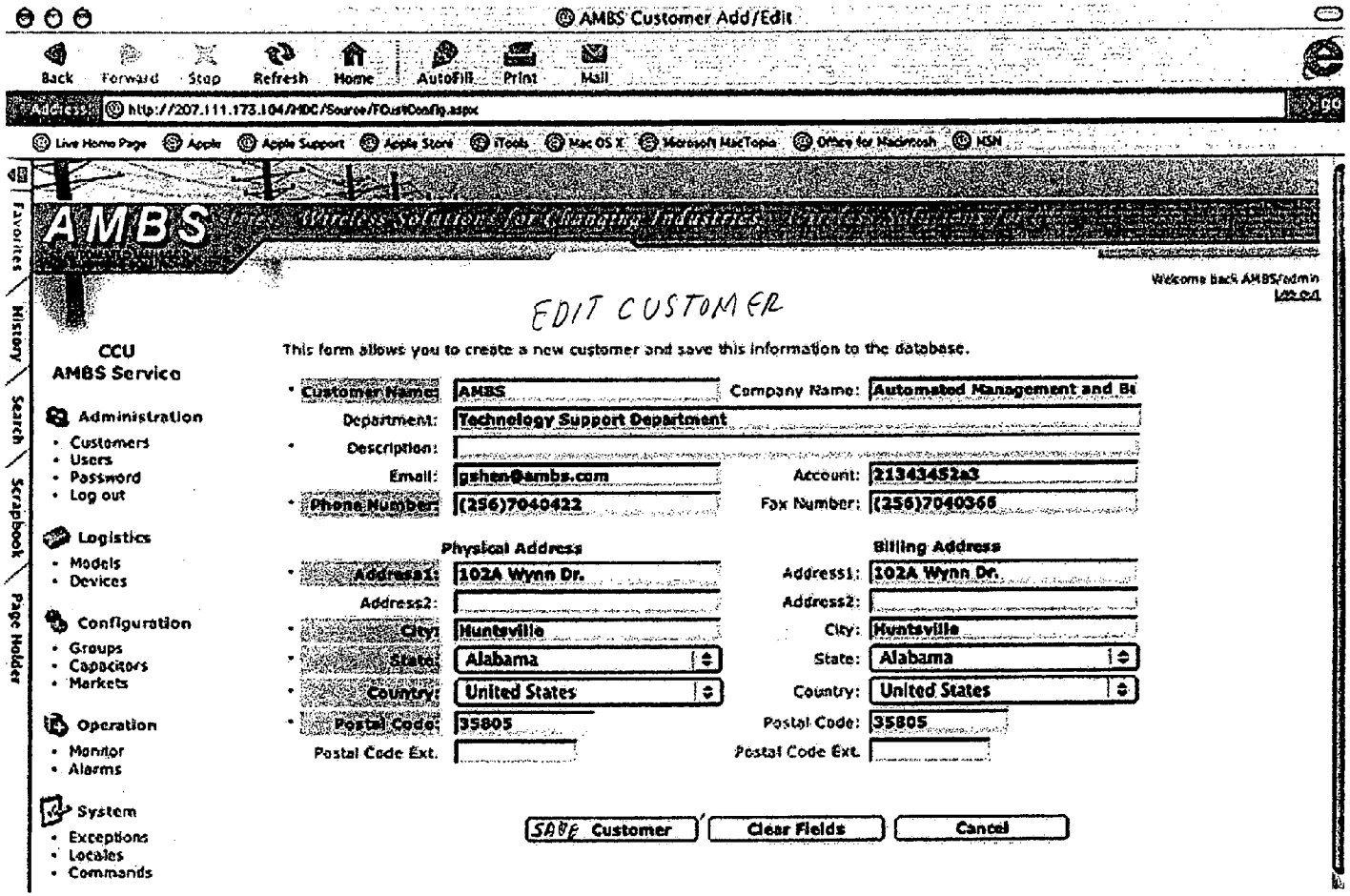
FIG. 16 is an image of a screen accessible from the screen of FIGS. 14 and 14*a*.
Figure 16:
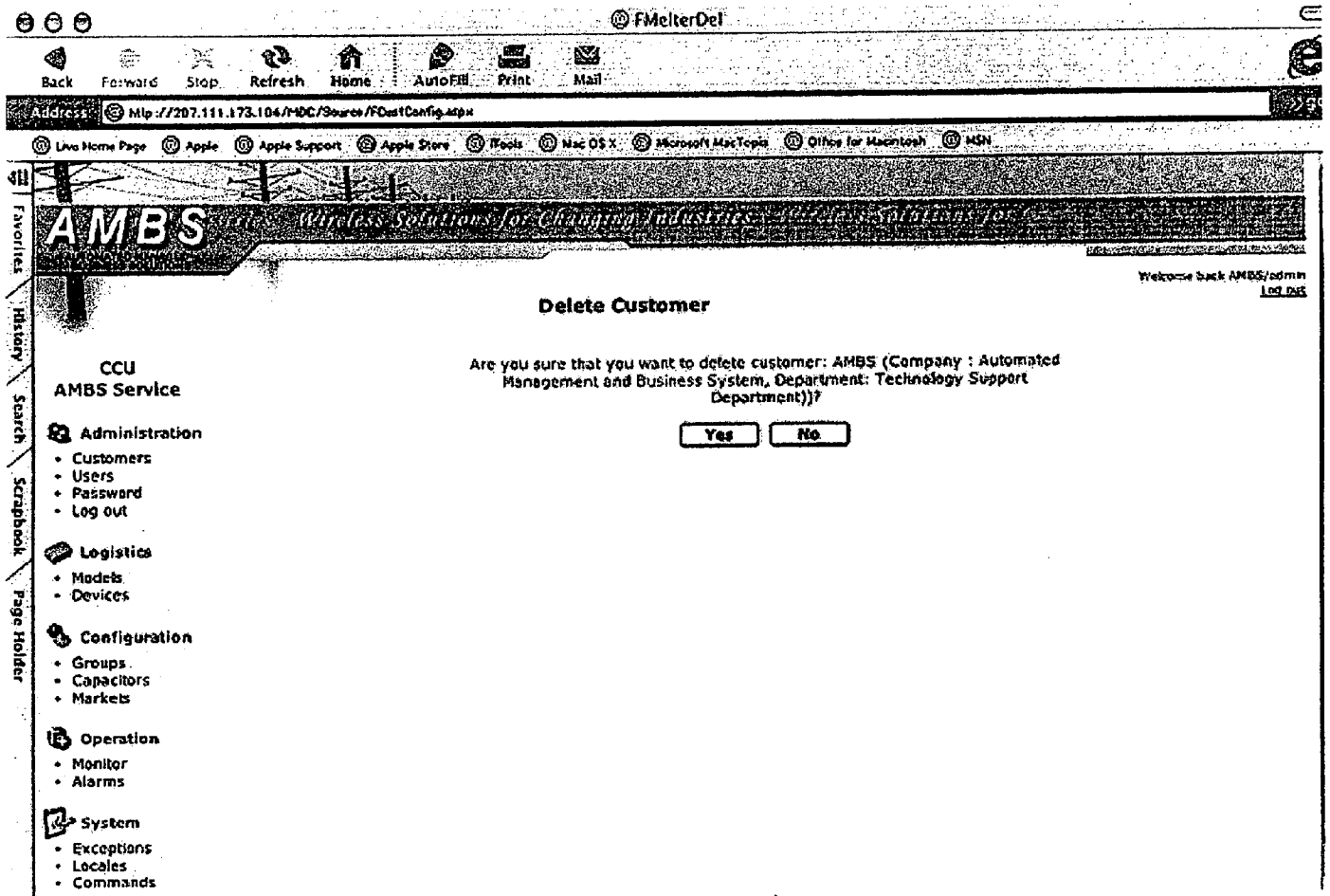
Figure 17:
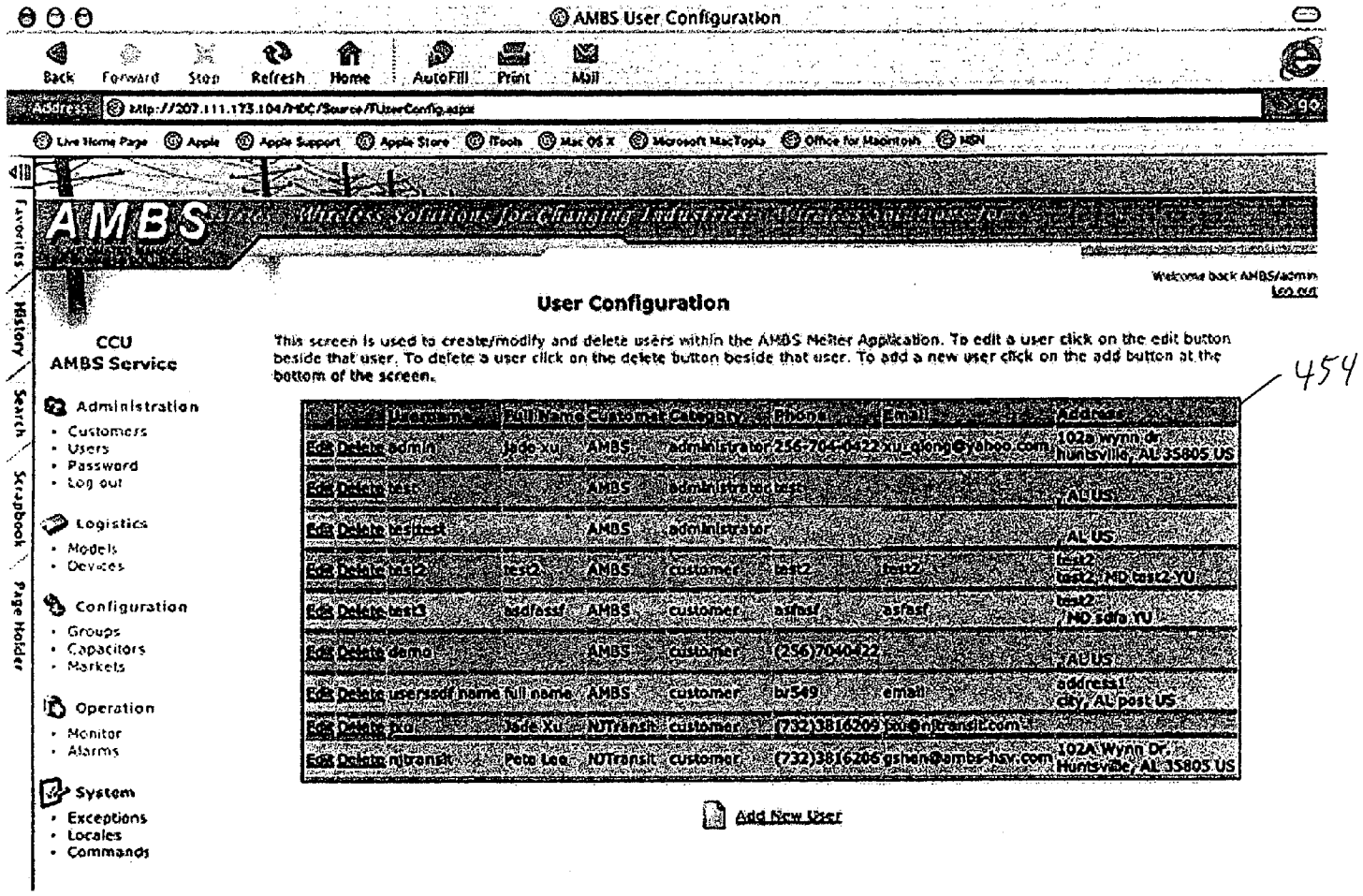
FIG. 17 is an image of a screen accessible from the screen of FIG. 13.
Figure 18:
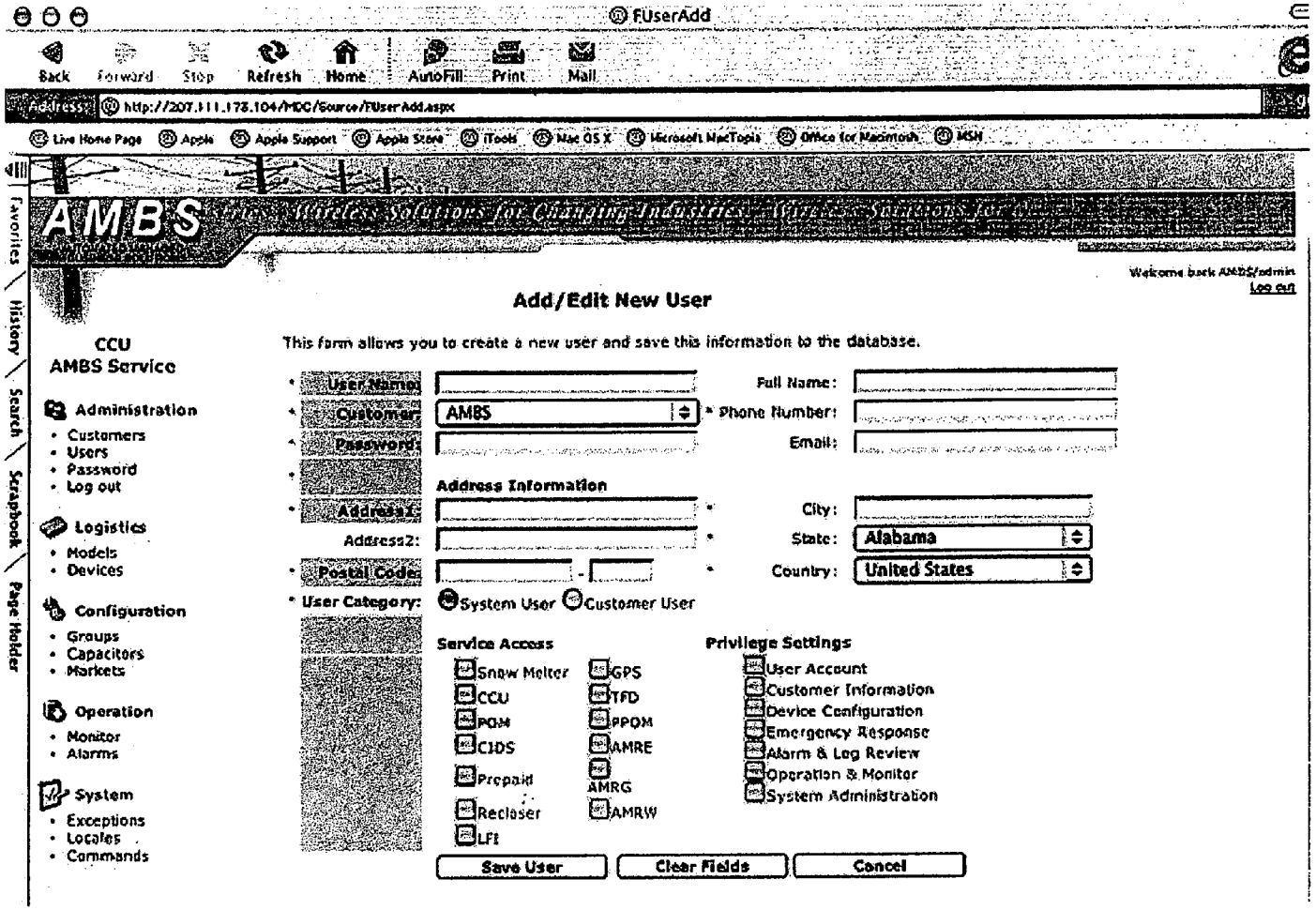
FIG. 18 is an image of a screen accessible from the screen of FIG. 17.

With respect to a system user, to add, delete or modify customer configurations, on screen 13 the system user selects ADMINISTRATION, CUSTOMERS, after which the screen of FIG. 14 is presented. In this screen, a user company may be selected for editing from customer list field 452 in the center of the screen, or a new customer may be added by selecting an ADD CUSTOMER button or field (similar to the ADD NEW USER icon of FIG. 17) that is located at the bottom of field 452, and which may be accessed by scrolling field 452 downward. Where the system user elects to add a new customer by selecting the ADD CUSTOMER button, the screen of FIG. 15 is presented to the system user. Here, as shown, relevant fields for customer information are filled in, and the SAVE CUSTOMER button is selected, saving the customer information in database 204 (FIG. 9*a*, 9*b*). Where, at screen 14, the system user has selected a customer user from the customer list for editing, as by selecting EDIT of field 452, the screen of FIG. 16 is presented, and the system user may make the appropriate corrections. In some instances, the customer user would have access to the screen of FIG. 16 in order to make their own editing corrections. Where a customer is to be deleted from the system, the system user would select DELETE from the field 452 (FIG. 14), after which the system user would be presented with a screen such as the screen of FIG. 16*a* requesting confirmation of deletion of that customer, along with YES/NO buttons.

Figure 19:
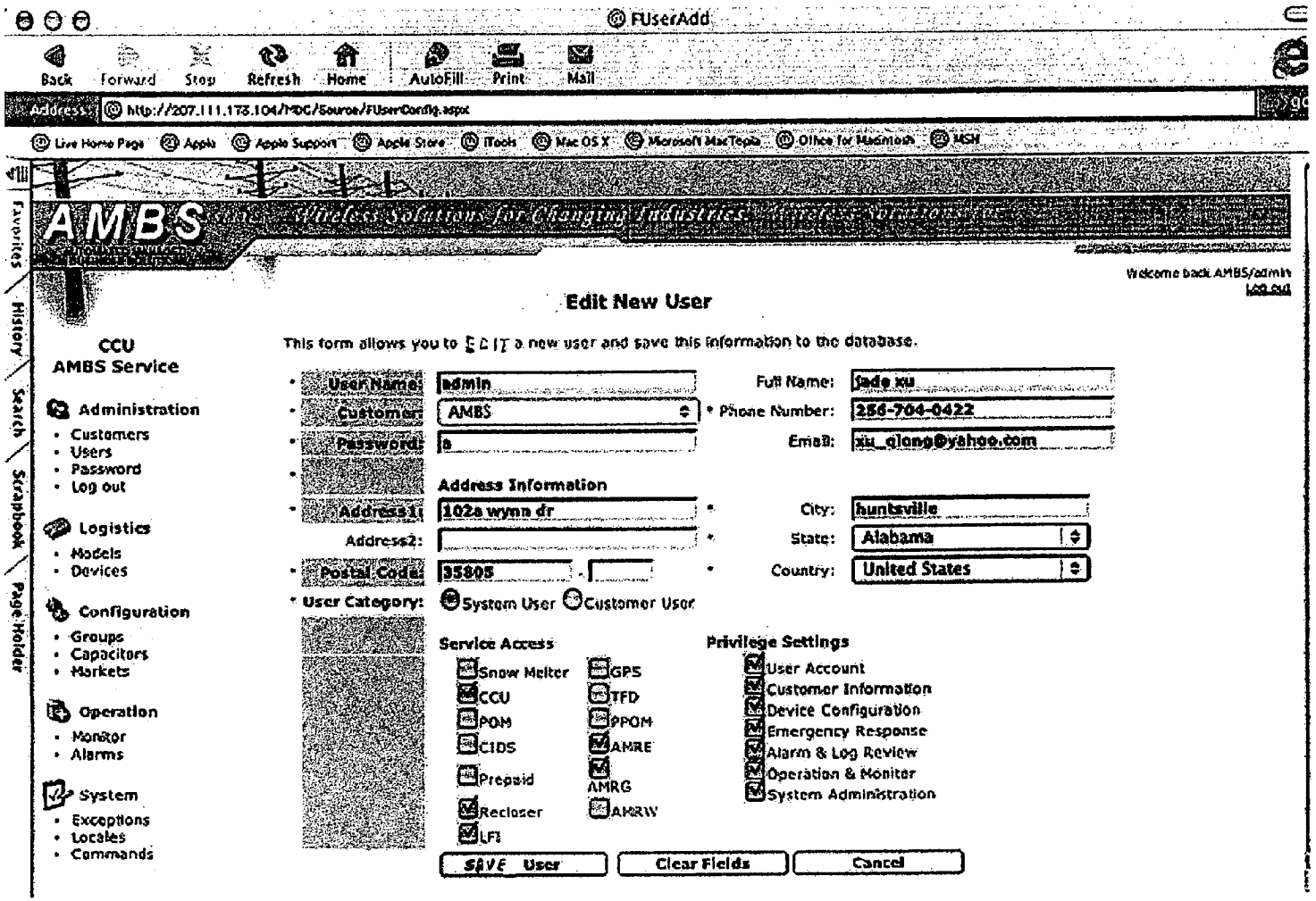
FIG. 19 is an image of a screen accessible from the screen of FIG. 17.

In general, system users add new customers and provide logistics and maintenance support for the system. Customer users may be given privileges so they may add or delete their own administrative customer users and other customer users, in addition to adding information to newly installed remote unit devices and new models of remote units. Thus, both system users and customer users may have access to screens under the selection of ADMINISTRATION, USERS, which brings up the screen of FIG. 17. Here, user configuration access is provided in field 454 so that individual users and their privilege settings may be entered. Where a new user is to be added, the field ADD NEW USER is selected to bring up the screen of FIG. 18. Here, appropriate fields for the new user are filled in, and the appropriate SERVICE ACCESS and PRIVILEGE SETTINGS boxes are checked. This defines the user in the system as to which customer operations the user may be involved with, i.e. electrical meter reading, snow melter, and other systems. The privilege settings define a level of operation within the customer operations that the new user has access to, i.e. a system administrator, an emergency responder, and other such levels of operation, as should be apparent to one skilled in the art. After the information is entered and appropriate service access and privilege settings set, the button SAVE USER is selected to save that user's information to the database. Where EDIT is selected from field 454 of FIG. 17, the screen of FIG. 19 is presented. Here, the user information may be altered, as by placing a cursor in the appropriate field to be changed and deleting the existing information and adding the new information. In addition, service access and privilege settings may also be changed. After editing is complete, the SAVE USER button is selected. Where the users to be deleted, DELETE is selected in field 454 of FIG. 17 to bring up a DELETE USER confirmation screen similar to the screen of FIG. 16*a*.

Figure 20:
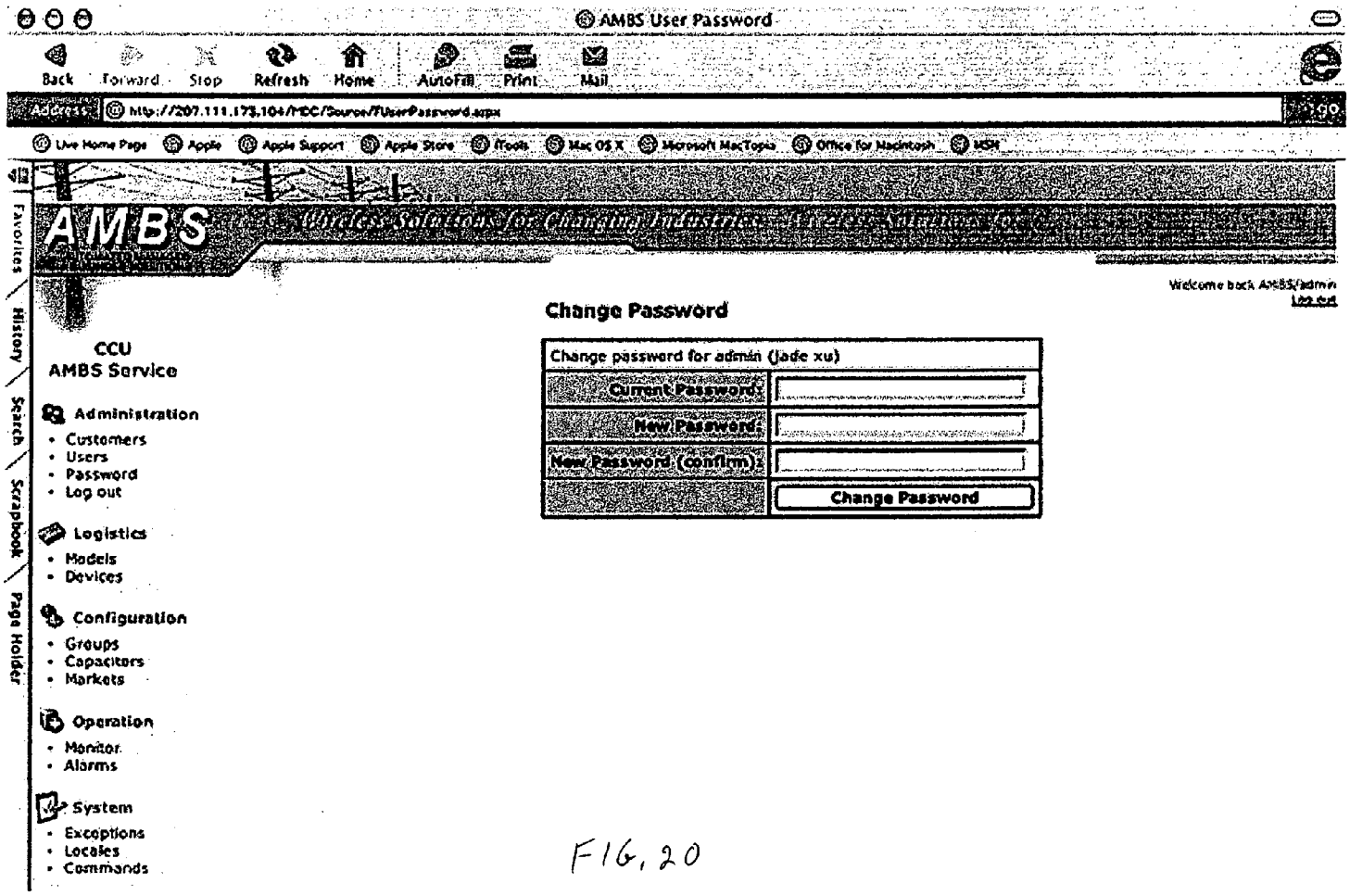
FIG. 20 is an image of a screen accessible from the screen of FIG. 13.

FIG. 20 shows a password screen presented when ADMINISTRATION, PASSWORD is selected. Here, passwords maybe changed by system users, customer users or both.

Figure 21:
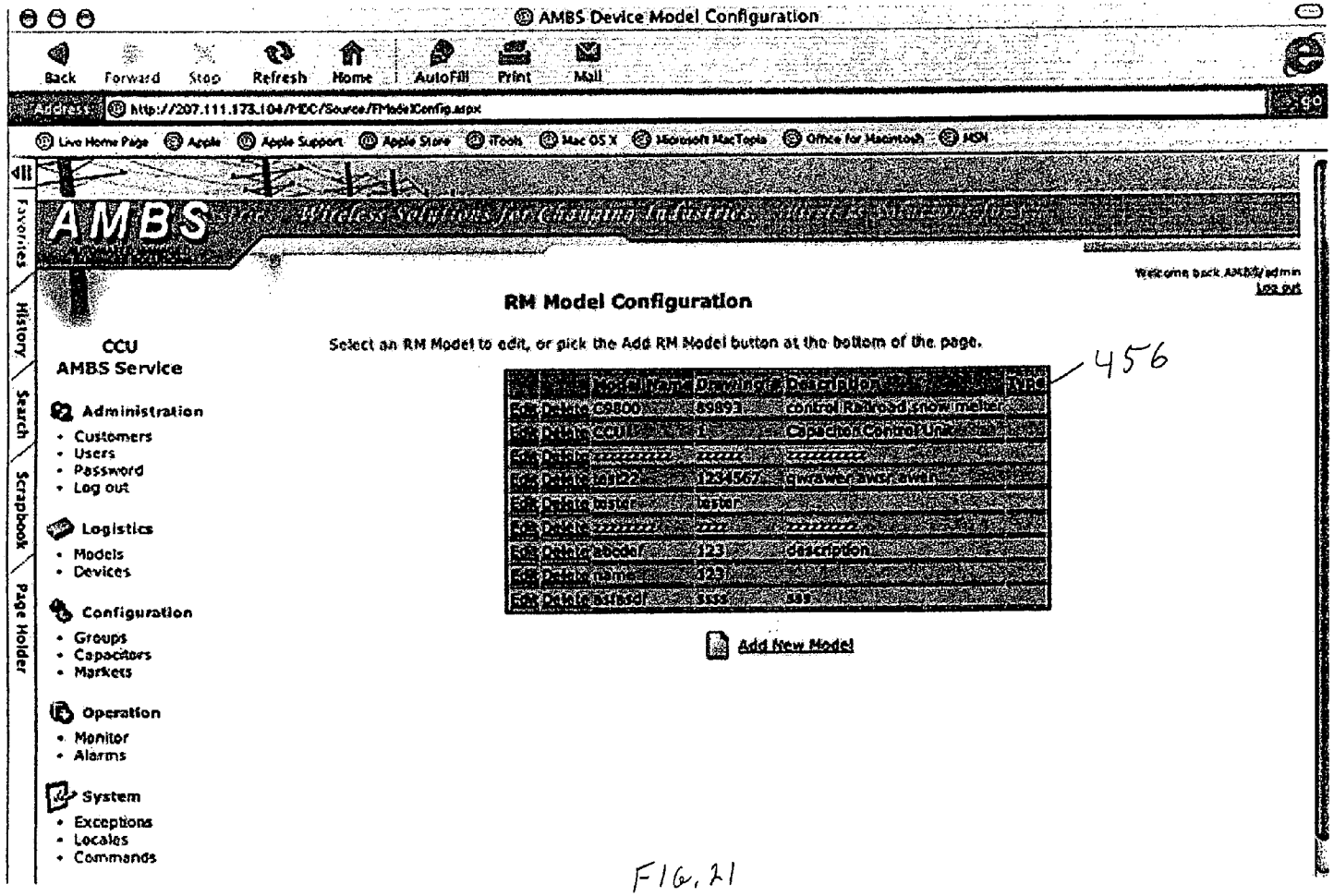
FIG. 21 is an image of a screen accessible from the screen of FIG. 13.

FIG. 21 shows a screen presented when LOGISTICS, MODELS of the screen of FIG. 13 is selected. Here, configuration of particular models of remote units, such as particular models of snow melter remote units, reclosers, and others may be added, edited or deleted from the system. A list of current remote module models in the system is shown in a field 456. This screen is generally used for maintenance and logistics, and is basically a list of remote unit models as applied to the various applications, and provides access to engineering drawings of the remote units and a brief description of its function.

Figure 22:
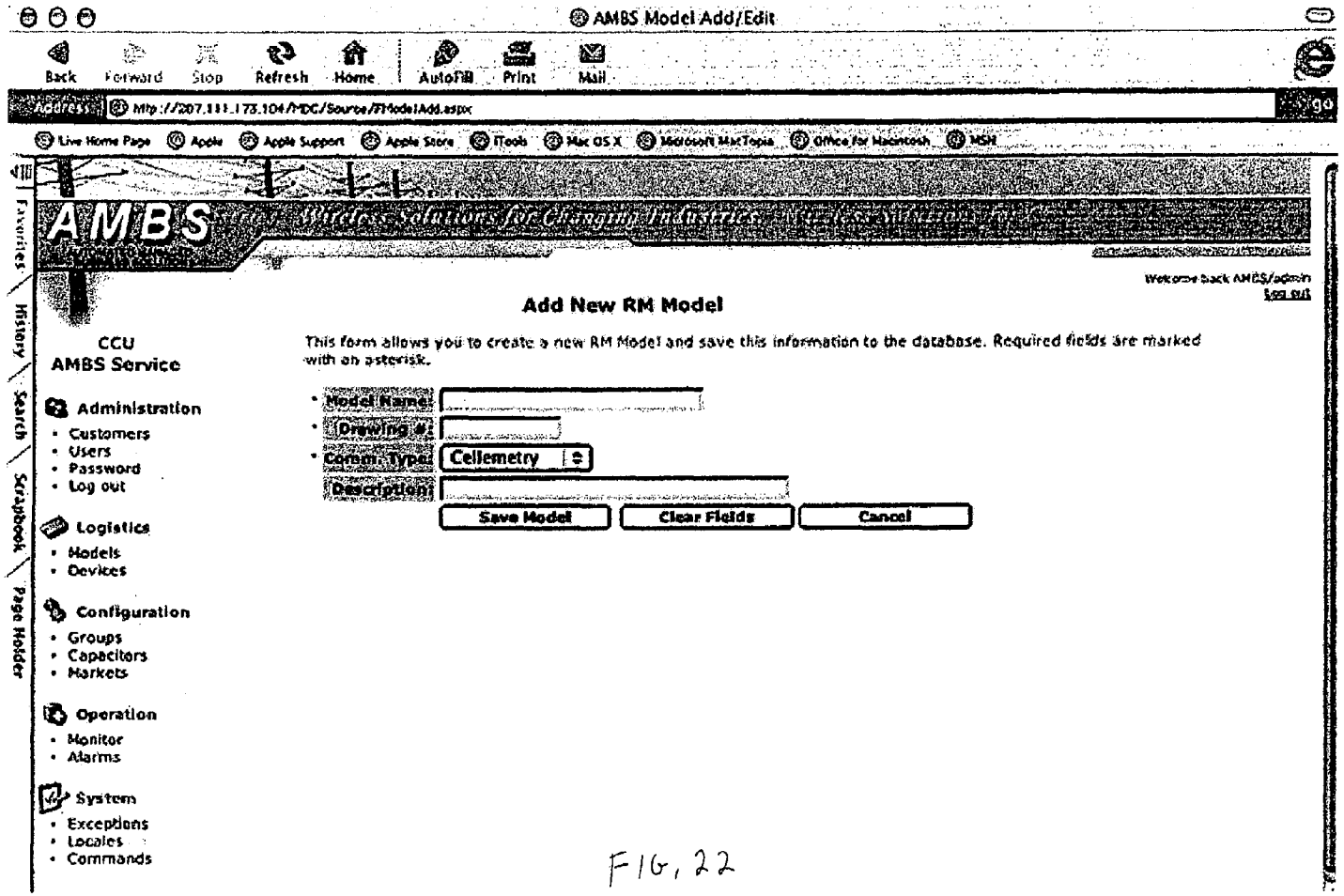
FIG. 22 is an image of a screen accessible from the screen of FIG. 21.
Figure 23:
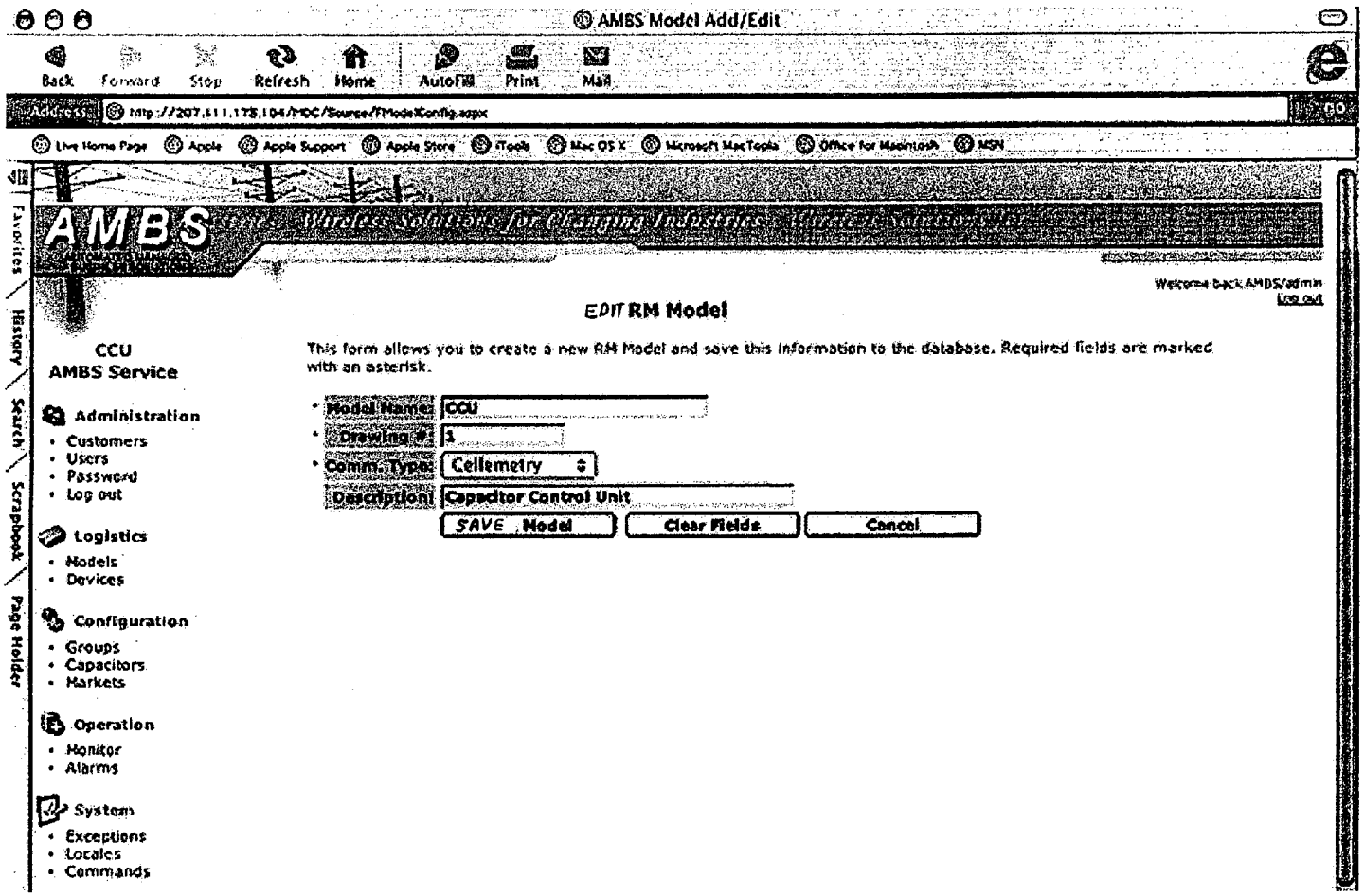
FIG. 23 is an image of a screen accessible from the screen of FIG. 21.

When ADD NEW MODEL is selected, the screen of FIG. 22 is presented. Here, the new remote module configuration data is added, and the SAVE MODEL button is selected to save the configuration data to the database. Where EDIT is selected from field 456 of FIG. 21, the screen of FIG. 23 is presented, where the current information for the selected remote module model may be changed. A model may be deleted by selecting DELETE in field 456 of FIG. 21, presenting a confirmation screen similar to that shown in FIG. 16*a*.

Figure 24:
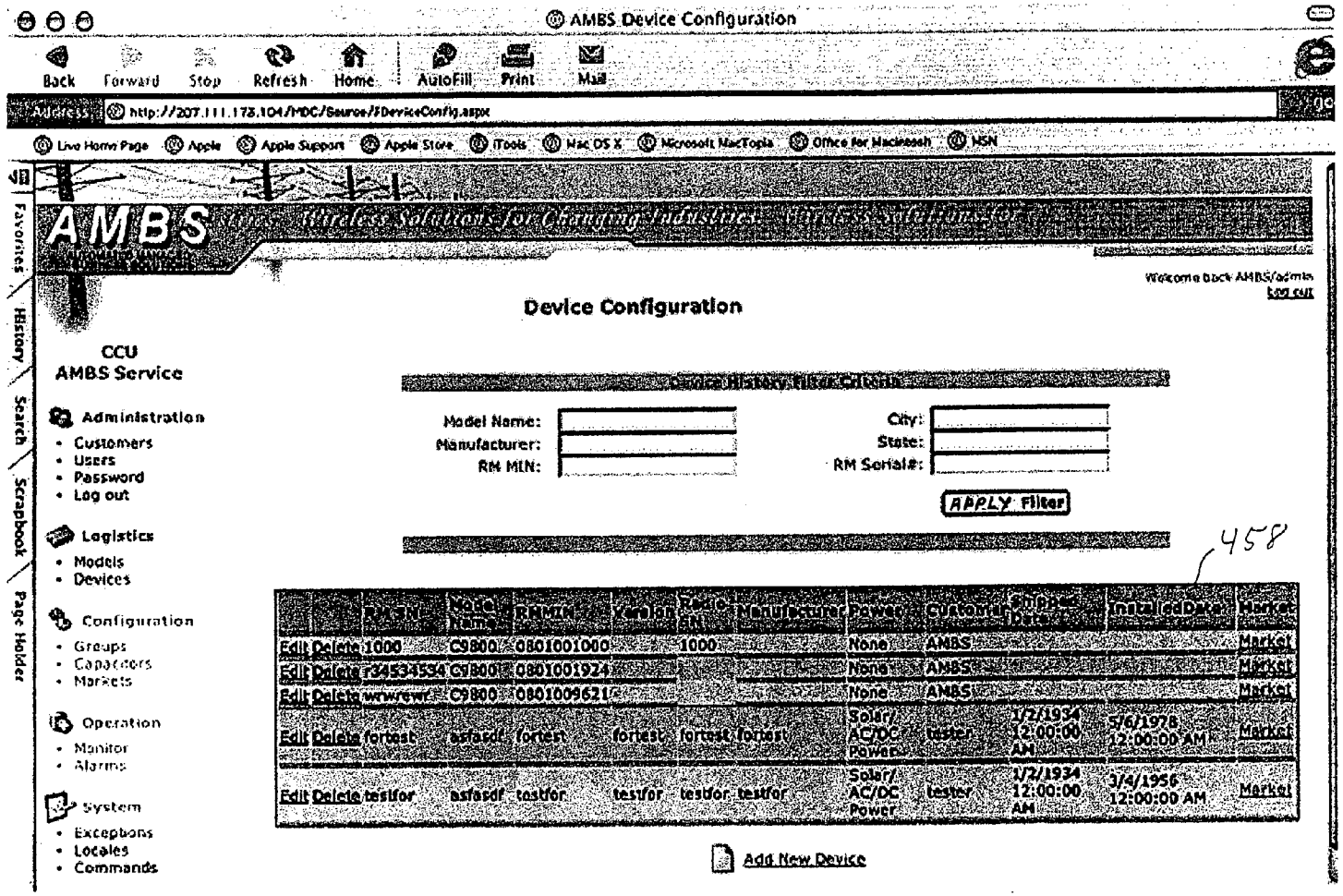
FIG. 24 is an image of a screen accessible from the screen of FIG. 13.
Figure 25:
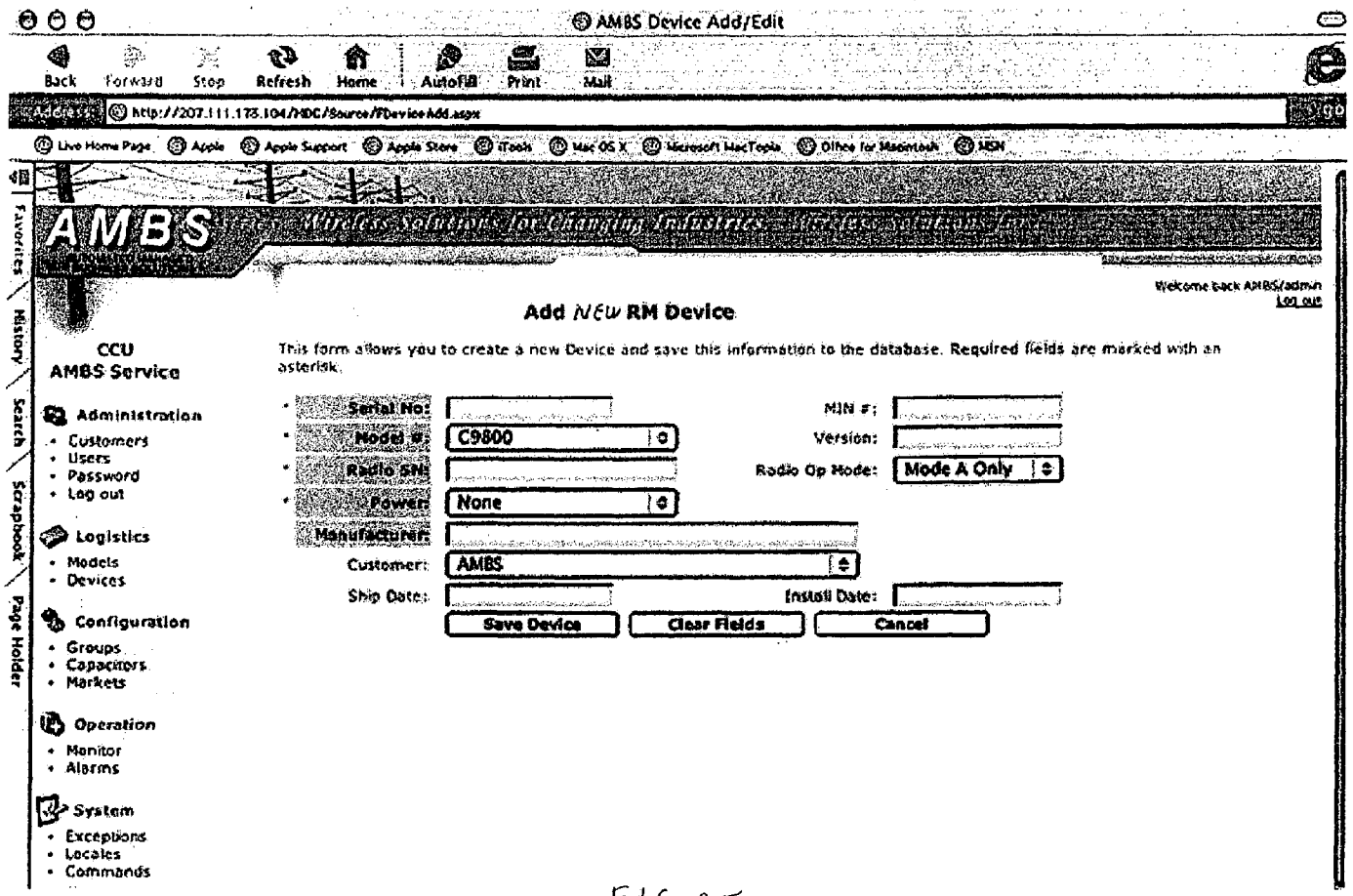
FIG. 25 is an image of a screen accessible from the screen of FIG. 24.
Figure 26:
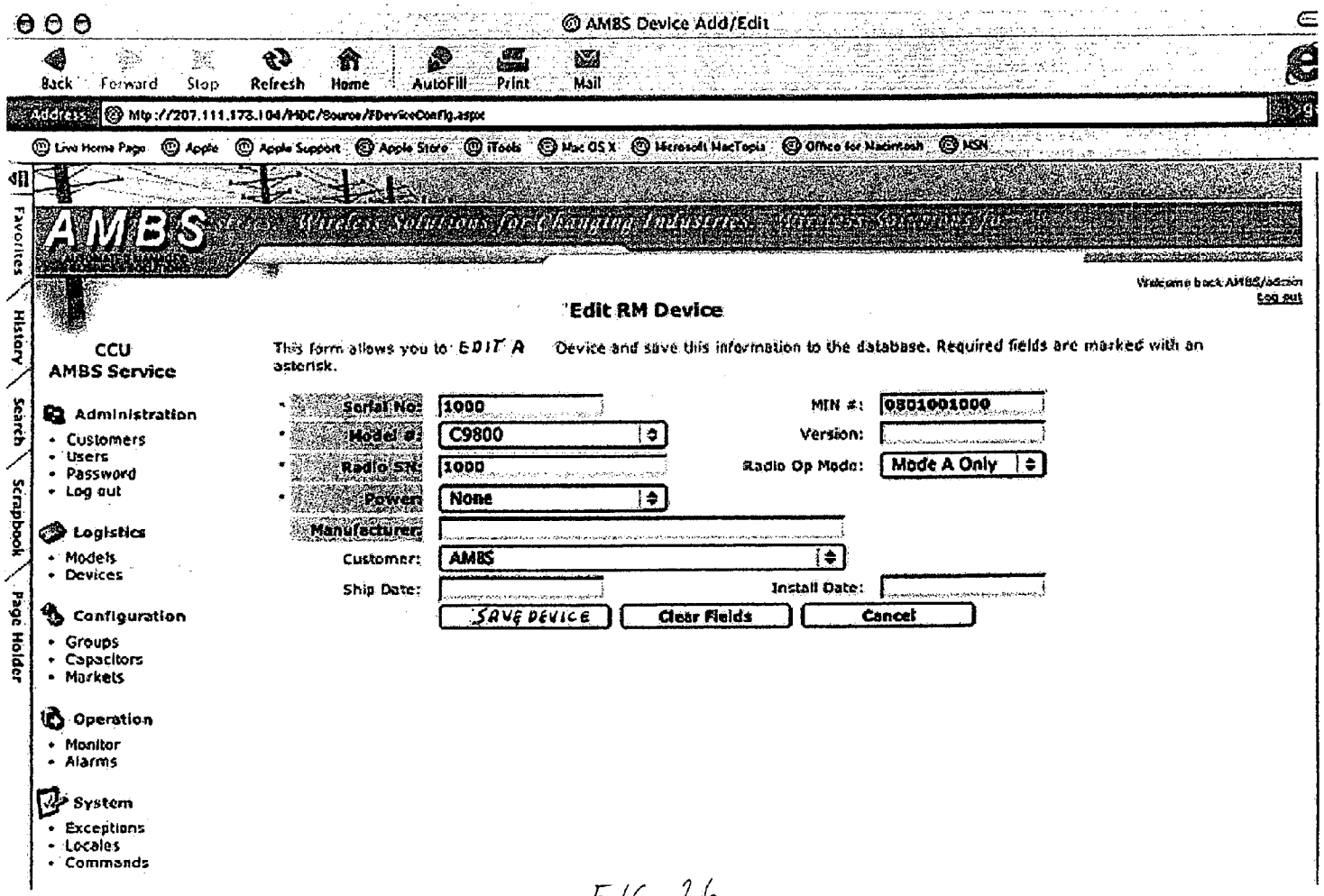
FIG. 26 is an image of a screen accessible from the screen of FIG. 24.

FIG. 24 is a screen that is presented when LOGISTICS, DEVICES of the screen of FIG. 13 is selected. This screen is used to enter device configuration data as well as show a list in field 458 of current device configurations. As shown, this data includes MIN numbers of fielded remote modules, along with serial numbers of the radios and remote units. In addition, filters are provided to allow a user to search for specific revision numbers of devices, specific configurations of remote units, model numbers and other parameters. Below field 458 of FIG. 24 is a small field labeled ADD NEW DEVICE. When selected, this field brings up the screen of FIG. 25, where a user enters information related to the new device. Such information may be a serial number of the device, a radio serial number, MIN number of the device and version of the device. After the information for the new device is entered, it is saved by selecting the button labeled SAVE DEVICE. Where, in field 458 of the screen of FIG. 24, EDIT is selected for a particular device in the list, the screen of FIG. 26 is presented to the user. In this screen, information for the selected device may be edited, as by selecting a field to be edited and changing the information therein. After editing is complete, the SAVE DEVICE button is selected to save the information to the database.

Where a device is to be deleted, the DELETE selection for that device is selected in field 458 of the screen of FIG. 24. This brings up a confirmation screen similar to the screen of FIG. 16*a* requiring the user to make a YES/NO confirmation of the deletion.

Figure 27:
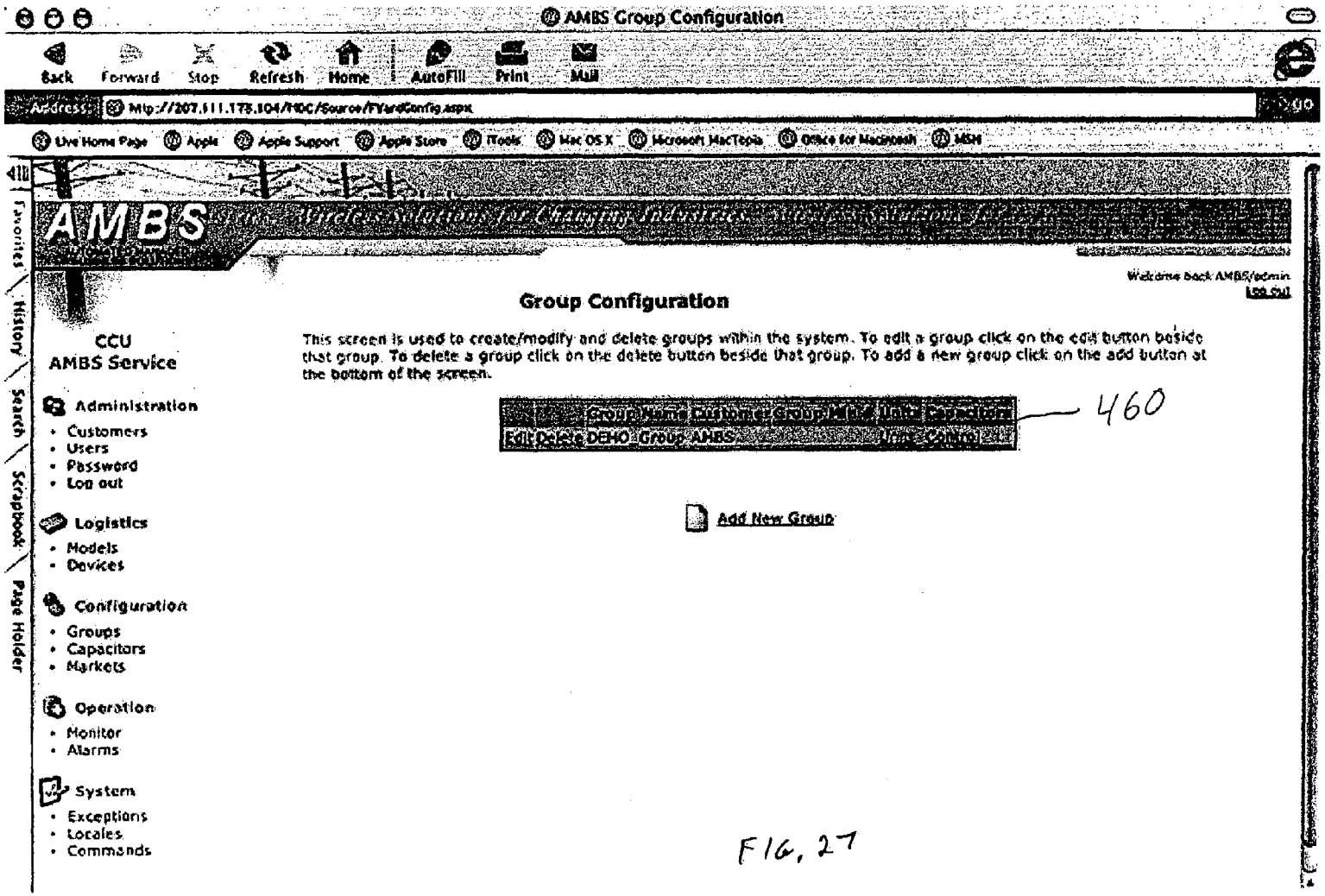
FIG. 27 is an image of a screen accessible from the screen of FIG. 13.
Figure 28:
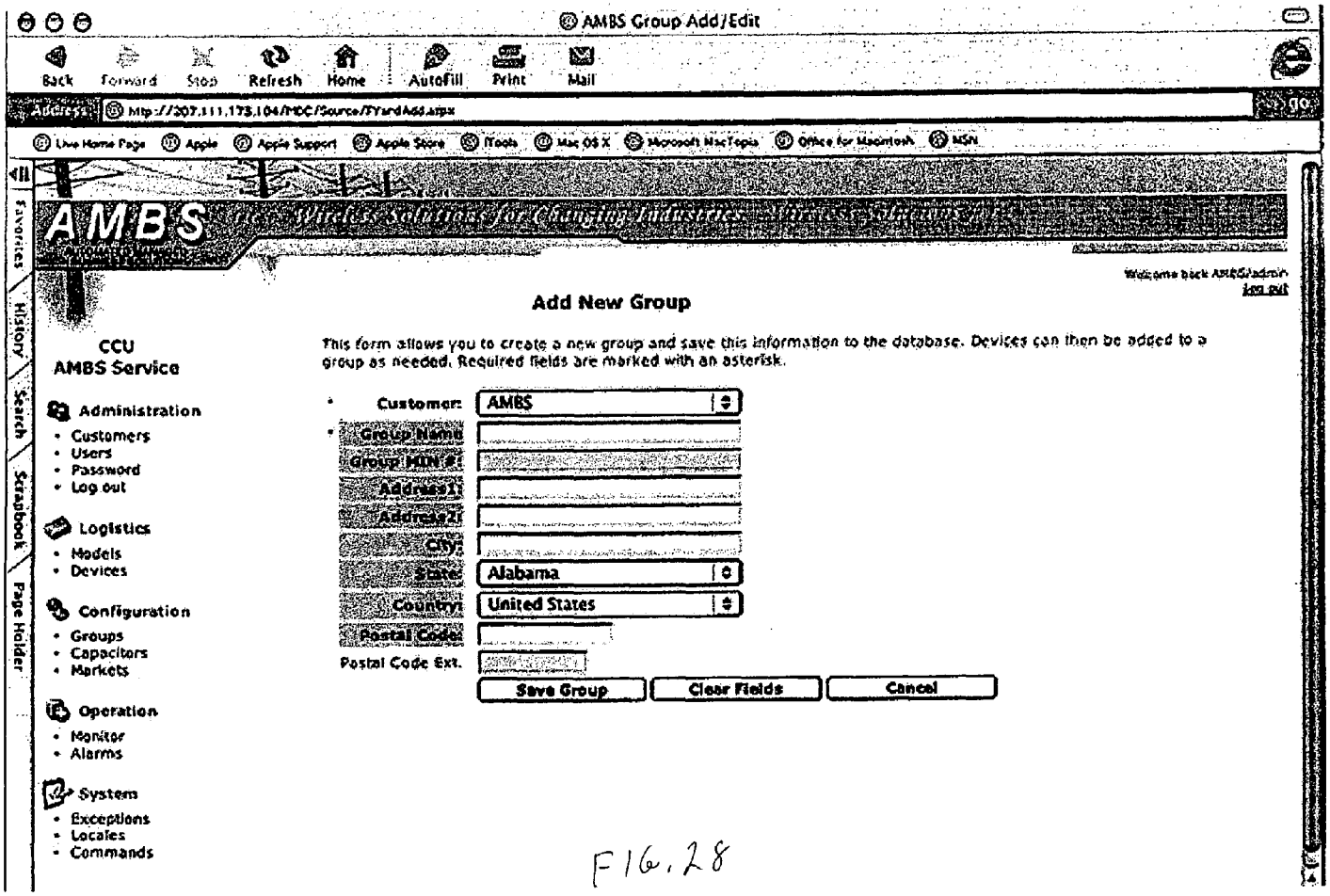
FIG. 28 is an image of a screen acessible from the screen of FIG. 27.
Figure 29:
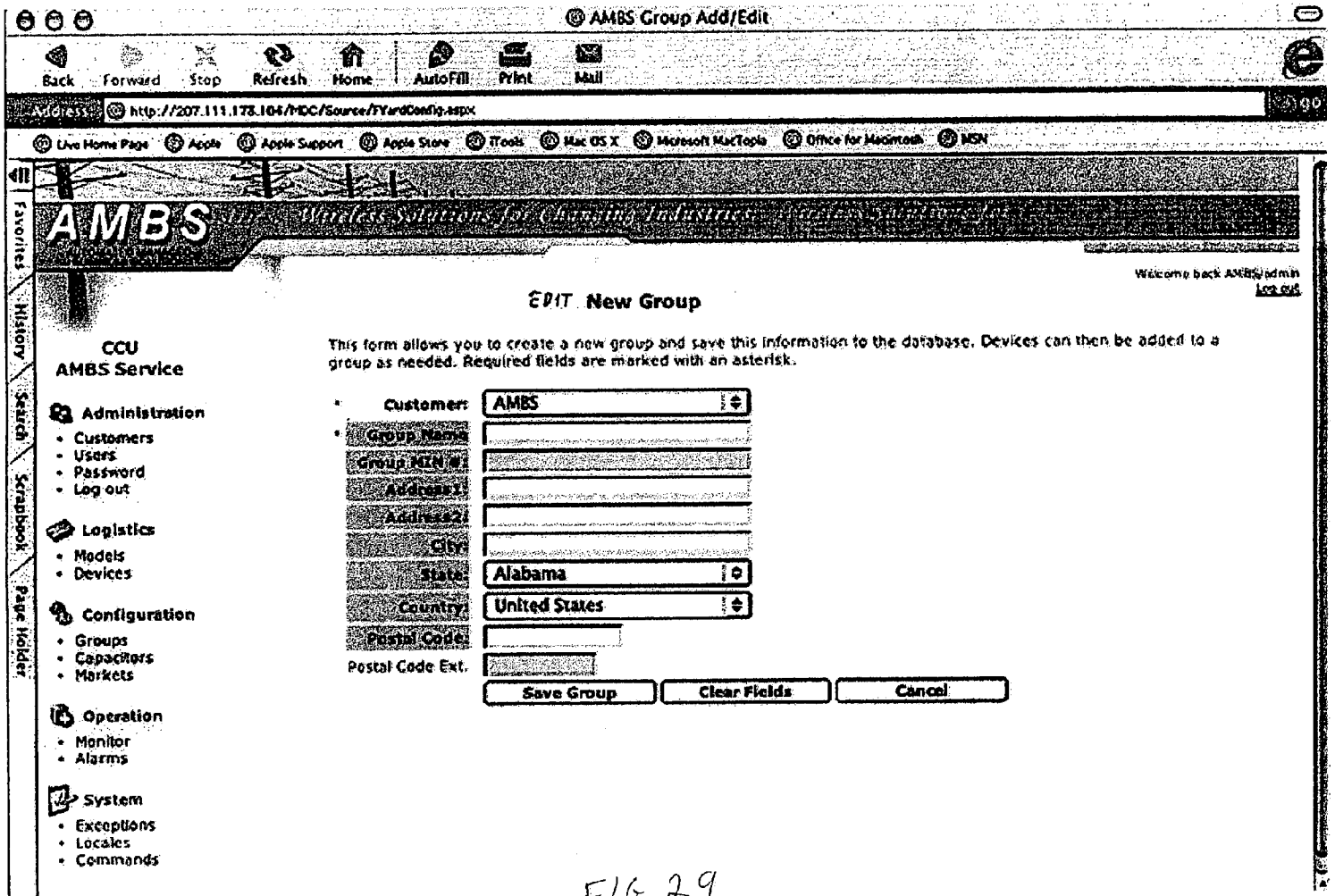
FIG. 29 is an image of a screen accessible from the screen of FIG. 27.

When a user selects CONFIGURATION, GROUPS of the screen of FIG. 13, a screen as shown in FIG. 27 is presented. This screen is used to configure groups of remote units according to unique criteria defined by each individual customer user. For instance, a railroad company would typically want all switch heaters in a single railroad switch-yard to be in a single group so as to be able to perform global operations on all the switch heaters, such as to energize or de-energize them all at once, or to energize or de-energize individual switch heaters. Likewise, an electrical utility company may wish to group a plurality of electrical meters, such as those in a neighborhood, in a single group. Such grouping is accomplished through the screen of FIG. 27. As in previous screens, a central field 460 lists existing groups, and a small field labeled ADD NEW GROUP is below field 460. When this field ADD NEW GROUP is selected, the screen of FIG. 28 is presented, where the user fills in the appropriate fields to define which remote units are in a particular group. As shown, the field GROUP MIN # is a MIN number that addresses all remote units in a group in order to perform global operations within that group. After the remote units are assigned to a group, the group is saved by selecting the SAVE GROUP button.

Figure 30:
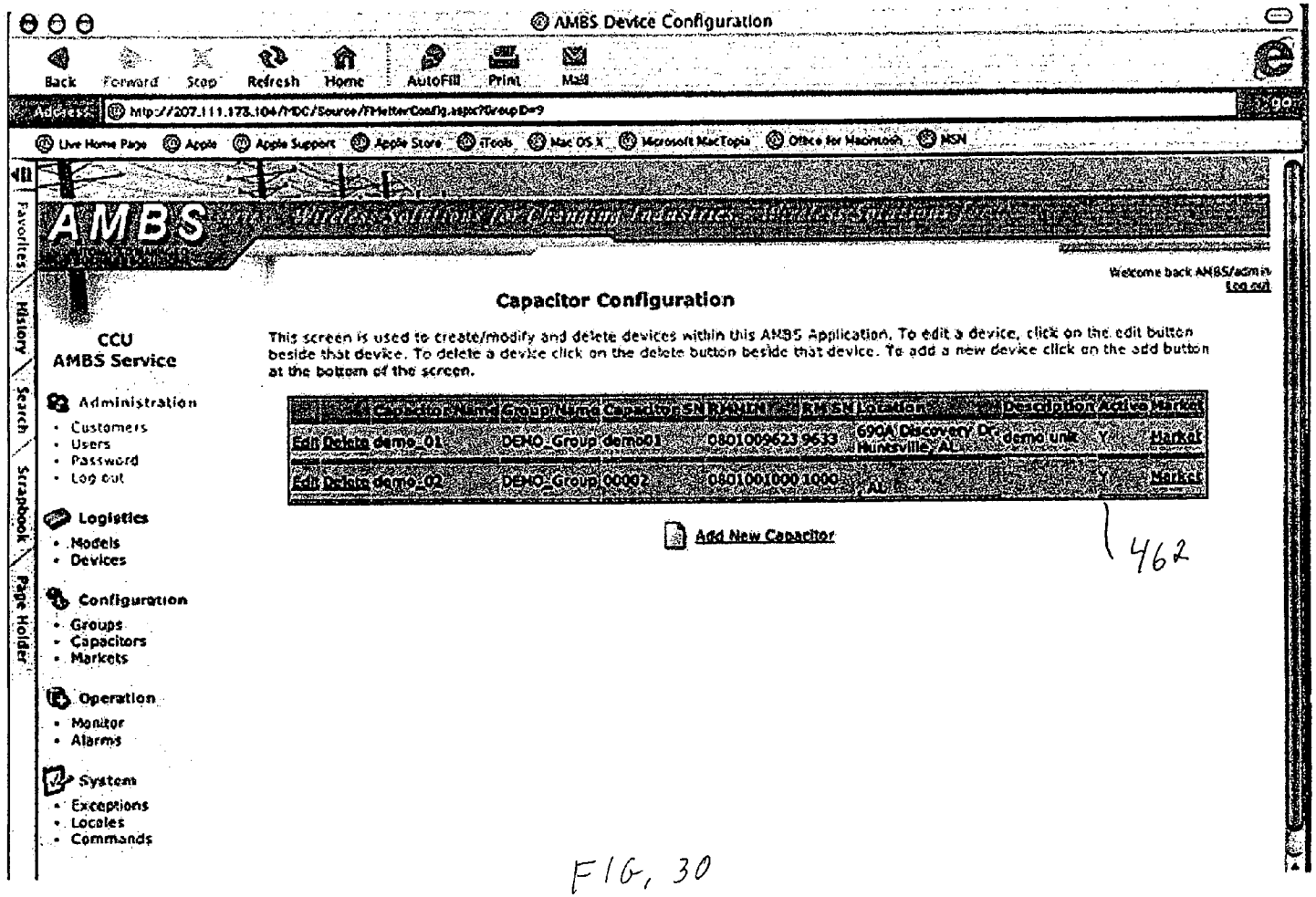
FIG. 30 is an image of a screen accessible from the screen of FIG. 13.
Figure 31:
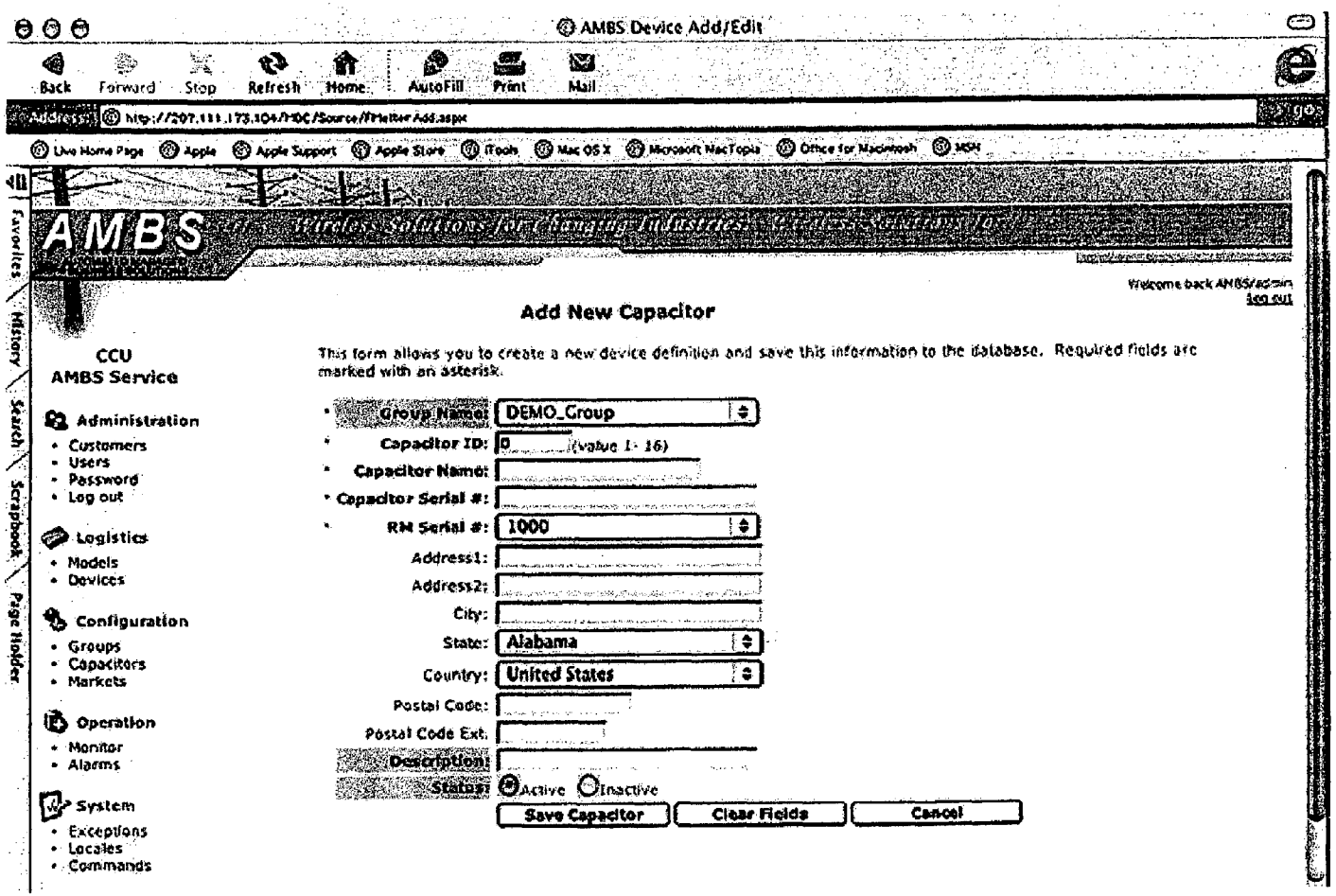
FIG. 31 is an image of a screen accessible from the screen of FIG. 30.

Editing of the groups is accomplished by selecting EDIT for a particular group shown in field 460 of FIG. 27. This brings up the screen of FIG. 29 where the fields with entered information as shown in FIG. 28 are displayed for editing. After editing for the group is finished, the SAVE GROUP button is selected to save the edited group information to the database.

Where a group is to be deleted, the DELETE selection in field 460 of the screen of FIG. 27 is selected, which brings up a screen similar to screen 16*a* asking confirmation of deletion of the group with which the DELETE selection is associated. A YES/NO confirmation is required to be entered by the user in order to effect the group deletion.

Where particular remote units in a group are to be configured or reconfigured, such as remote units that control switching of capacitor banks in a particular group of capacitor banks, a user selects CONFIGURATION, GROUPS, UNITS to bring up the screen of FIG. 30, which contains a field 462 containing a list of capacitors within the group of capacitors. While a group of capacitors are shown in the screen of FIG. 30, it should be apparent that features of this screen are applicable to groups of any remote units.

Figure 32:
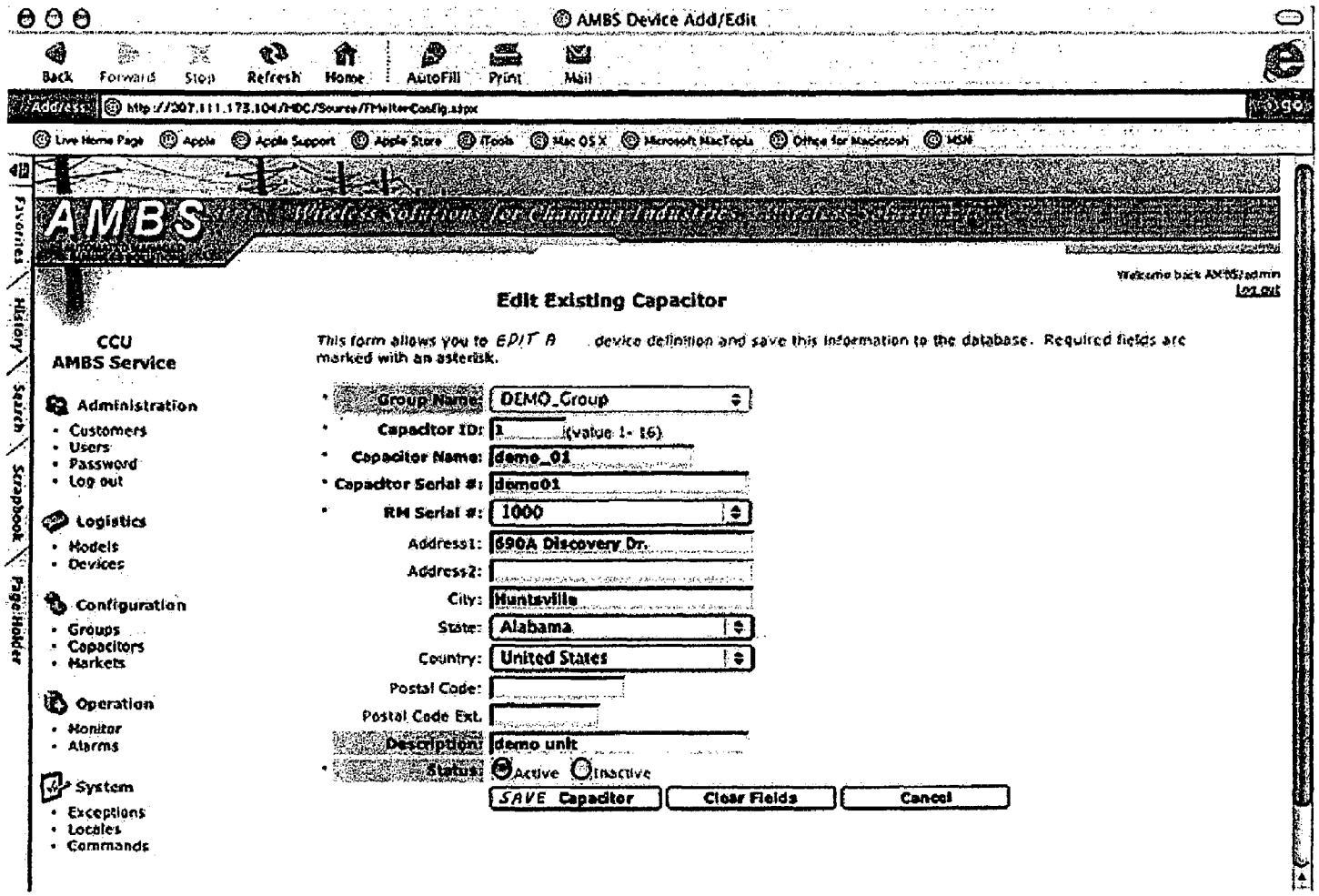
FIG. 32 is an image of a screen accessible from the screen of FIG. 30.

In this screen, a user may add a new capability or change configuration of a remote unit. This screen is used, for instance, where a different or updated remote unit is installed as a replacement for an older remote unit. In addition, capabilities of remote units may be changed, as where an electrical connect/disconnect device is added to an existing meter reading remote unit to provide remote connect/disconnect capability to the existing remote meter reading capability. Where a new remote unit for capacitor control, or as stated any other remote unit, is to be added, the field ADD NEW CAPACITOR (or any other device) is selected to bring up the screen of FIG. 31. In this screen, the relevant information for adding a new device, such as a capacitor, is entered into the appropriate fields. After the appropriate fields are filled in, the SAVE CAPACITOR (or other device) is selected to save the information to the database.

Where EDIT is selected for a particular device in field 462 of FIG. 30, the screen of FIG. 32 is presented. As described earlier, this screen allows information for an existing device, such as a capacitor, to be edited. After editing is complete, the SAVE CAPACITOR button is selected to save the edited information to the database. Deletion of a capacitor is accomplished by selecting DELETE by a respective capacitor in field 462 of FIG. 30, this action bringing up a confirmation screen as described above.

Figure 33:
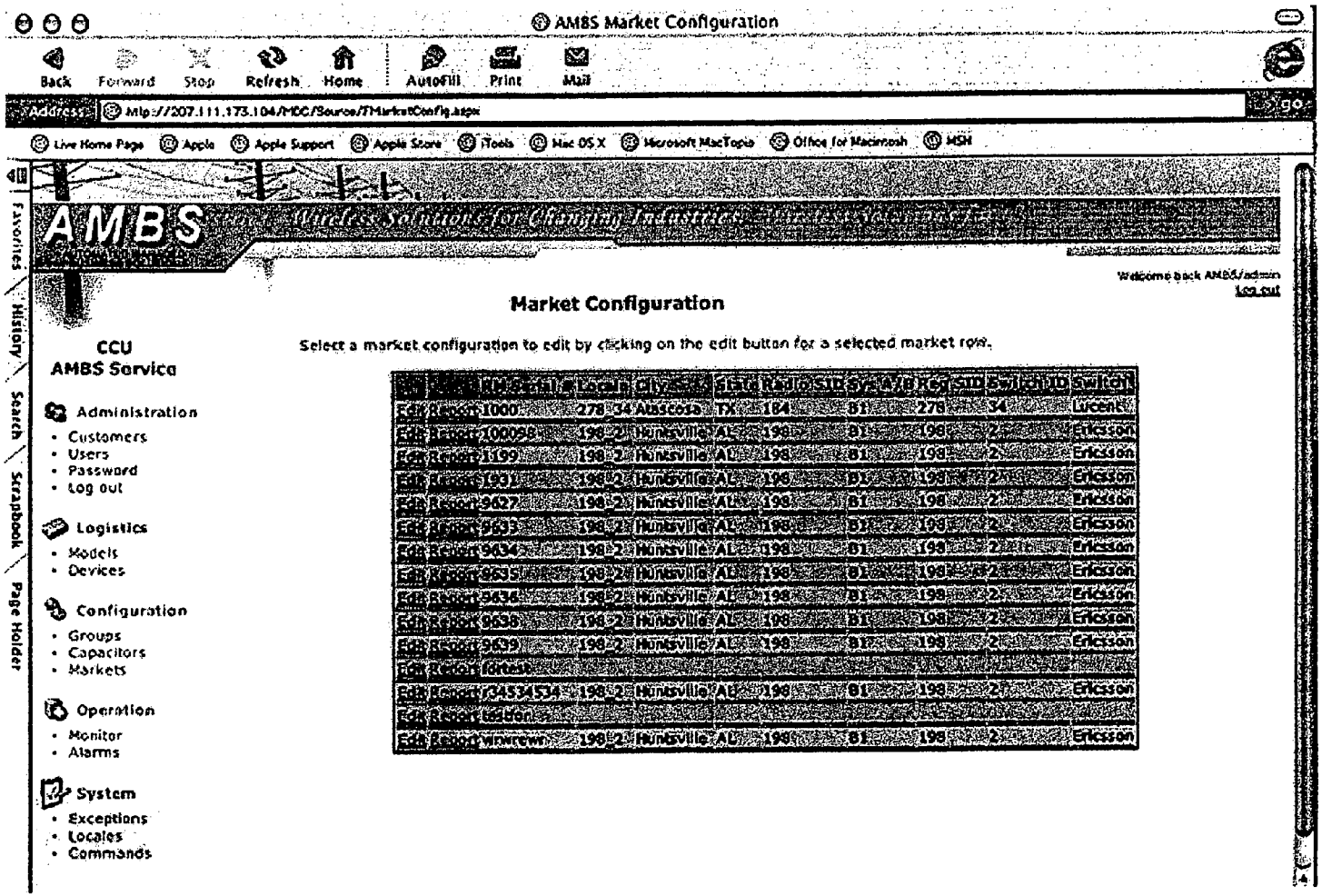
FIG. 33 is an image of a screen accessible from the screen of FIG. 13.
Figure 34:
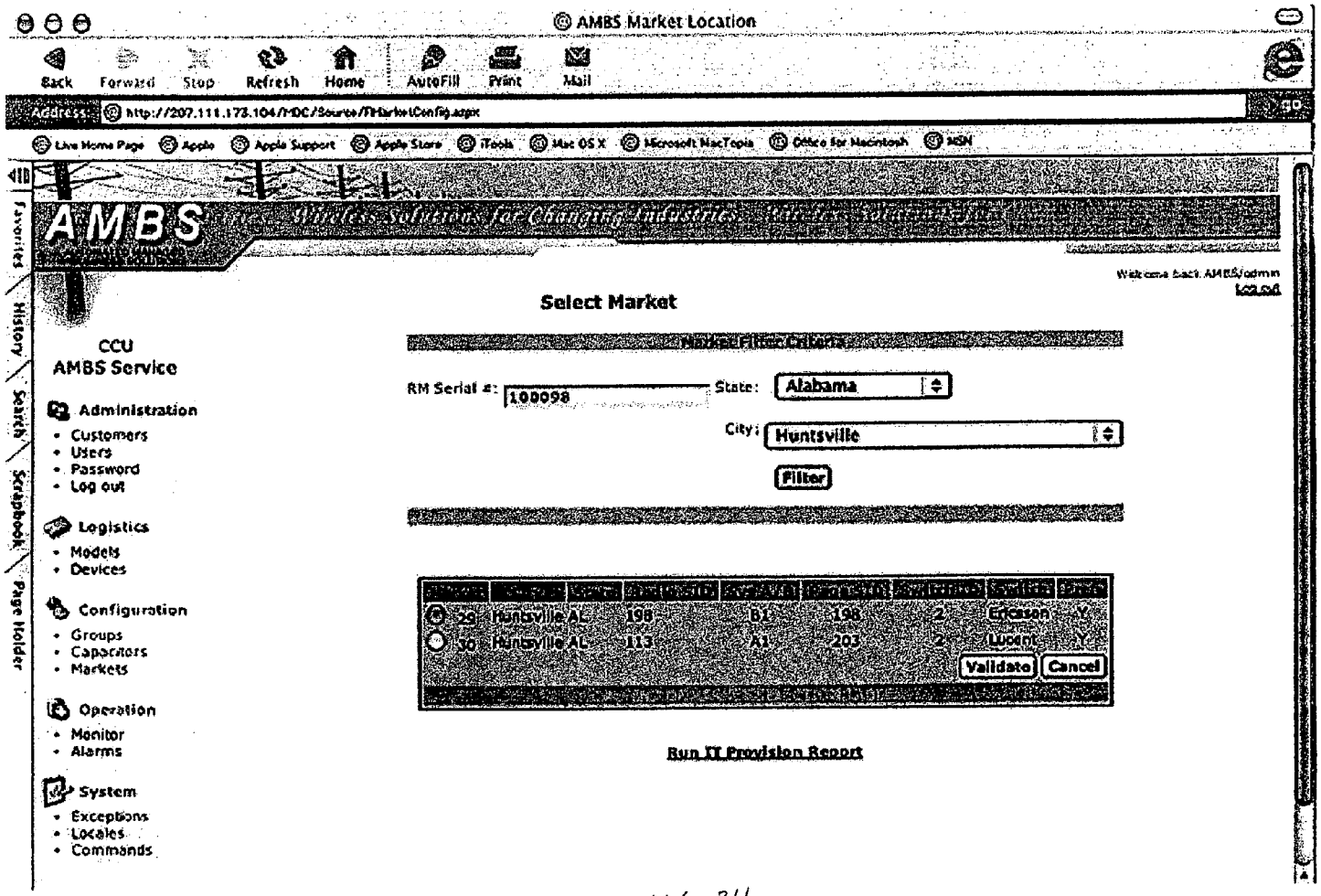
FIG. 34 is an image of a screen acessible from the screen of FIG. 34.
Figure 35:
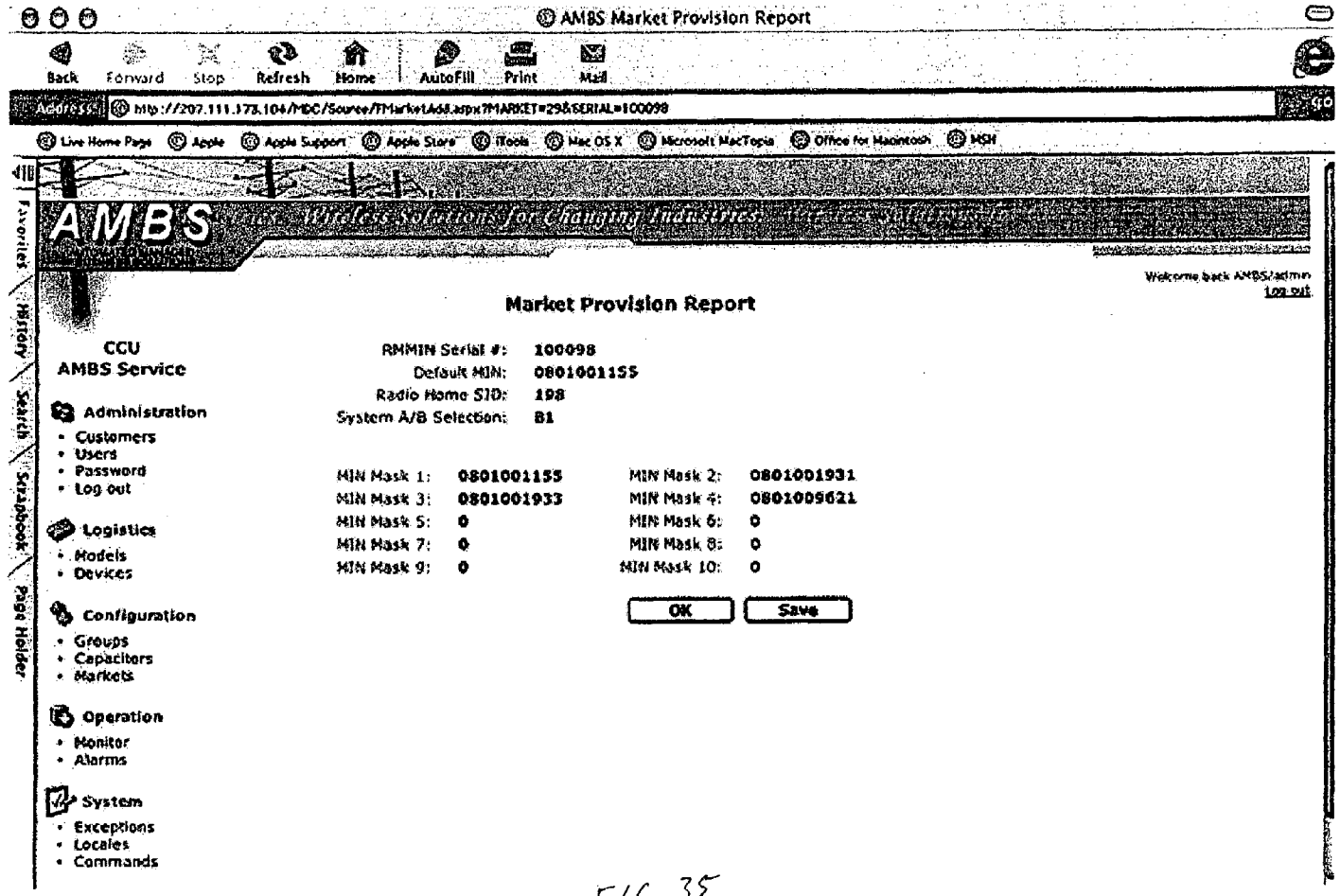
FIG. 35 is an image of a screen accessible from the screen of FIG. 35.

For entering a market configuration, for example a market configuration for capacitors, CONFIGURATION, CAPACITORS, MARKETS is selected in the screen of FIG. 33. This screen indicates parameters of system performance and location of particular remote units. This is useful, for instance, where customer users need to know what to expect from cellular coverage in their area, as some cellular switches perform differently from others. In addition, this screen relates to configuration of MIN and registration numbers and how they are set up within the cellular network.

For monitoring operation of remote units, OPERATION, MONITOR of the screen of FIG. 13 is selected. This brings up the screen of FIG. 36. Here, rows of indicators 470 indicate a condition or status, as by color, of remote units in a group. A legend 472 provides a user, typically a customer user, with a status associated with a particular color. Global commands may be issued by selecting buttons labeled OPEN ALL CAPACITORS or CLOSE ALL CAPACITORS. In the instance the user wishes to view events, such as where automated functions are performed by remote units such as reclosers, or where a fault has occurred as indicated by color change to a fault condition of one of indicators 470, then SHOW EVENTS WINDOW may be selected to bring up the screen of FIG. 37. In this window, a field 474 shows an event history, along with buttons labeled CLEAR RESULTS and SAVE RESULTS. When saved, the events are saved to a log file.

The device status screen of FIG. 38 may be presented when a pointing device, such as a mouse, is used to right-click on one of the indicators 470 of the screen of FIG.

36. As shown, this brings up a device status and control window for the device selected in the screen of FIG. 36. Indicators 476 show status of the device, and buttons marked OPEN CAP and CLOSE CAP, when selected, caused the indicated operation to be performed. As stated, while the screen of FIG. 38 is specifically for capacitors to balance power factor, this screen may be configured and used for any remote unit.

Figure 39:
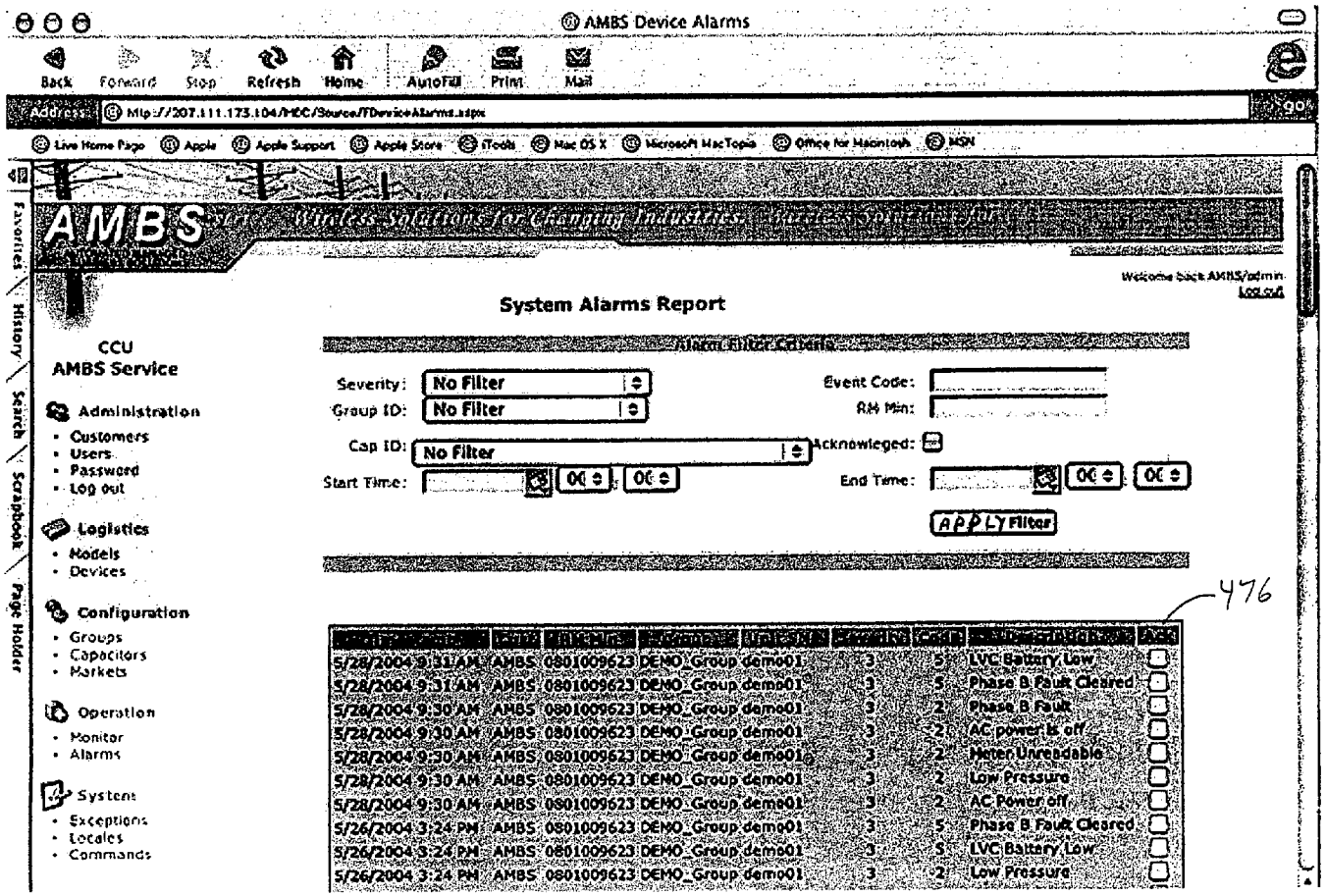
FIG. 39 is an image of a screen accessible from the screen of FIG. 13.
Figure 39A:
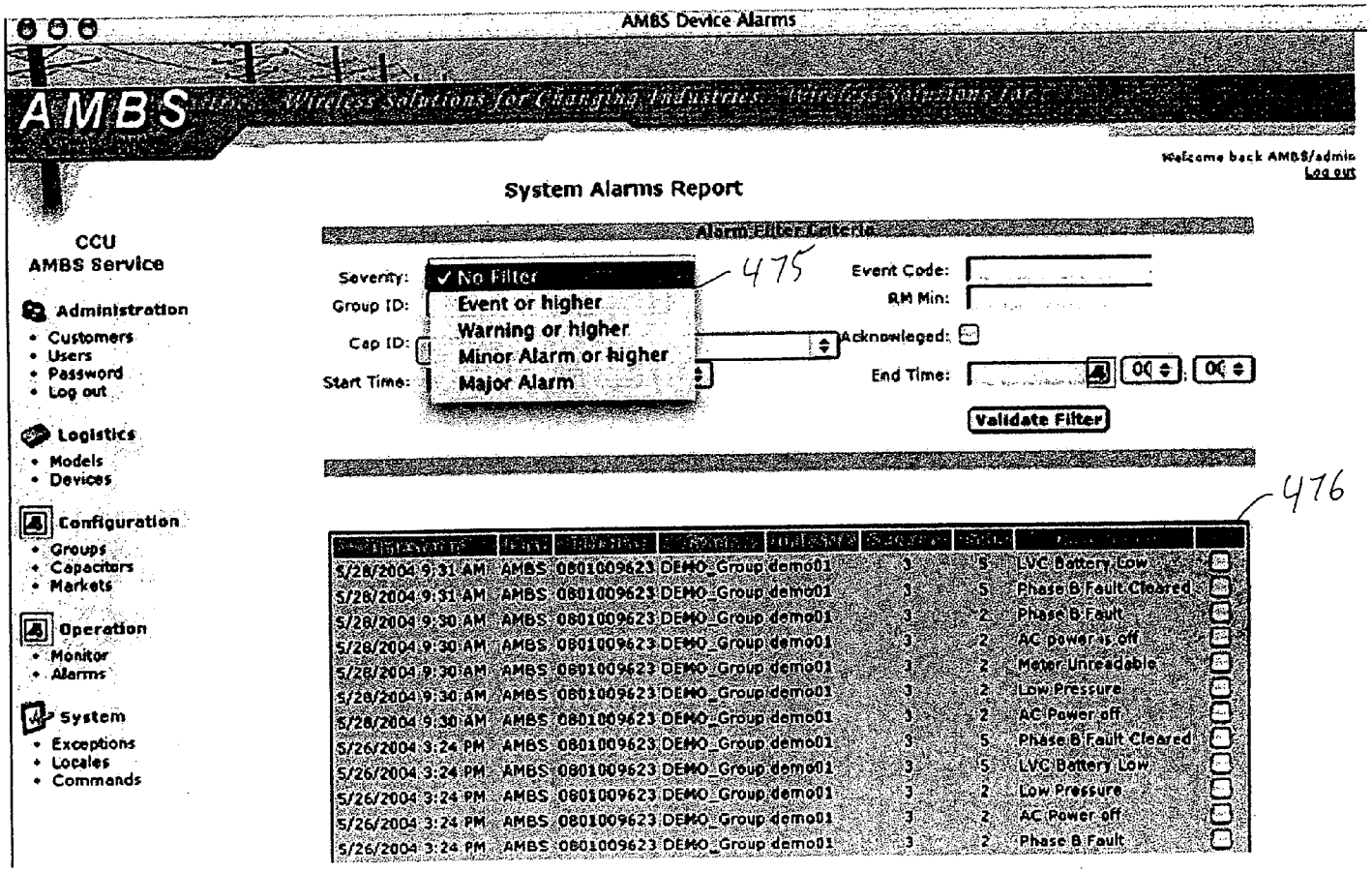
FIG. 39*a* is an image of a screen showing a pop-up menu in the screen of FIG. 39.

When OPERATION, ALARMS of the screen of FIG. 13 is selected, the screen of FIG. 39 is presented. Here, a list 476 is presented that includes a timestamp, the customer, remote MIN number, severity of the alarm and a general description as to the cause of the alarm. In this screen, filters are available where it is desired to only look at a category of alarms, a category of groups or a particular remote unit, such as a capacitor remote unit. Under the SEVERITY filter, where NO FILTER is selected, field 476 includes all alarms. Where, for example, the filter MAJOR ALARMS is selected from a pop-up menu 475 as shown in FIG. 39*a* that appears when a filter arrow is selected, then field 476 would only show those alarms deemed a major alarm. As should be apparent, alarms are ranked in order of severity of EVENT OR HIGHER being a lowest severity, and which is assigned to a numerical category of 1 (FIG. 40), EVENT OR HIGHER being assigned a numerical category of 2, MINOR ALARM OR HIGHER being assigned to 3 and MAJOR ALARM being assigned to 4. of course, the filter is not applied until the user selects the button labeled APPLY FILTER.

Figure 40:
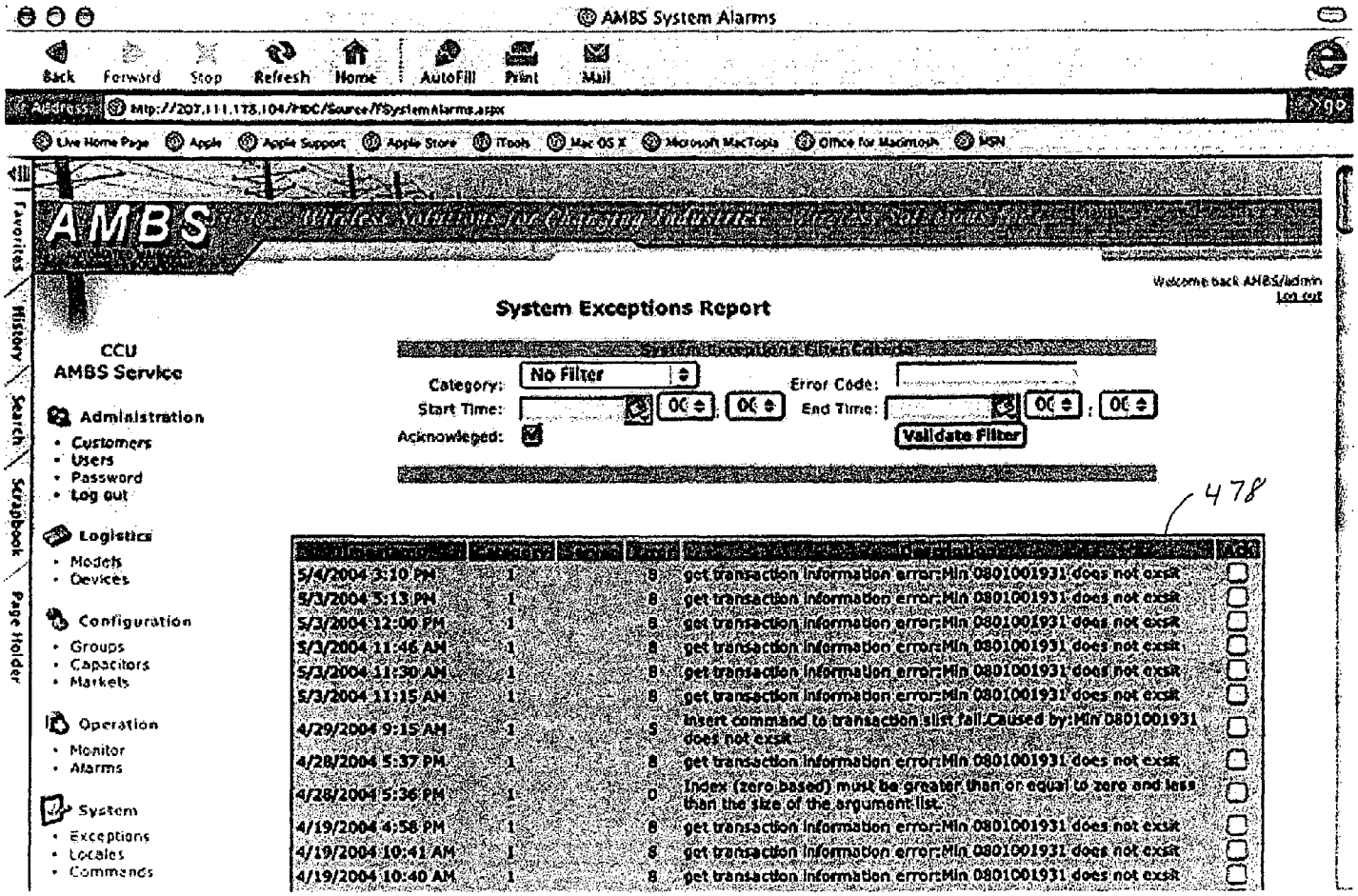
FIG. 40 is an image of a screen accessible from the screen of FIG. 13.

New incoming alarms are displayed in fields labeled EVENT CODE, which indicates severity of the alarm, and a RM MIN field indicating the remote unit MIN number that generated the alarm. After being acknowledged, as by selecting the ACKNOWLEDGE box, the respective alarm indication ACK box in field 476 for the alarm is either grayed out or a check is placed in the box. Where a plurality of alarms arrive simultaneously or too fast for a user to acknowledge them, they simply are placed in order in field 476 with the ACK box blank until a user has an opportunity to act on them. In some instances, as with alarms above a selected severity, the software may be configured so that the user may not place a check in an alarm box until the alarm is opened from within field 476. In the event that a user, such as a customer user, wishes to view system exceptions, then SYSTEM, EXCEPTIONS of the screen of FIG. 13 is selected, as shown by the screen of FIG. 40. In this screen, a field 478 provides a list of system exceptions that include a timestamp and general description as to the cause of the exception. At a bottom of list 478 are buttons (not shown) labeled CLEAR RESULTS and SAVE RESULTS that may be used to clear the exceptions from the list or save the exceptions to a log file.

Figure 41:
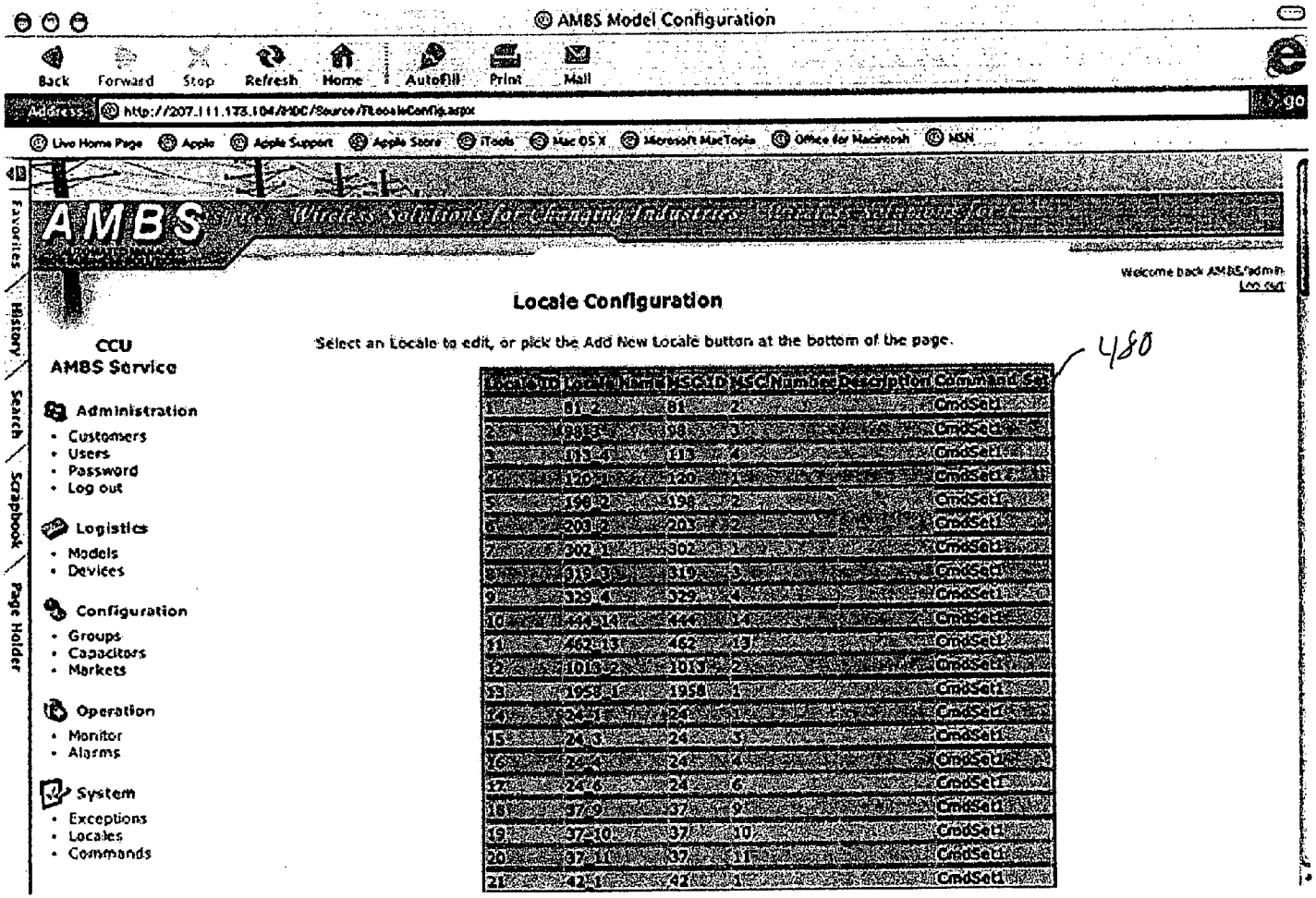
FIG. 41 is an image of a screen accessible from the screen of FIG. 13.

FIG. 41 shows a screen that may be used for viewing locale configurations. Here, devices may be located with respect to which cell tower or switch is connectable to that device.

Figure 42:
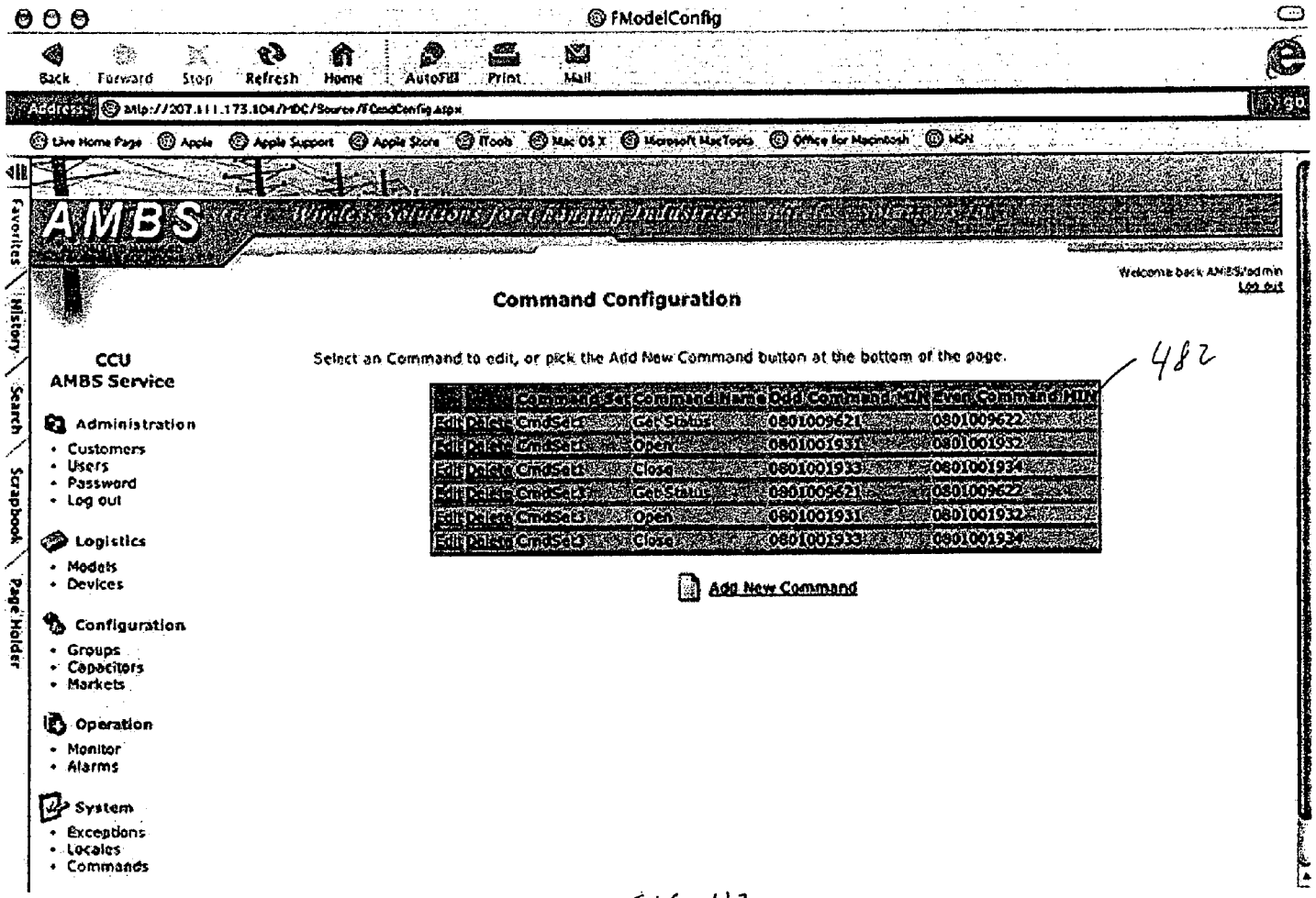
FIG. 42 is an image of a screen accessible from the screen of FIG. 13.
Figure 43:
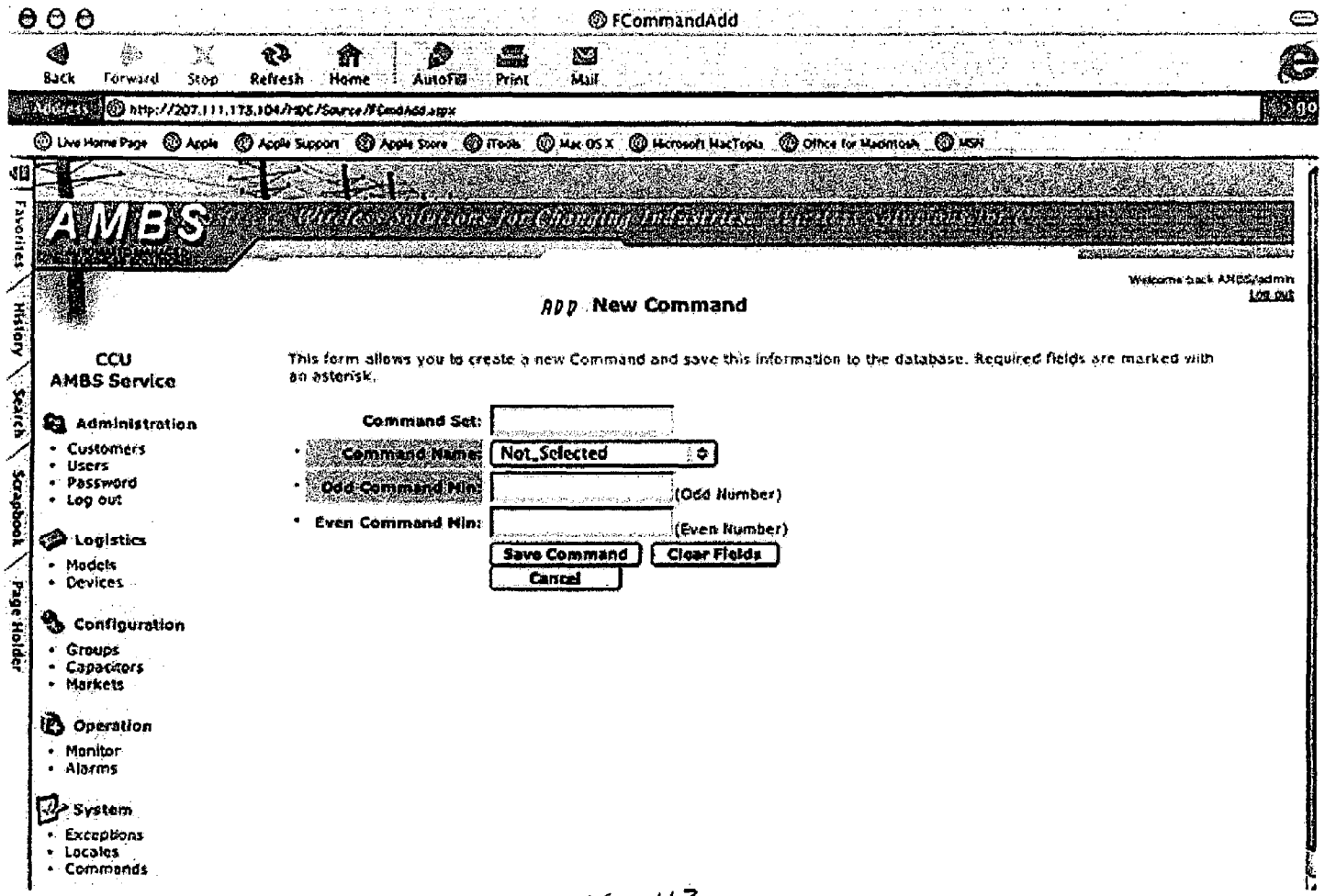
FIG. 43 is an image of a screen accessible from the screen of FIG. 42.
Figure 44:
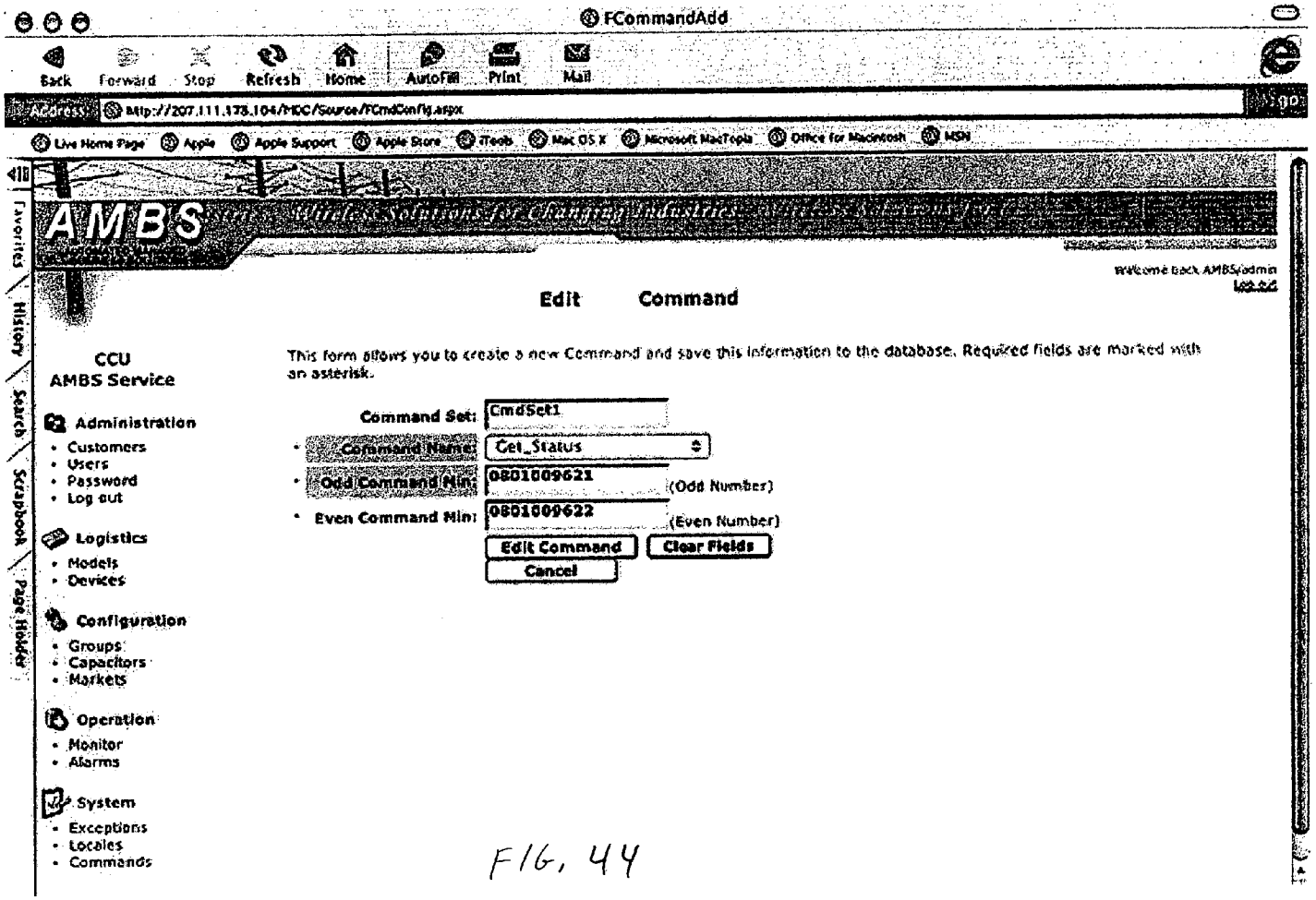
FIG. 44 is an image of a screen accessible from the screen of FIG. 42.

For viewing command configuration, SYSTEM, COMMANDS of the screen of FIG. 13 is selected to bring up the screen as shown in FIG. 42. In this screen, a field 482 shows a list of command sets divided into the A side or B side (odd or even MIN numbers) of the cellular system. At the bottom of this screen, a field labeled ADD NEW COMMAND is provided that when selected, brings up the screen of FIG. 43. Screen 43 is used to add a new command to the system, as where new capabilities are added to existing remote units, as described above or where command structures for newly added MIN numbers are added to the system.

Where an existing command is to be edited, then EDIT is selected for a particular command within field 482 of the screen of FIG. 42. This brings up the screen as shown in FIG. 44 wherein an existing command may be edited, again to add or delete capabilities of existing remote units.

To delete a command, then in field 482 of FIG. 42, DELETE is selected for the command to be deleted in the confirmation screen similar to the screen of FIG. 16*a* asking the question is the user sure that the command is to be deleted. Buttons marked YES and NO are provided to delete the command (YES) or to reject the deletion (NO).

Having thus described my invention and the manner of its use, it should be apparent to those skilled in the arts that incidental modifications may be made thereto that fairly fall within the scope of the following appended claims,

I claim:

1. A collar-based electrical utilities communications system comprising:

a plurality of electrical utilities devices, each of which is deployed at respective separate locations, each of said plurality of electrical utilities devices further comprising:

a collar connected between an electrical utility meter and an electrical utility meter base, said collar comprising at least a switch for performing a function related to said electrical utilities, and a cellular transmitter and a cellular receiver configured for communicating over control channels of a cellular network, and coupled to said switch, said cellular network coupled to the Internet;

a data center associated with said electrical utilities coupled to the Internet; and a user interface associated with said electrical utilities in said data center and configured to allow users to perform operations related to said switch and said electrical utilities devices.

2. An electrical utilities communications system as set forth in claim 1 wherein said switch is a connect/disconnect switch for electrical utilities for a location associated with said electrical meter, said switch responsive to commands from data center and transmitted over said control channels.

3. An electrical utilities communications system as set forth in claim 2, said collar further comprising an electrical meter reading receiving device coupled to said electrical meter and said cellular transmitter, for transferring said electrical meter reading to data center over said control channels to the Internet.

4. An electrical utilities communications system as set forth in claim 3 comprising an electrical meter reading sensor coupled to said electrical meter reading receiving device, said electrical meter reading sensor further comprising a rotor having at least one vane, said rotor attached to an existing shaft in said electrical meter that rotates responsive to electrical power use, and a detector for sensing passage of said vane upon each rotation of said shaft.

5. An electrical utilities communications system as set forth in claim 3 further comprising:

a meter reading device associated with a utilities meter other than said electrical meter, a first radio transceiver coupled to with said meter-reading device, a second radio transceiver associated with said electrical meter, and coupled to said cellular transmitter and said cellular receiver so that meter readings from said utilities meter other than said electrical meter are passed via said control channels to said data center.

6. An electrical utilities communications system as set forth in claim 3 wherein the collar is configured for receiving said electrical meter in electrically operable relation, said collar or adapter in turn adapted to be plugged into a receptacle for said electrical meter, and wherein said switch, said cellular transmitter, and said cellular receiver and said second radio transceiver are mounted in said collar or adapter, whereby to retrofit a location with said electrical meter with said switch, said cellular transmitter, said cellular receiver and said second transceiver, said collar or adapter is plugged into said receptacle and said meter is plugged into said collar or adapter.

7. An electrical utilities communications system as set forth in claim 2 further comprising an "electrical utilities remaining" notification device coupled to said cellular transmitter and indicating a usable amount of utilities from said data center that a customer has paid in advance that when are used said switch is activated to shut off said electrical utilities.

8. An electrical utilities communications system as set forth in claim 7 wherein said "electrical utilities remaining" notification device is located within a residence or business metered by said electrical meter, and further comprises an acknowledgement switch for indicating to said data center acknowledgement by a consumer of a remaining said usable amount of utilities.

9. An electrical utilities communications system as set forth in claim 8 wherein said "electrical utilities remaining" notification device is coupled to said cellular transmitter by a power line carrier system.

10. An electrical utilities communications system as set forth in claim 1 further comprising:

a radio transceiver, a second cellular transmitter and a second cellular receiver, a microprocessor coupled to said radio transceiver, said second cellular transmitter and said second cellular receiver, and configured so that said radio transceiver receives radio transmissions representative of a plurality of electrical meter readings from a plurality of said electrical meters and a plurality of other meter readings from a plurality of other utilities meters, with said cellular transmitter passing said plurality of electrical meter readings and said plurality of other meter readings to said data center.

11. An electrical utilities communications system as set forth in claim 10 wherein said radio transceiver, said second cellular transmitter, said second cellular receiver and said microprocessor are integrated into a single unit remotely located from any of said utilities meters and said electrical meters.

12. An electrical utilities communications system as set forth in claim 10 wherein said radio transceiver, said second cellular transmitter, said second cellular receiver and said microprocessor are constructed as a single unit and integrated into an electrical meter.

13. An automated meter reading system comprising:

a hollow collar having a first set of electrical terminals pluggable into a receptacle for a local electrical meter, a second set of electrical terminals that receive said local electrical meter, said first set of electrical terminals and said second set of electrical terminals communicating electrical power therebetween, an electrically shielded electronics package mounted in said hollow collar, said electronics package coupled to said local electrical meter and further comprising:

a microprocessor receiving indications of consumed electrical power from said local electrical meter, a cellular transmitter and cellular receiver coupled to said microprocessor, said microprocessor, said cellular transmitter and said cellular receiver configured for transmitting a local electrical meter reading from said local electrical meter to the Internet via cellular control channels, a battery backup and control system for powering said microprocessor, said cellular transmitter and said cellular receiver during a power failure to notify the data center associated with said electrical utilities coupled to the Internet of said power failure.

14. An automated meter reading system as set forth in claim 13 further comprising a connect/disconnect switch for electrical utilities for a location associated with said electrical meter, said switch responsive to commands from a data center and transmitted over said control channels, said switch mounted between said first set of contacts and said second set of contacts, and responsive to said microprocessor receiving an OPEN or CLOSE command from said data center to disconnect or connect, respectively, electrical power at a location monitored by said local electrical meter.

15. An automated meter reading system as set forth in claim 14 further comprising an "electrical utilities remaining" notification device coupled to said transmitter for notifying a customer of a remaining quantity of electrical power available in a prepaid electrical utilities system.

16. An automated meter reading system as set forth in claim 14 further comprising:

a meter reading sensor operatively positioned on at least one local utilities meter other than said local electrical meter, a first radio transmitter and power supply coupled to said meter reading sensor, a radio receiver mounted in said electrically shielded electronics package and coupled to said microprocessor, for receiving a local utilities meter reading from said radio transmitter and passing said local utilities meter reading to said data center over said control channels and the Internet.

17. An automated meter reading system as set forth in claim 16 further comprising a second radio transmitter coupled to a remote electrical meter and configured for transmitting a remote electrical meter reading to said radio receiver in said electrically shielded electronics package for transmittal to said data center over said control channels and the Internet.

18. An automatic meter reading system as set forth in claim 17 further comprising a third radio transmitter coupled to a remote utilities meter other than said remote electrical meter and configured for transmitting a remote meter reading other than said remote electrical meter reading to said radio receiver in said electrically shielded electronics package for transmittal to said data center over said control channels and the Internet.

19. An automatic meter reading system as set forth in claim 15, wherein the "electrical utilities remaining" notification device is located within a residence or business metered by said electrical meter, and further comprises an acknowledgement switch for indicating to said data center acknowledgement by a consumer of a remaining said usable amount of utilities.

20. A collar-based electrical utilities communications system comprising:

a plurality of electrical utilities devices, each of which is deployed at respective separate locations, each of said plurality of electrical utilities devices further comprising:

a collar connected between an electrical utility meter and an electrical utility meter base, said collar comprising at least a switch for performing a function related to said electrical utilities, and a communication means coupled to said switch, said communication means configured for communicating over a communication network;

a data center associated with said electrical utilities coupled to the communication network; and a user interface associated with said electrical utilities in said data center and configured to allow users to perform operations related to said switch and said electrical utilities devices.

21. An electrical utilities communications system as set forth in claim 20 wherein said switch is a connect/disconnect switch for electrical utilities for a location associated with said electrical meter, said switch responsive to commands from said data center and transmitted over said communication network.

22. An electrical utilities communications system as set forth in claim 21, said collar further comprising an electrical meter reading receiving device coupled to said electrical meter and said communication means, for transferring said electrical meter reading to data center over said communication network.

23. An electrical utilities communications system as set forth in claim 21 wherein the collar is configured for receiving said electrical meter in electrically operable relation, said collar or adapter in turn adapted to be plugged into a receptacle for said electrical meter, and wherein said switch and said communication means are mounted in said collar or adapter, whereby to retrofit a location with said electrical meter with said switch and said communication means, said collar or adapter is plugged into said receptacle and said meter is plugged into said collar or adapter.

24. An electrical utilities communications system as set forth in claim 21 further comprising an "electrical utilities remaining" notification device coupled to said communication means and indicating a usable amount of utilities from said data center that a customer has paid in advance that when are used said switch is activated to shut off said electrical utilities.

25. An electrical utilities communications system as set forth in claim 24 wherein said "electrical utilities remaining" notification device is located within a residence or business metered by said electrical meter, and further comprises an acknowledgement switch for indicating to said data center acknowledgement by a consumer of a remaining said usable amount of utilities.

26. An electrical utilities communications system as set forth in claim 21 wherein said communication network is selected from the group of: a fiber optic network, a power line carrier, a wireless network, and a mobile data service.

* * * * *